US010913288B2

(12) United States Patent
Nishimura

(10) Patent No.: US 10,913,288 B2
(45) Date of Patent: Feb. 9, 2021

(54) THERMAL TRANSFER PRINTING APPARATUS, METHOD FOR CALIBRATING THERMAL TRANSFER PRINTING APPARATUS, AND PRINTING METHOD OF THERMAL TRANSFER PRINTING APPARATUS

(71) Applicant: Mitsubishi Electric Corporation, Tokyo (JP)

(72) Inventor: Yoshikuni Nishimura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 33 days.

(21) Appl. No.: 16/484,762

(22) PCT Filed: Oct. 2, 2018

(86) PCT No.: PCT/JP2018/036874
§ 371 (c)(1),
(2) Date: Aug. 8, 2019

(87) PCT Pub. No.: WO2020/070802
PCT Pub. Date: Apr. 9, 2020

(65) Prior Publication Data
US 2020/0406632 A1 Dec. 31, 2020

(51) Int. Cl.
*B41J 29/393* (2006.01)
*B41J 2/36* (2006.01)
*B41J 2/325* (2006.01)

(52) U.S. Cl.
CPC ..... *B41J 2/36* (2013.01); *B41J 2/325* (2013.01); *B41J 29/393* (2013.01)

(58) Field of Classification Search
CPC ..... B41J 2/36; B41J 29/393; B41J 2/325
See application file for complete search history.

(56) References Cited

U.S. PATENT DOCUMENTS 5,132,701 A * 7/1992 Stephenson ..... B41J 2/325 347/176
5,140,341 A * 8/1992 Fiscella ..... B41J 2/325 347/176

(Continued)

FOREIGN PATENT DOCUMENTS

JP 2004-82610 A 3/2004
WO WO 2016/151971 A1 3/2004
WO WO 2011/125134 A1 10/2011

OTHER PUBLICATIONS

International Search Report, issued in PCT/JP2018/036874, PCT/ISA/210, dated Nov. 13, 2018.

*Primary Examiner* — Huan H Tran
(74) *Attorney, Agent, or Firm* — Birch, Stewart, Kolasch & Birch, LLP

(57) ABSTRACT

A thermal transfer printing apparatus includes a storage to store a plurality of density adjustment parameters that are each associated with a corresponding one of a plurality of first-page calibration patterns and a plurality of second-page calibration patterns, a density adjustment processing part to adjust data on a color gradation value of a first-page superimposing portion and data on a gradation value of a second-page superimposing portion using their respective associated density adjustment parameters, and a printing part to make a print on recording paper to form a plurality of printed calibration patterns that include a printed superimposing portion where the first-page superimposing portion and the second-page superimposing portion are superimposed on each other based on data on color densities adjusted by the density adjustment processing part. A color density of the printed superimposing portion printed on the recording paper varies for each of the printed calibration patterns.

9 Claims, 21 Drawing Sheets

(56) References Cited

U.S. PATENT DOCUMENTS

| | | | | |
|---|---|---|---|---|
| 5,450,099 | A | 9/1995 | Stephenson et al. | |
| 10,005,291 | B2 * | 6/2018 | Yamazaki | B41J 2/525 |
| 2013/0016172 | A1 * | 1/2013 | Furuki | B41J 2/325<br>347/172 |
| 2017/0210143 | A1 * | 7/2017 | Yamazaki | B41J 2/36 |
| 2020/0122479 | A1 * | 4/2020 | Okinaka | B41J 2/362 |

* cited by examiner

FIG. 8

LINE NUMBER IN SUB-SCANNING DIRECTION Y

| LINE NUMBER IN PRIMARY SCANNING DIRECTION X | ··· | #TPs-1 | #TPs | #TPs+1 | ··· | #TPe-1 | #TPe | #TPe+1 | ··· |
|---|---|---|---|---|---|---|---|---|---|
| ⋮ | ⋱ | ⋮ | ⋮ | ⋮ | ⋱ | ⋮ | ⋮ | ⋮ | ⋱ |
| #LYa-1 | ··· | 0 | 0 | 0 | ··· | 0 | 0 | 0 | ··· |
| #LYa | ··· | 0 | 128 | 128 | ··· | 128 | 128 | 0 | ··· |
| #LYa+1 | ··· | 0 | 128 | 128 | ··· | 128 | 128 | 0 | ··· |
| ⋮ | ⋱ | ⋮ | ⋮ | ⋮ | ⋱ | ⋮ | ⋮ | ⋮ | ⋱ |
| #LYa+LP-1 | ··· | 0 | 128 | 128 | ··· | 128 | 128 | 0 | ··· |
| #LYa+LP | ··· | 0 | 128 | 128 | ··· | 128 | 128 | 0 | ··· |
| #LYa+LP+1 | ··· | 0 | 0 | 0 | ··· | 0 | 0 | 0 | ··· |
| ⋮ | ⋱ | ⋮ | ⋮ | ⋮ | ⋱ | ⋮ | ⋮ | ⋮ | ⋱ |
| #LYb-1 | ··· | 0 | 0 | 0 | ··· | 0 | 0 | 0 | ··· |
| #LYb | ··· | 0 | 128 | 128 | ··· | 128 | 128 | 0 | ··· |
| #LYb+1 | ··· | 0 | 128 | 128 | ··· | 128 | 128 | 0 | ··· |
| ⋮ | ⋱ | ⋮ | ⋮ | ⋮ | ⋱ | ⋮ | ⋮ | ⋮ | ⋱ |
| #LYb+LP-1 | ··· | 0 | 128 | 128 | ··· | 128 | 128 | 0 | ··· |
| #LYb+LP | ··· | 0 | 128 | 128 | ··· | 128 | 128 | 0 | ··· |
| #LYb+LP+1 | ··· | 0 | 0 | 0 | ··· | 0 | 0 | 0 | ··· |
| ⋮ | ⋱ | ⋮ | ⋮ | ⋮ | ⋱ | ⋮ | ⋮ | ⋮ | ⋱ |
| #LYc-1 | ··· | 0 | 0 | 0 | ··· | 0 | 0 | 0 | ··· |
| #LYc | ··· | 0 | 128 | 128 | ··· | 128 | 128 | 0 | ··· |
| #LYc+1 | ··· | 0 | 128 | 128 | ··· | 128 | 128 | 0 | ··· |
| ⋮ | ⋱ | ⋮ | ⋮ | ⋮ | ⋱ | ⋮ | ⋮ | ⋮ | ⋱ |
| #LYc+LP-1 | ··· | 0 | 128 | 128 | ··· | 128 | 128 | 0 | ··· |
| #LYc+LP | ··· | 0 | 128 | 128 | ··· | 128 | 128 | 0 | ··· |
| #LYc+LP+1 | ··· | 0 | 0 | 0 | ··· | 0 | 0 | 0 | ··· |
| ⋮ | ⋱ | ⋮ | ⋮ | ⋮ | ⋱ | ⋮ | ⋮ | ⋮ | ⋱ |

71Ya

71Yb

71Yc

LINE NUMBER IN SUB-SCANNING DIRECTION Y

| CALIBRATION PATTERN | ... | #TPs-1 | #TPs | #TPs+1 | ... | #TPSs-1 | #TPSs | #TPSs+1 | ... | #TPSe-1 | #TPSe | #TPSe+1 | ... | #TPe-1 | #TPe | #TPe+1 |
|---|---|---|---|---|---|---|---|---|---|---|---|---|---|---|---|---|
| FIRST FIRST-PAGE Y-COLOR CALIBRATION PATTERN 71Yaa | ... | 0 | 128 | 128 | ... | 128 | 128 | 128 | ... | 128 | 128 | 0 | ... | 0 | 0 | 0 |
| SECOND FIRST-PAGE Y-COLOR CALIBRATION PATTERN 71Yba | ... | 0 | 128 | 128 | ... | 128 | 128 | 128 | ... | 128 | 128 | 0 | ... | 0 | 0 | 0 |
| THIRD FIRST-PAGE Y-COLOR CALIBRATION PATTERN 71Yca | ... | 0 | 128 | 128 | ... | 128 | 128 | 128 | ... | 128 | 128 | 0 | ... | 0 | 0 | 0 |

LINE NUMBER IN SUB-SCANNING DIRECTION Y

| CALIBRATION PATTERN | ... | #TPs-1 | #TPs | #TPs+1 | ... | #TPSs-1 | #TPSs | #TPSs+1 | ... | #TPSe-1 | #TPSe | #TPSe+1 | ... | #TPe-1 | #TPe | #TPe+1 |
|---|---|---|---|---|---|---|---|---|---|---|---|---|---|---|---|---|
| FIRST SECOND-PAGE Y-COLOR CALIBRATION PATTERN 71Yab | ... | 0 | 0 | 0 | ... | 0 | 128 | 128 | ... | 128 | 128 | 128 | ... | 128 | 128 | 0 |
| SECOND SECOND-PAGE Y-COLOR CALIBRATION PATTERN 71Ybb | ... | 0 | 0 | 0 | ... | 0 | 128 | 128 | ... | 128 | 128 | 128 | ... | 128 | 128 | 0 |
| THIRD SECOND-PAGE Y-COLOR CALIBRATION PATTERN 71Ycb | ... | 0 | 0 | 0 | ... | 0 | 128 | 128 | ... | 128 | 128 | 128 | ... | 128 | 128 | 0 |

FIG. 13

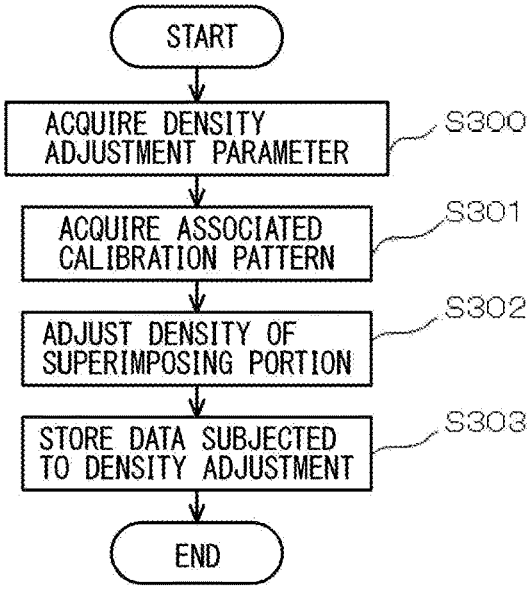

FIG. 14

| CALIBRATION PATTERN | DENSITY ADJUSTMENT PARAMETER |
|---|---|
| FIRST Y-COLOR CALIBRATION PATTERN 71Ya | Ypara1 |
| SECOND Y-COLOR CALIBRATION PATTERN 71Yb | Ypara2 |
| THIRD Y-COLOR CALIBRATION PATTERN 71Yc | Ypara3 |
| FIRST M-COLOR CALIBRATION PATTERN 71Ma | Mpara1 |
| SECOND M-COLOR CALIBRATION PATTERN 71Mb | Mpara2 |
| THIRD M-COLOR CALIBRATION PATTERN 71Mc | Mpara3 |
| FIRST C-COLOR CALIBRATION PATTERN 71Ca | Cpara1 |
| SECOND C-COLOR CALIBRATION PATTERN 71Cb | Cpara2 |
| THIRD C-COLOR CALIBRATION PATTERN 71Cc | Cpara3 |

FIG. 17
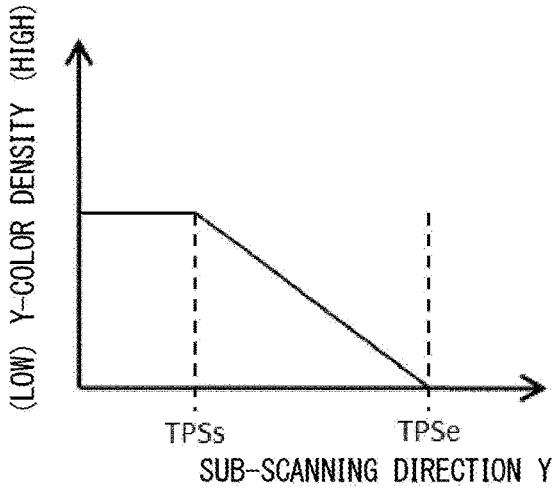
FIG. 18
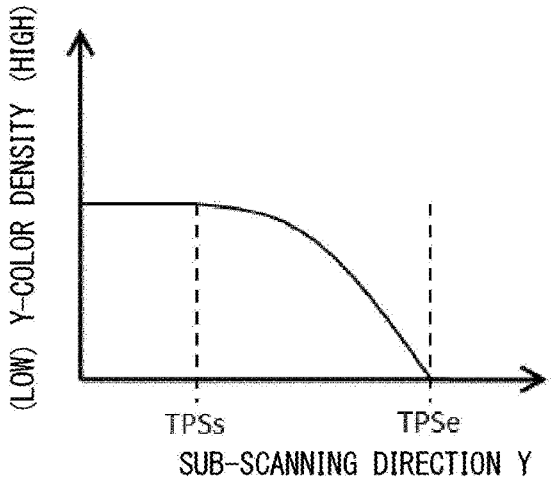
FIG. 19
LINE NUMBER IN SUB-SCANNING DIRECTION Y
| DENSITY ADJUSTMENT PARAMETER | #N | #N+1 | ··· | #N+(TP3)/2-1 | #N+(TP3)/2 | #N+(TP3)/2+1 | ··· | #N+TP3-1 | #N+TP3 |
|---|---|---|---|---|---|---|---|---|---|
| Ypara1 | 1.00 | 0.80 | ··· | 0.35 | 0.25 | 0.20 | ··· | 0.01 | 0.00 |
| Ypara2 | 1.00 | 0.95 | | 0.55 | 0.50 | 0.45 | | 0.05 | 0.00 |
| Ypara3 | 1.00 | 0.99 | | 0.80 | 0.75 | 0.65 | | 0.20 | 0.00 |

LINE NUMBER IN SUB-SCANNING DIRECTION Y

| CALIBRATION PATTERN | ... | #TPs-1 | #TPs | #TPs+1 | ... | #TPSs-1 | #TPSs | #TPSs+1 | ... | #TPSs+(Tp3)/2-1 | #TPSs+(Tp3)/2 | #TPSs+(Tp3)/2+1 | ... | #TPSe-1 | #TPSe | #TPSe+1 |
|---|---|---|---|---|---|---|---|---|---|---|---|---|---|---|---|---|
| FIRST FIRST-PAGE Y-COLOR CALIBRATION PATTERN 71Yaa | ... | 0 | 128 | 128 | ... | 128 | 128 | 102 | ... | 45 | 32 | 26 | ... | 1 | 0 | 0 |
| SECOND FIRST-PAGE Y-COLOR CALIBRATION PATTERN 71Yba | ... | 0 | 128 | 128 | ... | 128 | 128 | 122 | ... | 70 | 64 | 58 | ... | 6 | 0 | 0 |
| THIRD FIRST-PAGE Y-COLOR CALIBRATION PATTERN 71Yca | ... | 0 | 128 | 128 | ... | 128 | 128 | 127 | ... | 102 | 96 | 83 | ... | 26 | 0 | 0 |

FIG. 24

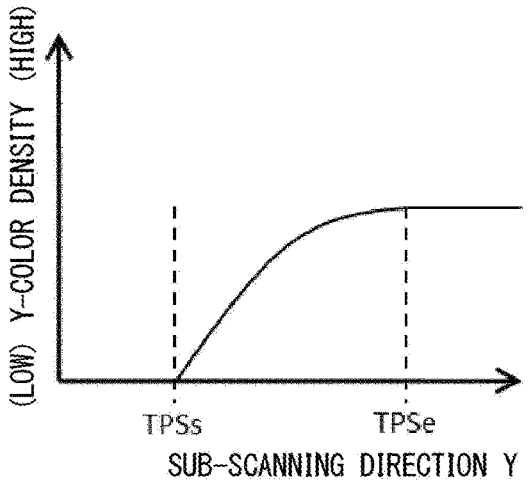

FIG. 25

LINE NUMBER IN SUB-SCANNING DIRECTION Y

| DENSITY ADJUSTMENT PARAMETER | #N | #N+1 | ··· | #N+(TP3)/2-1 | #N+(TP3)/2 | #N+(TP3)/2+1 | ··· | #N+TP3-1 | #N+TP3 |
|---|---|---|---|---|---|---|---|---|---|
| Ypara1 | 0.00 | 0.01 | ··· | 0.20 | 0.25 | 0.35 | ··· | 0.80 | 1.00 |
| Ypara2 | 0.00 | 0.05 | | 0.45 | 0.50 | 0.55 | | 0.95 | 1.00 |
| Ypara3 | 0.00 | 0.20 | | 0.65 | 0.75 | 0.80 | | 0.99 | 1.00 |

FIG. 26

LINE NUMBER IN SUB-SCANNING DIRECTION Y

| CALIBRATION PATTERN | ··· | #TPSs-1 | #TPSs | #TPSs+1 | ··· | #TPSs+(Tp3)/2-1 | #TPSs+(Tp3)/2 | #TPSs+(Tp3)/2+1 | ··· | #TPSe-1 | #TPSe | #TPSe+1 | ··· | #Tpe-1 | #Tpe | #Tpe+1 |
|---|---|---|---|---|---|---|---|---|---|---|---|---|---|---|---|---|
| FIRST SECOND-PAGE Y-COLOR CALIBRATION PATTERN 71Yab | ··· | 0 | 0 | 1 | ··· | 26 | 32 | 45 | ··· | 102 | 128 | 128 | ··· | 128 | 128 | 0 |
| SECOND SECOND-PAGE Y-COLOR CALIBRATION PATTERN 71Ybb | ··· | 0 | 0 | 6 | ··· | 58 | 64 | 70 | ··· | 122 | 128 | 128 | ··· | 128 | 128 | 0 |
| THIRD SECOND-PAGE Y-COLOR CALIBRATION PATTERN 71Ycb | ··· | 0 | 0 | 26 | ··· | 83 | 95 | 102 | ··· | 127 | 128 | 128 | ··· | 128 | 128 | 0 |

FIG. 36

LINE NUMBER IN SUB-SCANNING DIRECTION Y

| LINE NUMBER IN PRIMARY SCANNING DIRECTION X | ··· | #TPs-1 | #TPs | #TPs+1 | ··· | #TPe-1 | #TPe | #TPe+1 | ··· |
|---|---|---|---|---|---|---|---|---|---|
| ⋮ | ⋱ | ⋮ | ⋮ | ⋮ | ⋱ | ⋮ | ⋮ | ⋮ | ⋱ |
| #LYa-1 | ··· | 0 | 0 | 0 | ··· | 0 | 0 | 0 | ··· |
| #LYa | ··· | 0 | 16 | 16 | ··· | 16 | 16 | 0 | ··· |
| #LYa+1 | ··· | 0 | 32 | 32 | ··· | 32 | 32 | 0 | ··· |
| ⋮ | ⋱ | ⋮ | ⋮ | ⋮ | ⋱ | ⋮ | ⋮ | ⋮ | ⋱ |
| #LYa+LP-1 | ··· | 0 | 112 | 112 | ··· | 112 | 112 | 0 | ··· |
| #LYa+LP | ··· | 0 | 128 | 128 | ··· | 128 | 128 | 0 | ··· |
| #LYa+LP+1 | ··· | 0 | 0 | 0 | ··· | 0 | 0 | 0 | ··· |
| ⋮ | ⋱ | ⋮ | ⋮ | ⋮ | ⋱ | ⋮ | ⋮ | ⋮ | ⋱ |
| #LYb-1 | ··· | 0 | 0 | 0 | ··· | 0 | 0 | 0 | ··· |
| #LYb | ··· | 0 | 16 | 16 | ··· | 16 | 16 | 0 | ··· |
| #LYb+1 | ··· | 0 | 32 | 32 | ··· | 32 | 32 | 0 | ··· |
| ⋮ | ⋱ | ⋮ | ⋮ | ⋮ | ⋱ | ⋮ | ⋮ | ⋮ | ⋱ |
| #LYb+LP-1 | ··· | 0 | 112 | 112 | ··· | 112 | 112 | 0 | ··· |
| #LYb+LP | ··· | 0 | 128 | 128 | ··· | 128 | 128 | 0 | ··· |
| #LYb+LP+1 | ··· | 0 | 0 | 0 | ··· | 0 | 0 | 0 | ··· |
| ⋮ | ⋱ | ⋮ | ⋮ | ⋮ | ⋱ | ⋮ | ⋮ | ⋮ | ⋱ |
| #LYc-1 | ··· | 0 | 0 | 0 | ··· | 0 | 0 | 0 | ··· |
| #LYc | ··· | 0 | 16 | 16 | ··· | 16 | 16 | 0 | ··· |
| #LYc+1 | ··· | 0 | 32 | 32 | ··· | 32 | 32 | 0 | ··· |
| ⋮ | ⋱ | ⋮ | ⋮ | ⋮ | ⋱ | ⋮ | ⋮ | ⋮ | ⋱ |
| #LYc+LP-1 | ··· | 0 | 112 | 112 | ··· | 112 | 112 | 0 | ··· |
| #LYc+LP | ··· | 0 | 128 | 128 | ··· | 128 | 128 | 0 | ··· |
| #LYc+LP+1 | ··· | 0 | 0 | 0 | ··· | 0 | 0 | 0 | ··· |
| ⋮ | ⋱ | ⋮ | ⋮ | ⋮ | ⋱ | ⋮ | ⋮ | ⋮ | ⋱ |

71Ya

71Yb

71Yc

FIG. 37

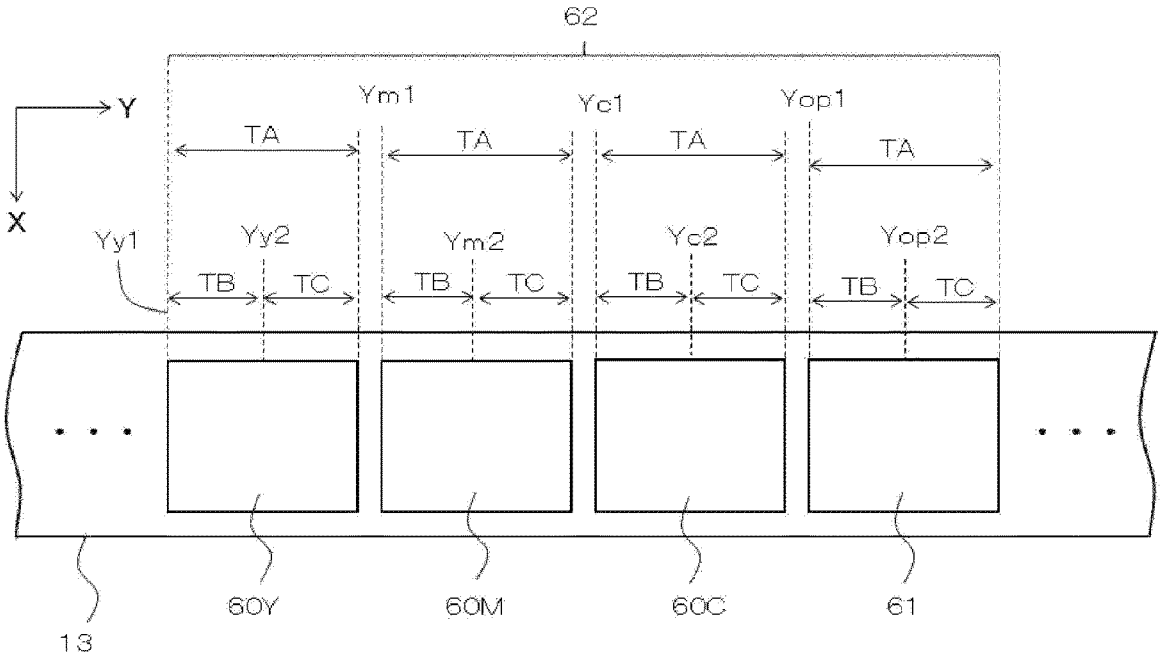

THERMAL TRANSFER PRINTING APPARATUS, METHOD FOR CALIBRATING THERMAL TRANSFER PRINTING APPARATUS, AND PRINTING METHOD OF THERMAL TRANSFER PRINTING APPARATUS

TECHNICAL FIELD

The present invention relates to a thermal transfer printing apparatus, a method for calibrating a thermal transfer printing apparatus, and a printing method of a thermal transfer printing apparatus.

BACKGROUND ART

As shown in Patent Document 1 and Patent Document 2, a thermal transfer printer performs printing by causing a thermal head to apply heat to an ink sheet to which color dyes including a yellow dye, a magenta dye, and a cyan dye are applied to transfer each of the color dyes to recording paper. Note that, in the following description, yellow is referred to as "Y color", magenta is referred to as "M color", and cyan is referred to as "C color".

Recently, digital cameras, and cameras incorporated in mobile phones and smartphones have a wide panoramic photography mode. Therefore, the demand for printing wide panoramic photographs taken in such a panoramic photography mode is on the increase.

Patent Document 1 discloses a thermal transfer printing method in which a wide panoramic picture is divided into a first image and a second image, and the first image to be printed and the second image to be printed are arranged such that an overlapping portion where the first image and the second image overlap one another (corresponding to overlap B in Patent Document 1) is formed. Patent Document 1 further discloses a thermal transfer printing method in which a density process of gradually decreasing a density of the first image in the overlapping portion and gradually increasing a density of the second image in the overlapping portion in a paper feeding direction is performed.

Patent Document 2 discloses a thermal transfer printing method in which a joint shifting process of preventing joints of Y color, M color, and C color in an overlapping portion from being aligned with each other in a sub-scanning transfer direction is performed. Patent Document 2 further discloses a thermal transfer printing method in which a joint density gradual decrease/gradual increase process of correcting gradation data of the overlapping portion on a color to be transferred based on a correction coefficient predetermined for each line in the sub-scanning transfer direction, a joint reverse transfer correction process and a joint excessive transfer correction process of correcting gradation data on a color to be transferred later based on a correction coefficient predetermined for each piece of gradation data on a color to be transferred earlier.

PRIOR ART DOCUMENTS

Patent Documents

Patent Document 1: Japanese Patent Application Laid-Open No. 2004-82610

Patent Document 2: WO 2011/125134 A1

SUMMARY

Problem to be Solved by the Invention

When a wide panoramic photograph is divided into a first image and a second image, and printing is performed such that an overlapping portion where the first image to be printed and the second image to be printed overlap one another is formed, it is desirable that the printing be performed such that the overlapping portion is less noticeable. Particularly, in actual printing, there are disturbance factors such as variations in characteristics of ink sheet and paper to be used or differences between environments where printing is performed. These disturbance factors may cause streaks or unevenness in the overlapping portion and accordingly make the overlapping portion noticeable.

However, such disturbance factors are not considered in the density process disclosed in Patent Document 1, and the joint density gradual decrease/gradual increase process, the joint reverse transfer correction process, and the joint excessive transfer correction process disclosed in Patent Document 2.

The present invention has been made to solve the above-described problem, and provides a thermal transfer printing apparatus, a method for calibrating a thermal transfer printing apparatus, and a printing method of a thermal transfer printing apparatus that make an overlapping portion less noticeable even under the influence of disturbance factors.

Means to Solve the Problem

A thermal transfer printing apparatus according to a first invention is configured to acquire data on a color of a first image and data on a color of a second image, adjust a portion of the data on the color of the first image thus acquired and a portion of the data on the color of the second image thus acquired using a predetermined density adjustment parameter, and perform a panoramic image printing process of printing the first image and the second image using a plurality of printing surfaces arranged on an ink sheet to cause the portion of the first image thus adjusted and the portion of the second image thus adjusted to be superimposed on each other, and the thermal transfer printing apparatus includes a divided image data acquisition part configured to acquire data representing a first-page calibration image including data on a color density of a plurality of first-page calibration patterns and data representing a second-page calibration image including data on a color density of a plurality of second-page calibration patterns, a calibration-use density adjustment parameter storage part configured to store a plurality of the density adjustment parameters that are each associated with a corresponding one of the plurality of first-page calibration patterns and the plurality of second-page calibration patterns, a density adjustment processing part configured to adjust data on a color density of a first-page superimposing portion that is superimposed on a corresponding one of the plurality of second-page calibration patterns during printing of the data on the color density of the plurality of first-page calibration patterns using one of the density adjustment parameters associated with a corresponding one of the first-page calibration patterns and adjust data on a color density of a second-page superimposing portion that is superimposed on a corresponding one of the plurality of first-page calibration patterns during printing of the data on the color density of the plurality of second-page calibration patterns using one of the plurality of density adjustment parameters associated with a corresponding one of the second-page calibration patterns, and a printing part configured to print the first-page calibration image and the second-page calibration image on recording paper to form a plurality of printed calibration patterns that are each constituted by one of the first-page calibration patterns and one of the second-page calibration patterns and include a printed superimposing portion where the first-page superimposing portion and the second-page superimposing portion are superimposed on each other based on the data on the color densities adjusted by the density adjustment processing part. A color density of the printed superimposing portion printed on the recording paper varies for each of the printed calibration patterns.

A method for calibrating a thermal transfer printing apparatus according to a second invention includes acquiring data representing a first-page calibration image including data on a color density of a plurality of first-page calibration patterns and data representing a second-page calibration image including data on a color density of a plurality of second-page calibration patterns adjusting data on a color density of a first-page superimposing portion that is superimposed on a corresponding one of the plurality of second-page calibration patterns during printing of the data on the color density of the plurality of first-page calibration patterns thus acquired using a density adjustment parameter associated with a corresponding one of the plurality of first-page calibration patterns and adjusting data on a color density of a second-page superimposing portion that is superimposed on a corresponding one of the plurality of first-page calibration patterns during printing of data on the color density of the plurality of second-page calibration patterns thus acquired using a density adjustment parameter associated with a corresponding one of the plurality of second-page calibration patterns, printing the first-page calibration image and the second-page calibration image on recording paper to form a plurality of printed calibration patterns that are each constituted by one of the first-page calibration patterns and one of the second-page calibration patterns and include a printed superimposing portion where the first-page superimposing portion and the second-page superimposing portion are superimposed on each other based on the data on color densities thus adjusted and to make a color density of the printed superimposing portion different for each of the printed calibration patterns, and receiving a signal including data on the printed calibration pattern selected from among the plurality of printed calibration patterns printed on the recording paper, and storing, in a density adjustment parameter storage part, the density adjustment parameters that are each associated with a corresponding one of the first-page calibration patterns and the second-page calibration patterns constituting the printed calibration pattern thus selected.

A printing method of a thermal transfer printing apparatus according to a third invention includes acquiring data on a color of a first image and a color of a second image, adjusting a portion of the data on the color of the first image thus acquired and a portion of the data on the color of the second image thus acquired using the density adjustment parameters stored in the density adjustment parameter storage part in the method for calibrating a thermal transfer printing apparatus according to the second invention, and printing the first image and the second image using a plurality of printing surfaces arranged on an ink sheet to cause the portion of the first image thus adjusted and the portion of the second image thus adjusted to be superimposed on each other.

Effects of the Invention

The thermal transfer printing apparatus according to the first invention, the method for calibrating a thermal transfer printing apparatus according to the second invention, and the printing method of a thermal transfer printing apparatus according to the third invention are configured so that the color density of the printed superimposing portion printed on the recording paper varies for each of the printed calibration patterns. This configuration makes it possible to select a calibration pattern whose superimposing portion including disturbance factors is less noticeable, and thus makes it possible to provide the thermal transfer printing apparatus that makes the superimposing portion less noticeable even under the influence of the disturbance factors.

BRIEF DESCRIPTION OF DRAWINGS

FIG. 8 is a table showing a Y-color gradation value of each pixel of data representing the calibration image immediately after step S100 is completed in the thermal transfer printing apparatus according to the first embodiment.

FIG. 13 is a detailed flowchart of a density adjustment process on a calibration pattern in the thermal transfer printing apparatus according to the first embodiment.

FIG. 14 is a table showing a correspondence between a density adjustment parameter and a calibration pattern stored in a calibration pattern correspondence storage part of the thermal transfer printing apparatus according to the first embodiment.

FIG. 17 is a graph showing a Y-color density of a range from the coordinates TPSs to TPSe in the sub-scanning direction Y of a second Y-color (printed) calibration pattern of the first-page calibration image immediately after step S111 is completed in the thermal transfer printing apparatus according to the first embodiment.

FIG. 18 is a graph showing a Y-color density of a range from the coordinates TPSs to TPSe in the sub-scanning direction Y of a third Y-color (printed) calibration pattern of the first-page calibration image immediately after step S111 is completed in the thermal transfer printing apparatus according to the first embodiment.

FIG. 19 is a table showing data on density adjustment parameters Ypara1, Ypara2, Ypara3 for the first-page calibration image in the thermal transfer printing apparatus according to the first embodiment.

FIG. 24 is a graph showing a Y-color density of a range from the coordinates TPSs to TPSe in the sub-scanning direction Y of a third Y-color calibration pattern of the second-page calibration image immediately after step S111 is completed in the thermal transfer printing apparatus according to the first embodiment.

FIG. 25 is a table showing data on density adjustment parameters Ypara1, Ypara2, and Ypara3 for the second-page calibration image in the thermal transfer printing apparatus according to the first embodiment.

FIG. 26 is a table showing a Y-color gradation value of each pixel of data representing the second-page calibration image immediately after step S111 is completed in the thermal transfer printing apparatus according to the first embodiment.

FIG. 36 is a table showing a Y-color gradation value of each pixel of data representing the calibration image immediately after step S100 is completed in the thermal transfer printing apparatus according to the second embodiment.

FIG. 37 is a schematic diagram of an ink sheet to be loaded into a thermal transfer printer according to a third embodiment.

DESCRIPTION OF EMBODIMENTS

Figure 1:
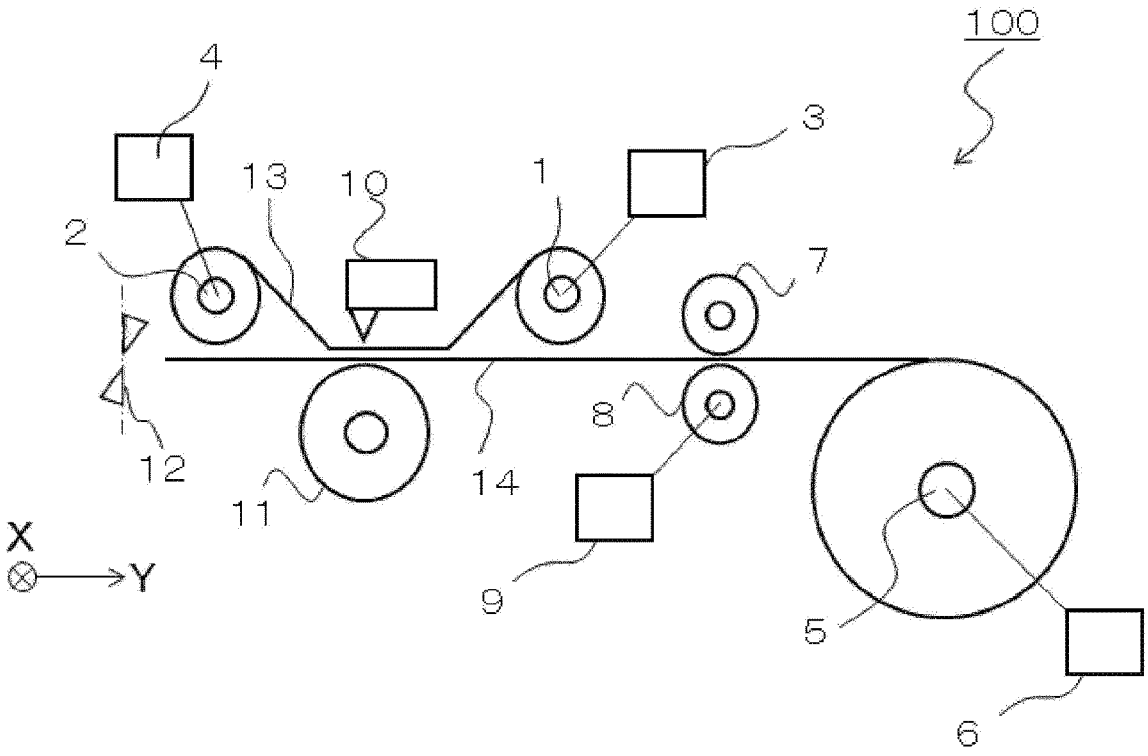
FIG. 1 is a schematic diagram of a thermal transfer printer according to a first embodiment.

Embodiments of the present invention will be described below with reference to the drawings. Note that, in each of the drawings, the same reference numerals are given to parts that are identical or equivalent to each other. In the descriptions of the embodiments, no descriptions or simplified descriptions will be given as appropriate of the parts that are identical or equivalent to each other. In each of the drawings, an orientation and direction are defined by an orthogonal coordinate system in which an X axis and a Y axis are orthogonal to each other. A direction indicated by the Y axis in the drawings is referred to as a sub-scanning direction Y. Further, in the descriptions of the embodiments, an end of each component on a proximal-end side of an arrow representing the Y axis is referred to as a rear end, and an end of the component on a distal-end side of the arrow representing the Y axis is referred to as a front end. Furthermore, a direction indicated by the X axis in the drawings is referred to as a primary scanning direction X. Further, in the descriptions of the embodiments, an end of each component on a proximal-end side of an arrow representing the X axis is referred to as an upper end, and an end of the component on a distal-end side of the arrow representing the X axis is referred to as a lower end. Further, a plane including the X axis and the Y axis is referred to as an XY plane. Note that the definitions of the orientation, direction, and plane in the orthogonal coordinate system are given for the sake of explanation, and are not intended to limit arrangements, orientations, and the like of apparatuses, parts, and the like. Configurations, such as a material, shape, and size, of apparatuses, parts, and the like can be appropriately changed within the scope of the present invention.

First Embodiment

FIG. 1 is a schematic diagram of a thermal transfer printer according to a first embodiment. Next, a description will be given of a thermal transfer printer 100 according to the first embodiment with reference to the schematic diagram. Note that, in FIG. 1, an arrow representing the X axis extends toward a back side of the paper surface of FIG. 1.

The thermal transfer printer 100 includes a feeding-side bobbin 1, a winding-side bobbin 2, a feeding-side motor 3, a winding-side motor 4, a paper roll bobbin 5, a paper roll motor 6, a pinch roller 7, and a grip roller 8, a feed motor 9, a thermal head 10, a platen roller 11, and a cutter 12. Further, in the thermal transfer printer 100 shown in FIG. 1, an ink sheet 13 is loaded in the feeding-side bobbin 1 and the winding-side bobbin 2, and recording paper 14 is loaded in the paper roll bobbin 5.

One end of the ink sheet 13 is attached to the feeding-side bobbin 1, and an unused portion of the ink sheet 13 is wound on the feeding-side bobbin 1. The other end of the ink sheet 13 is attached to the winding-side bobbin 2, and a used portion of the ink sheet 13 is wound on the winding-side bobbin 2. The feeding-side bobbin 1 is rotated by the feeding-side motor 3, and the winding-side bobbin 2 is rotated by the winding-side motor 4. The feeding-side motor 3 and the winding-side motor 4 are capable of rotating the feeding-side bobbin 1 and the winding-side bobbin 2, respectively, to feed the ink sheet 13 in the sub-scanning direction Y and to apply a predetermined tension to the ink sheet 13.

One end of the recording paper 14 is attached to the paper roll bobbin 5, and an unused portion of the recording paper 14 is wound on the paper roll bobbin 5. The paper roll bobbin 5 is rotated by the paper roll motor 6. The paper roll motor 6 is capable of rotating the paper roll bobbin 5 to feed the recording paper 14 in the sub-scanning direction Y.

The pinch roller 7 and the grip roller 8 are arranged facing each other. Sandwiched between the pinch roller 7 and the grip roller 8 is the recording paper 14 unwound from the paper roll bobbin 5. The grip roller 8 is rotated by the feed motor 9. The feed motor 9 is capable of rotating the grip roller 8 to feed the recording paper 14 in the sub-scanning direction Y.

The thermal head 10 is capable of generating heat. The platen roller 11 is disposed facing a portion of the thermal head 10. Located between the thermal head 10 and the platen roller 11 are the ink sheet 13 and the recording paper 14 having their respective surfaces parallel to the XY plane. The thermal head 10 is movable toward the platen roller 11 to press against the platen roller 11 so as to allow the ink sheet 13 and the recording paper 14 to be sandwiched between the platen roller 11 and the thermal head 10. With the ink sheet 13 and the recording paper 14 sandwiched between the thermal head 10 and the platen roller 11, the thermal head 10 generates heat to transfer ink from the ink sheet 13 to the recording paper 14.

The cutter 12 is capable of cutting the recording paper 14.

Figure 2:
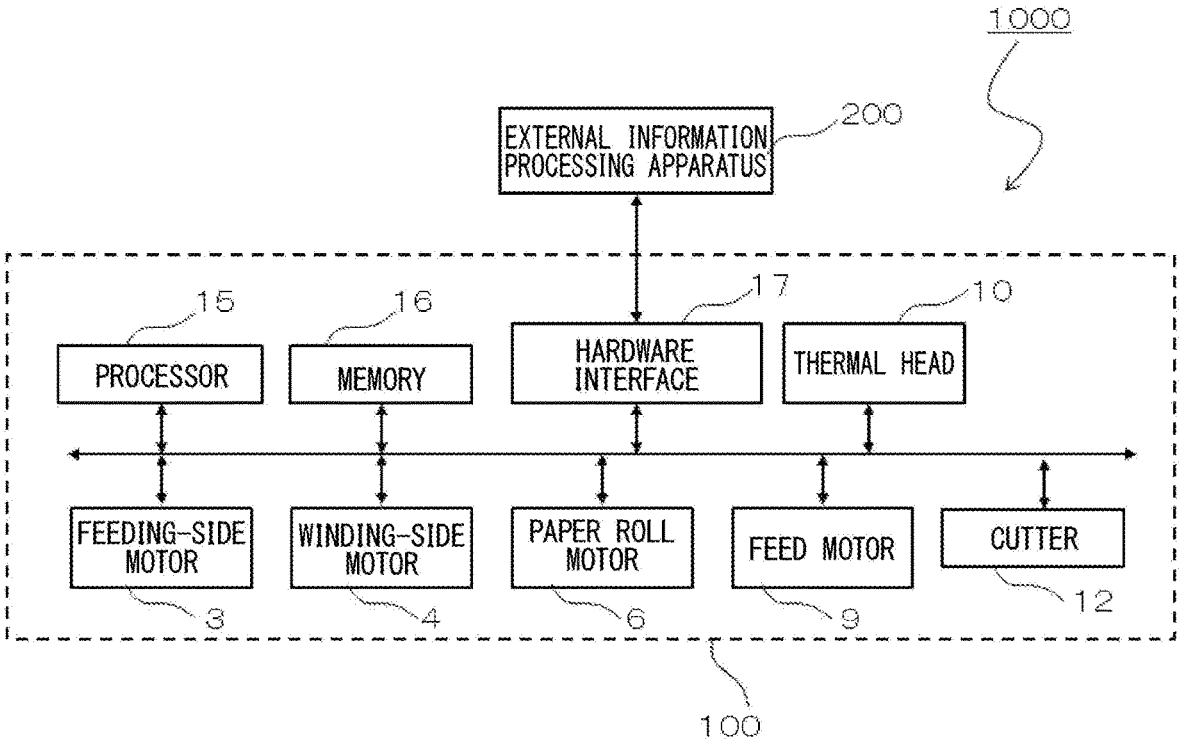
FIG. 2 is a hardware configuration diagram of a thermal transfer printing apparatus according to the first embodiment.

FIG. 2 is a hardware configuration diagram of a thermal transfer printing apparatus according to the first embodiment. Next, a description will be given of a hardware configuration of a thermal transfer printing apparatus 1000 according to the first embodiment. The thermal transfer printing apparatus 1000 includes the thermal transfer printer 100 and an external information processing apparatus 200.

The thermal transfer printer 100 includes a processor 15, a memory 16, and a hardware interface 17. Further, the thermal transfer printer 100 is connected to the external information processing apparatus 200 and thus is capable of communicating with the external information processing apparatus 200.

The processor 15 is a device that controls hardware in the thermal transfer printer 100 such as the feed motor 9 and executes data processing. The processor 15 is, for example, a central processing unit (CPU).

The memory 16 is a device for storing data. The memory 16 is, for example, a nonvolatile or volatile semiconductor memory such as a randam access memory (RAM), a read only memory (ROM), a flash memory, an erasable programmable read only memory (EPROM), and an electrically rasable programmable read only memory (EEPROM).

The hardware interface 17 is a device such as a universal serial bus (USB) interface that transmits and receives data to and from the external information processing apparatus 200.

The external information processing apparatus 200 is an apparatus that inputs and outputs various information such as image data to and from the thermal transfer printer 100. The external information processing apparatus 200 is operated by a user. Examples of the external information processing apparatus 200 include a personal computer, a smartphone, and a tablet terminal.

The image data in the first embodiment is data represented as an arrayed pixels to which predetermined line numbers are assigned in the sub-scanning direction Y and the primary scanning direction X, and, in elements of each of the arrayed pixels, a Y-color gradation value, an M-color gradation value, and a C-color gradation value are stored. Further, an array line number corresponding to a coordinate in each of the directions is prefixed with "#". For example, an array line number corresponding to a coordinate Y1 in the sub-scanning direction Y is denoted as #Y1. Note that a range of the gradation value is from 0 to 255, and the greater the gradation value is, the higher the density becomes. Further, the gradation value corresponds to data on a color density in the present invention.

The feeding-side motor 3, the winding-side motor 4, the paper roll motor 6, the feed motor 9, the thermal head 10, the cutter 12, the processor 15, the memory 16, and the hardware interface 17 are each connected to an internal bus of the thermal transfer printer 100 and thus are capable of communicating with each other.

Figure 3:
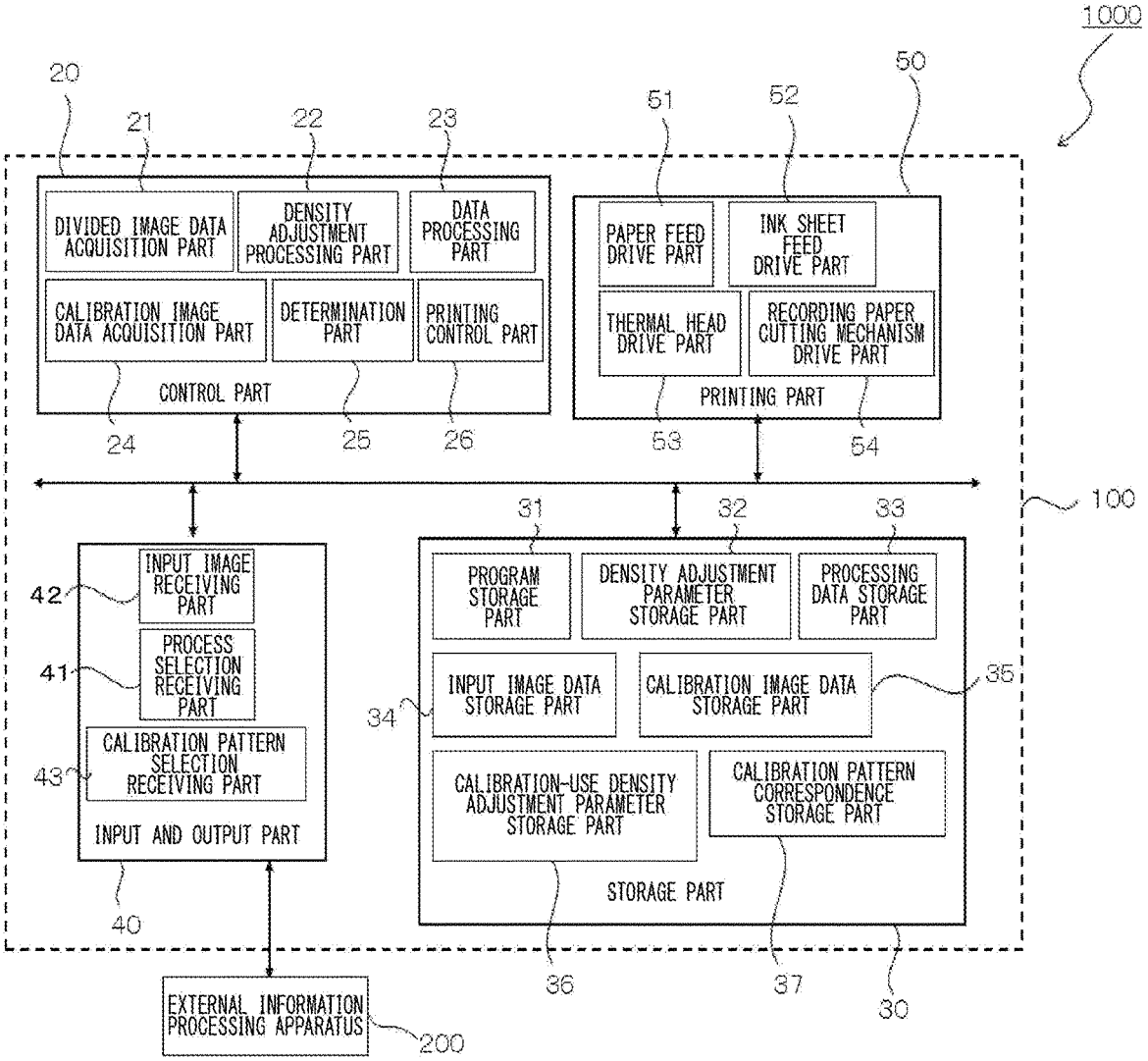
FIG. 3 is a functional block diagram of the thermal transfer printing apparatus according to the first embodiment.

FIG. 3 is a functional block diagram of the thermal transfer printing apparatus according to the first embodiment. Next, a description will be given of a functional block configuration of the thermal transfer printing apparatus 1000 according to the first embodiment.

The thermal transfer printer 100 includes a control part 20, a storage part 30, an input and output part 40, and a printing part 50. Further, the control part 20, the storage part 30, the input and output part 40, and the printing part 50 are each capable of transmitting and receiving data.

The control part 20 includes a divided image data acquisition part 21, a density adjustment processing part 22, a data processing part 23, a calibration image data acquisition part 24, a determination part 25, and a printing control part 26. The divided image data acquisition part 21, the density adjustment processing part 22, the data processing part 23, the calibration image data acquisition part 24, the determination part 25, and the printing control part 26 are program modules to be run by the processor 15. That is, the processor 15 executes various processes in accordance with a software program stored in the memory 16 to enable the divided image data acquisition part 21, the density adjustment processing part 22, the data processing part 23, the calibration image data acquisition part 24, the determination part 25, and the printing control part 26 to work.

The divided image data acquisition part 21 performs a process of acquiring a plurality of pieces of image data from one piece of image data.

The density adjustment processing part 22 performs a process of adjusting a density of a portion of image data using a density adjustment parameter.

The data processing part 23 converts image data into printing data to be thermal-transferred by the thermal head 10.

The calibration image data acquisition part 24 performs a process of acquiring a calibration image 70 to be described later.

The determination part 25 makes various determinations on the thermal transfer printer 100.

The printing control part 26 controls operations of a paper feed drive part 51, an ink sheet feed drive part 52, a thermal head drive part 53, and a recording paper cutting mechanism drive part 54 included in the printing part 50 that are to be described later.

The storage part 30 includes at least a program storage part 31, a density adjustment parameter storage part 32, a processing data storage part 33, an input image data storage part 34, a calibration image data storage part 35, a calibration-use density adjustment parameter storage part 36, and a calibration pattern correspondence storage part 37. The program storage part 31, the density adjustment parameter storage part 32, the processing data storage part 33, the input image data storage part 34, the calibration image data storage part 35, the calibration-use density adjustment parameter storage part 36, and the calibration pattern correspondence storage part 37 are each enabled when a corresponding piece of data is stored in the memory 16.

Stored in the program storage part 31 is the software program to be run by the processor 15.

Stored in the density adjustment parameter storage part 32 is a density adjustment parameter set in a calibration process to be described later.

Stored in the processing data storage part 33 is data converted in each process.

Stored in the input image data storage part 34 is input image data input from the input and output part 40.

Stored in the calibration image data storage part 35 is data necessary for the calibration image data acquisition part 24 to acquire the calibration image 70. In the first embodiment, stored in the calibration image data storage part 35 are a Y-color gradation value of a Y-color (printed) calibration pattern 71Y, an M-color gradation value of an M-color calibration pattern 71M, and a C-color gradation value of a C-color calibration pattern 71C that are to be described later. Further, it is assumed that the color gradation value of each of the color calibration patterns is stored as a center gradation value. The center gradation value corresponds to a center value in a range of the gradation value, and the center gradation value is 128 when the gradation value ranges from 0 to 255.

Stored in the calibration-use density adjustment parameter storage part 36 is a density adjustment parameter to be used in the calibration process. In the first embodiment, density adjustment parameters Ypara1, Ypara2, and Ypara3 for Y color, density adjustment parameters Mpara1, Mpara2, and Mpara3 for M color, and density adjustment parameters Cpara1, Cpara2 and Cpara3 for C color are stored. Details of each density adjustment parameter will be described later.

Stored in the calibration pattern correspondence storage part 37 is a correspondence between the calibration pattern and the density adjustment parameter that are to be described later. Details of the correspondence stored in the calibration pattern correspondence storage part 37 will be described later.

The input and output part 40 includes at least a process selection receiving part 41, an input image receiving part 42, and a calibration pattern selection receiving part 43. The process selection receiving part 41, the input image receiving part 42, and the calibration pattern selection receiving part 43 are enabled by the hardware interface 17.

The process selection receiving part 41, the input image receiving part 42, and the calibration pattern selection receiving part 43 receive various data from the external information processing apparatus 200. Details of the various data to be received will be described in the control of the thermal transfer printer 100 according to the first embodiment to be described later.

The printing part 50 includes the paper feed drive part 51, the ink sheet feed drive part 52, the thermal head drive part 53, and the recording paper cutting mechanism drive part 54.

The paper feed drive part 51 is capable of feeding the recording paper 14 loaded in the thermal transfer printer 100 to a predetermined position. The paper feed drive part 51 is constituted by the paper roll motor 6 and the feed motor 9.

The ink sheet feed drive part 52 is capable of feeding the ink sheet 13 loaded in the thermal transfer printer 100 to a predetermined position. The ink sheet feed drive part 52 is constituted by the feeding-side motor 3 and the winding-side motor 4.

The thermal head drive part 53 is capable of moving the thermal head 10 and causing the thermal head 10 to generate heat. The thermal head drive part 53 is constituted by the thermal head 10.

The recording paper cutting mechanism drive part 54 is capable of cutting the recording paper 14 loaded in the thermal transfer printer 100. The recording paper cutting mechanism drive part 54 is constituted by the cutter 12.

Figure 4:
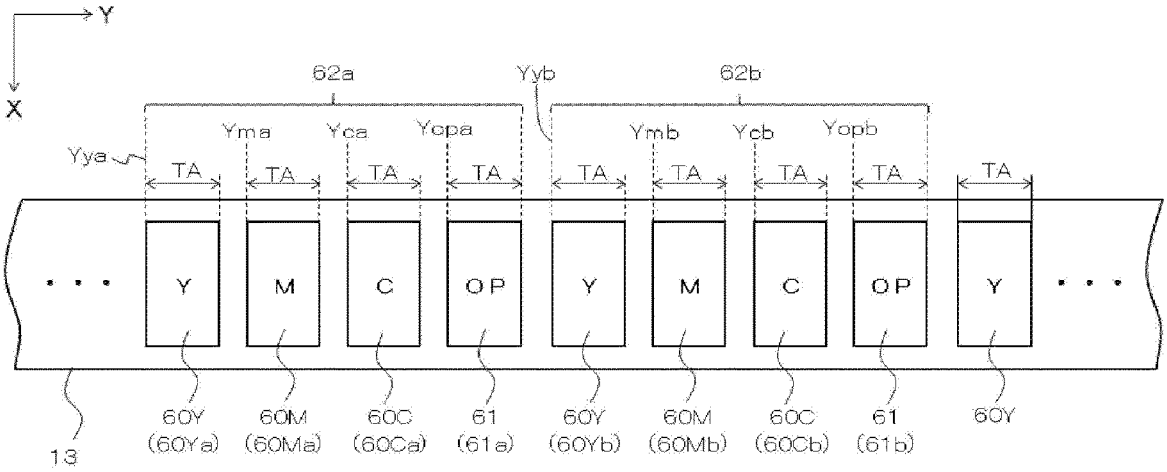
FIG. 4 is a schematic diagram of an ink sheet to be loaded into the thermal transfer printer according to the first embodiment.

FIG. 4 is a schematic diagram of the ink sheet to be loaded into the thermal transfer printer according to the first embodiment. Next, a description will be given of the ink sheet 13 of the first embodiment. The ink sheet 13 is a plastic film having heat resistance. The ink sheet 13 includes printing surfaces 60 of Y, M, and C colors and a protective material surface 61. The printing surfaces 60 and the protective material surface 61 are arranged at regular intervals in the sub-scanning direction Y. A printing surface 60 to which a Y-color dye is applied is referred to as a Y-color printing surface 60Y, a printing surface 60 to which an M-color dye is applied is referred to as an M-color printing surface 60M, and a printing surface 60 to which a C-color dye is applied is referred to as a C-color printing surface 60C. The protective material surface 61 is a surface to which a protective material is applied, the protective material reducing a mechanical influence and an influence of ultraviolet rays on a printed surface. Further, each of the printing surfaces 60 and the protective material surface 61 has a predetermined length TA in the sub-scanning direction Y.

For each printing process, one Y-color printing surface 60Y, one M-color printing surface 60M, one C-color printing surface 60C, and one protective material surface 61 are used. An area including the Y-color printing surface 60Y, the M-color printing surface 60M, the C-color printing surface 60C, and the protective material surface 61 to be consumed for each printing process is referred to as a printing ink sheet area 62, and, in FIG. 4, a first printing ink sheet area 62*a* and a second printing ink sheet area 62*b* are shown.

The Y-color printing surface 60Y, the M-color printing surface 60M, the C-color printing surface 60C, and the protective material surface 61 arranged in the first printing ink sheet area 62*a* are referred to as a first Y-color printing surface 60Ya, a first M-color printing surface 60Ma, a first C-color printing surface 60Ca, and a first protective material surface 61*a*, respectively. Similarly, the Y-color printing surface 60Y, the M-color printing surface 60M, the C-color printing surface 60C, and the protective material surface 61 arranged in the second printing ink sheet area 62*b* are referred to as a second Y-color printing surface 60Yb, a second M-color printing surface 60Mb, a second C-color printing surface 60Cb, and a second protective material surface 61*b*, respectively.

Further, one of ends of the first Y-color printing surface 60Ya adjacent to an origin in the sub-scanning direction Y is referred to as a rear end Yya. Similarly, ends, adjacent to the origin in the sub-scanning direction Y, of the first M-color printing surface 60Ma, the first C-color printing surface 60Ca, the first protective material surface 61*a*, the second Y-color printing surface 60Yb, the second M-color printing surface 60Mb, the second C-color printing surface 60Cb, and the second protective material surface 61*b* are referred to as a rear end Yma, a rear end Yca, a rear end Yopa, a rear end Yyb, a rear end Ymb, a rear end Ycb, and a rear end Yopb, respectively.

Next, a description will be given in detail of various processes to be performed by the thermal transfer printer 100 according to the first embodiment. The thermal transfer printer 100 is capable of performing at least the calibration process and a panoramic image printing process. When the process selection receiving part 41 receives a signal containing an instruction to perform the calibration process from the external information processing apparatus 200, the thermal transfer printer 100 performs the calibration process. Further, when the process selection receiving part 41 receives a signal containing an instruction to perform the panoramic image printing process from the external information processing apparatus 200, the thermal transfer printer 100 performs the panoramic image printing process.

Figure 5:
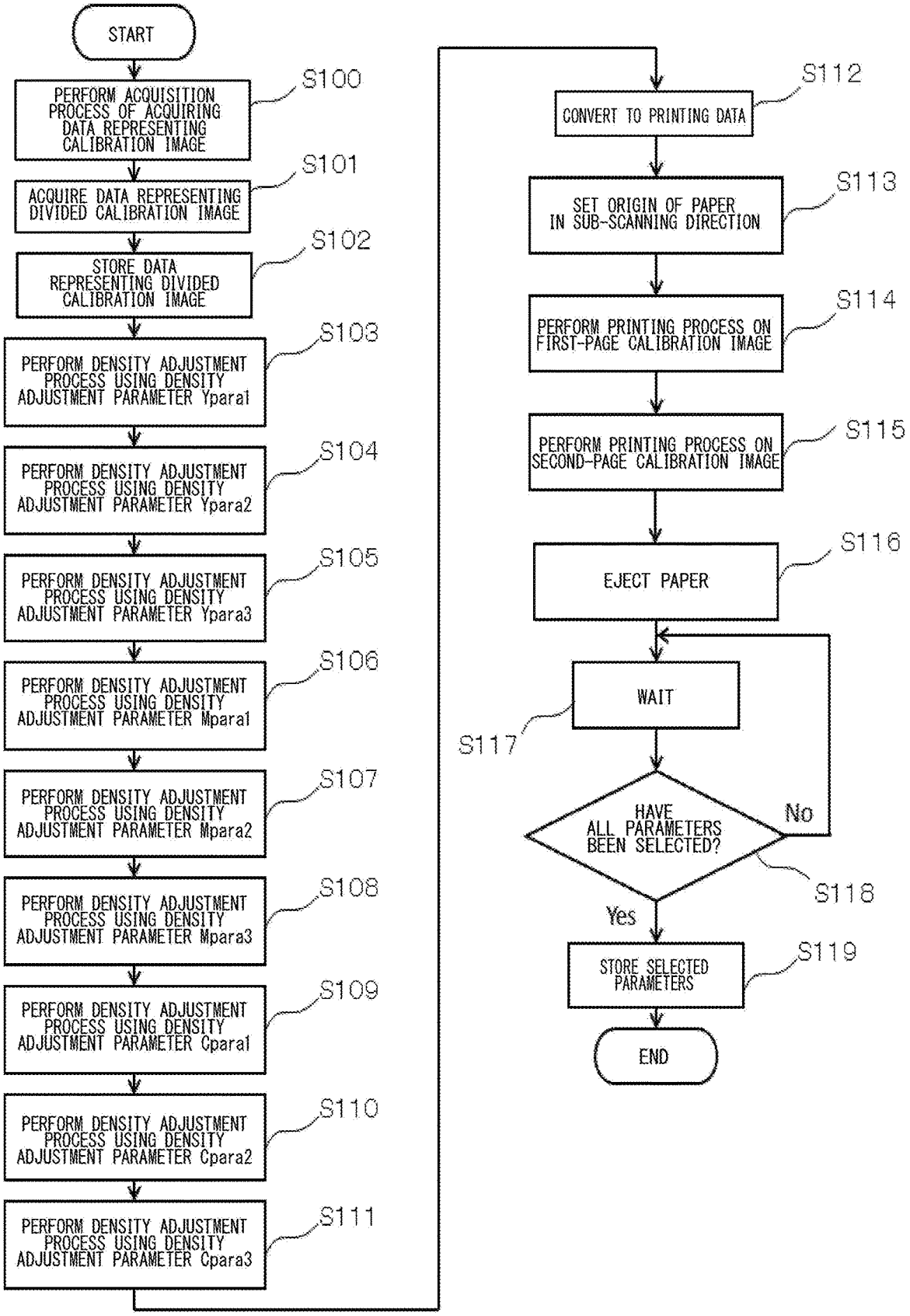
FIG. 5 is a flowchart of a calibration process in the thermal transfer printing apparatus according to the first embodiment.

FIG. 5 is a flowchart of the calibration process in the thermal transfer printing apparatus according to the first embodiment. Next, a description will be given of the details of the calibration process in the thermal transfer printer 100 according to the first embodiment. As a premise at the start of the flowchart of FIG. 5, it is assumed that the process selection receiving part 41 has already received a signal containing the instruction to perform the calibration process from the external information processing apparatus 200.

In step S100, the calibration image data acquisition part 24 performs an acquisition process of acquiring data representing the calibration image 70.

Figure 6:
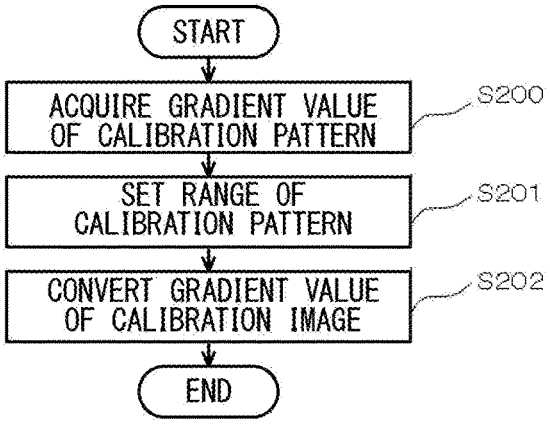
FIG. 6 is a detailed flowchart of an acquisition process of acquiring data representing a calibration image in the thermal transfer printing apparatus according to the first embodiment.
Figure 7:
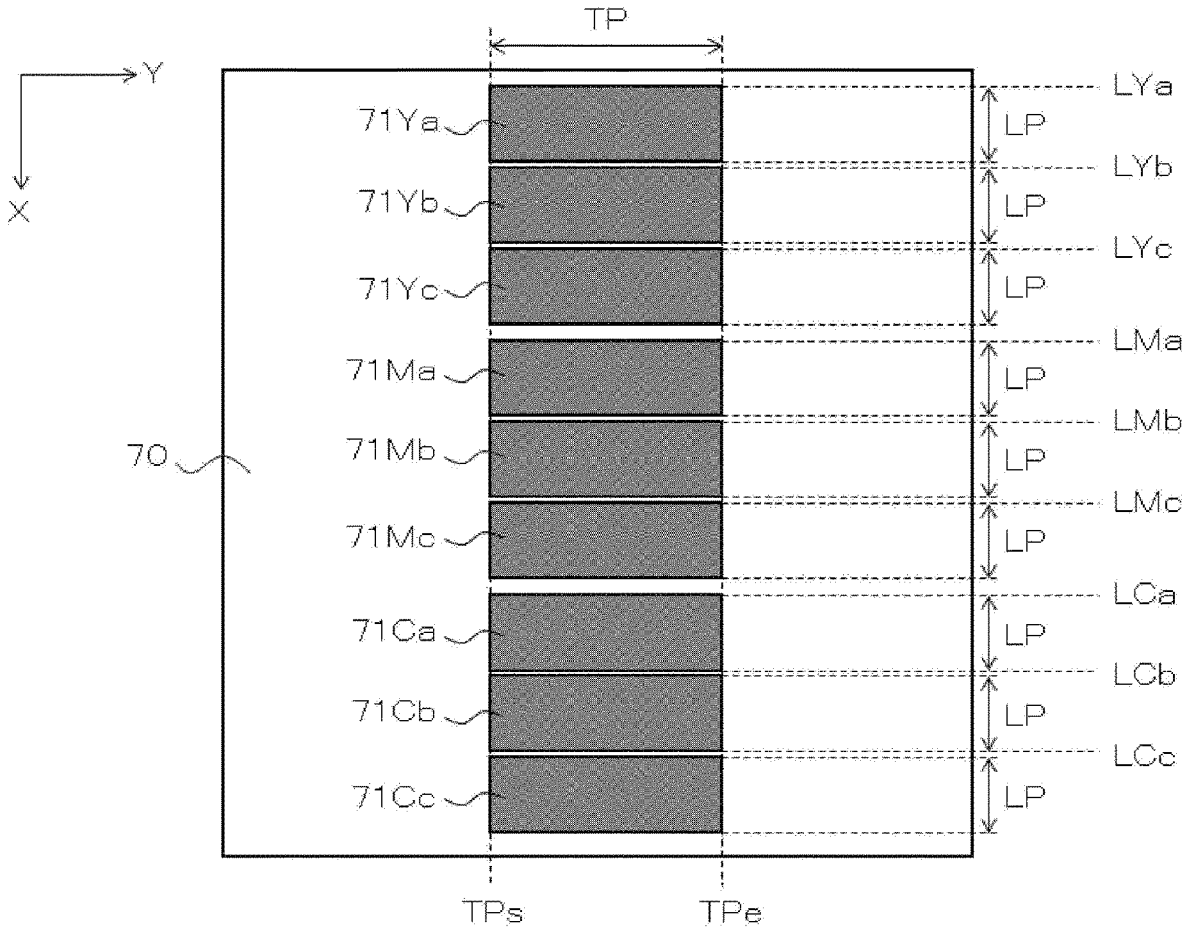
FIG. 7 is a diagram showing a calibration image immediately after step S100 is completed in the thermal transfer printing apparatus according to the first embodiment.

FIG. 6 is a detailed flowchart of the acquisition process of acquiring data representing the calibration image in the thermal transfer printing apparatus according to the first embodiment. FIG. 7 is a diagram showing a calibration image immediately after step S100 is completed in the thermal transfer printing apparatus according to the first embodiment. Here, a description will be given of the details of the acquisition process of acquiring the calibration image to be performed in step S100. As a premise at the start of the flowchart of FIG. 6, it is assumed that step S100 in the flowchart of FIG. 5 has been already started, and the data representing the calibration image 70 has a Y-color gradation value of 0, an M-color gradation value of 0, and a C-color gradation value of 0 in each pixel of all the data representing the calibration image 70.

In step S200, the calibration image data acquisition part 24 acquires a Y-color gradation value of the Y-color calibration pattern 71Y, an M-color gradation value of the M-color calibration pattern 71M, and a C-color gradation value of the C-color calibration pattern 71C stored in the calibration image data storage part 35.

After step S200 is completed, the process proceeds to step S201. In step S201, the calibration image data acquisition part 24 sets a range of the calibration pattern 71. The calibration image data acquisition part 24 sets the range of the calibration pattern 71 at a predetermined position and with a predetermined size in the calibration image 70 in accordance with the program stored in the program storage part 31.

In the first embodiment, respective ranges of three Y-color (printed) calibration patterns 71Y, three M-color calibration patterns 71M, and three C-color calibration patterns 71C are set. The calibration patterns 71 are individually referred to as a first Y-color (printed) calibration pattern 71Ya, a second Y-color calibration pattern 71Yb, a third Y-color (printed) calibration pattern 71Yc, a first M-color calibration pattern 71Ma, a second M-color (printed) calibration pattern 71Mb, a third M-color calibration pattern 71Mc, a first C-color calibration pattern 71Ca, a second C-color calibration pattern 71Cb, and a third C-color calibration pattern 71Cc.

Further, the first Y-color calibration pattern 71Ya is set as a rectangular range having a side that extends from a coordinate TPs in the sub-scanning direction Y by a width TP, and a side that extends from a coordinate LYa in the primary scanning direction X by a length LP.

Similarly, the second Y-color calibration pattern 71Yb, the third Y-color calibration pattern 71Yc, the first M-color calibration pattern 71Ma, the second M-color calibration pattern 71Mb, the third M-color calibration pattern 71Mc, the first C-color calibration pattern 71Ca, the second C-color calibration pattern 71Cb, and the third C-color calibration pattern 71Cc are each set as a rectangular range having a side that extends from the coordinate TPs in the sub-scanning direction Y by the length TP, and a side that extends from coordinates LYb, LYc, LMa, LMb, LMc, LCa, LCb, and LCc in the primary scanning direction X by the length LP, respectively.

After step S201 is completed, the process proceeds to step S202. In step S202, the calibration image data acquisition part 24 converts the gradation values of pixels in the ranges, set in step S201, of the calibration patterns 71 of the data representing the calibration image 70 into the color gradation values of the calibration patterns 71 acquired in step S200.

In the first embodiment, of pixels in the ranges of the first Y-color calibration pattern 71Ya, the second Y-color calibration pattern 71Yb, and the third Y-color calibration pattern 71Yc of the data representing the calibration image 70, the Y-color gradation value, the M-color gradation value, and the C-color gradation value are changed to 128, 0, and 0, respectively.

Further, of pixels in the ranges of the first M-color calibration pattern 71Ma, the second M-color calibration pattern 71Mb, and the third M-color calibration pattern 71Mc of the data representing the calibration image 70, the Y-color gradation value, the M-color gradation value, and the C-color gradation value are changed to 0, 128, and 0, respectively.

Furthermore, of pixels in the ranges of the first C-color calibration pattern 71Ca, the second C-color calibration pattern 71Cb, and the third C-color calibration pattern 71Cc of the data representing the calibration image 70, the Y-color gradation value, the M-color gradation value, and the C-color gradation value are changed to 0, 0, and 128, respectively.

The completion of step 202 brings the acquisition process of acquiring data representing the calibration image 70 to an end.

As shown in FIG. 7, the data representing the calibration image 70 that includes nine calibration patterns 71 is acquired through the processes in step S200 to step S202. The nine calibration patterns 71 include three Y-color calibration patterns 71Y in which each pixel has the same Y-color gradation value, three M-color calibration patterns 71M in which each pixel has the same M-color gradation value, and three C-color calibration patterns 71C in which each pixel has the same C-color gradation value. That is, the color density of each color calibration pattern 71 is uniform.

A rear end of each calibration pattern 71 corresponds to a side extending in the primary scanning direction X along the coordinate TPs. Further, a front end of each calibration pattern 71 corresponds to a side extending in the primary scanning direction X along the coordinate TPe.

FIG. 8 is a table showing a Y-color gradation value of each pixel of data representing the calibration image immediately after step S100 is completed in the thermal transfer printing apparatus according to the first embodiment. Here, the gradation value of each pixel of the data representing the calibration image 70 is given as an example. As shown in FIG. 8, of the data representing the calibration image 70, the Y-color gradation value of each pixel in the range from the line number #TPs to the line number #TPe in the sub-scanning direction Y and from the line number #LYa to the line number #LYa+LP in the primary scanning direction X is changed to 128, and the pixels in this range correspond to the first Y-color calibration pattern 71Ya. Of the data representing the calibration image 70, the Y-color gradation value of each pixel in the range from the line number #TPs to the line number #TPe in the sub-scanning direction Y and from the line number #LYb to the line number #LYb+LP in the primary scanning direction X is changed to 128, and the pixels in this range correspond to the second Y-color calibration pattern 71Yb. Furthermore, of the data representing the calibration image 70, the Y-color gradation value of each pixel in the range from the line number #TPs to the line number #TPe in the sub-scanning direction Y and from the line number #LYc to the line number #LYc+LP in the primary scanning direction X is changed to 128, and the pixels in this range correspond to the third Y-color calibration pattern 71Yc.

A description will be given of the details of the flowchart of the calibration process again with reference to FIG. 5. After step S100 is completed, the process proceeds to step S101. In step S101, the divided image data acquisition part 21 acquires a plurality of pieces of data representing divided calibration images from the data representing the calibration image 70 acquired in step S100. In the first embodiment, the divided calibration images include a first-page calibration image 70*a* and a second-page calibration image 70*b*, and data representing the first-page calibration image 70*a* and data representing the second-page calibration image 70*b* are acquired in step S101.

Figures 9, 10:
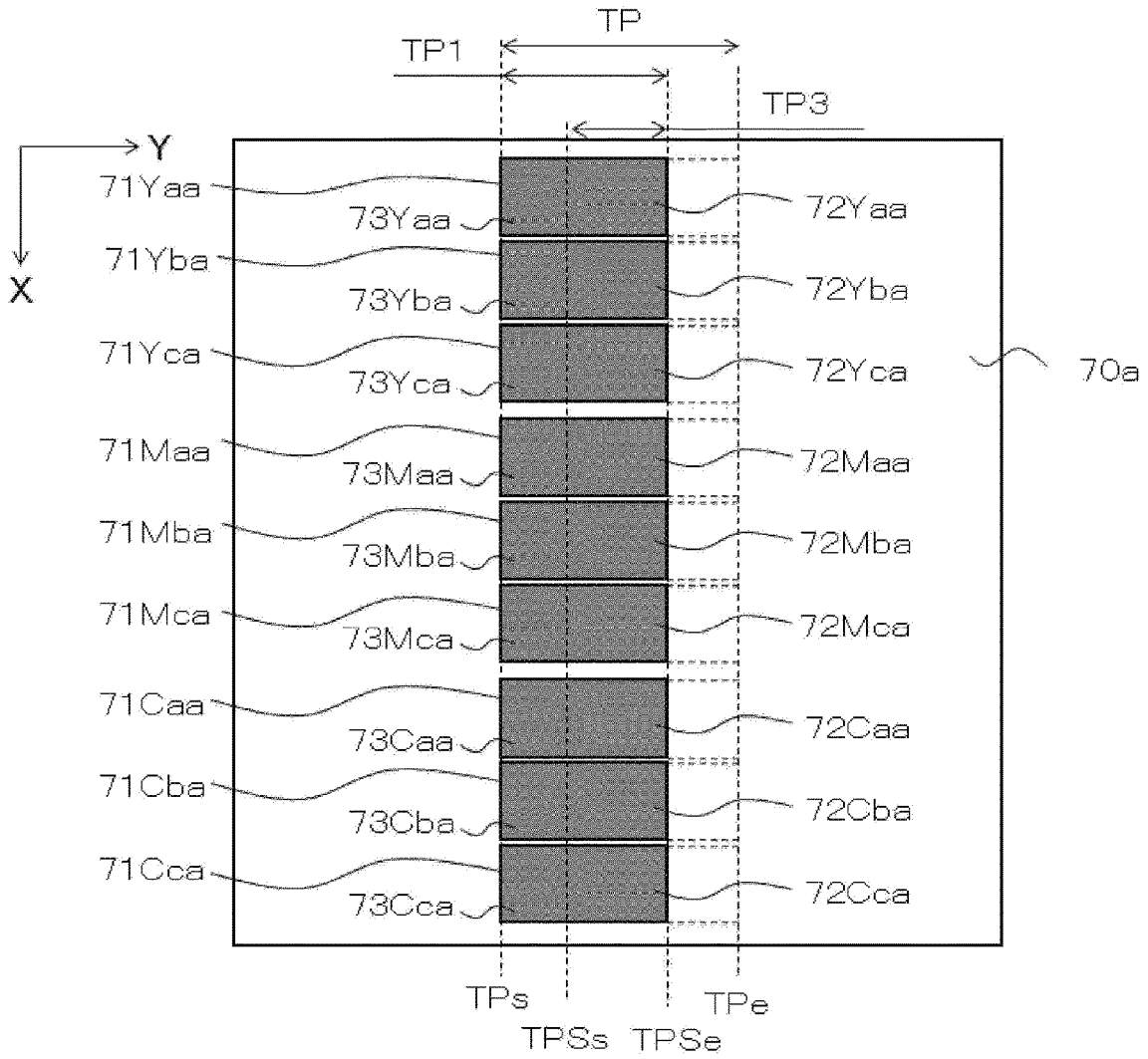
FIG. 9 is a diagram showing a first-page calibration image immediately after step S101 is completed in the thermal transfer printing apparatus according to the first embodiment.
FIG. 10 is a table showing a Y-color gradation value of each pixel of data representing the first-page calibration image immediately after step S101 is completed in the thermal transfer printing apparatus according to the first embodiment.

FIG. 9 is a diagram showing the first-page calibration image immediately after step S101 is completed in the thermal transfer printing apparatus according to the first embodiment. The first-page calibration image 70*a* includes nine first-page calibration patterns 71*a*.

The first-page calibration patterns 71*a* are individually referred to as a first first-page Y-color calibration pattern 71Yaa, a second first-page Y-color calibration pattern 71Yba, a third first-page Y-color calibration pattern 71Yca, a first first-page M-color calibration pattern 71Maa, a second first-page M-color calibration pattern 71Mba, a third first-page M-color calibration pattern 71Mca, a first first-page C-color calibration pattern 71Caa, a second first-page C-color calibration pattern 71Cba, and a third first-page C-color calibration pattern 71Cca. Note that the coordinates and length in the primary scanning direction X of each of the first-page calibration patterns 71*a* are the same as the coordinates and length of a corresponding calibration pattern 71, and thus no description on the primary scanning direction X of the first-page calibration patterns 71*a* will be given.

TP1 denotes a length of each of the first-page calibration patterns 71*a* in the sub-scanning direction Y. TP1 is equal to or less than the length TA of each of the printing surface 60 of the ink sheet 13 in the sub-scanning direction Y. Further, a front end of the first-page calibration pattern 71*a* is a side extending in the primary scanning direction X along the coordinate TPSe. Further, a rear end of the first-page calibration pattern 71*a* is a side extending in the primary scanning direction X along the coordinate TPs, as with the calibration pattern 71. Note that data on gradation of the first-page calibration pattern 71*a* is the same as the data on gradation of a section from TPs to TPSe of the calibration pattern 71.

Further, on a front-end side, beyond the coordinate TPSs, of each of the first-page calibration patterns 71*a*, a first-page superimposing portion 72*a* that is superimposed on a second-page calibration pattern 71*b* (to be described later) during printing is included. The first-page superimposing portion 72*a* of the first first-page Y-color calibration pattern 71Yaa is referred to as a first first-page Y-color superimposing portion 72Yaa. The first-page superimposing portion 72*a* of the second first-page Y-color calibration pattern 71Yba is referred to as a second first-page Y-color superimposing portion 72Yba. The first-page superimposing portion 72*a* of the third first-page Y-color calibration pattern 71Yca is referred to as a third first-page Y-color superimposing portion 72Yca. The first-page superimposing portion 72*a* of the first first-page M-color calibration pattern 71Maa is referred to as a first first-page M-color superimposing portion 72Maa. The first-page superimposing portion 72*a* of the second first-page M-color calibration pattern 71Mba is referred to as a second first-page M-color superimposing portion 72Mba. The first-page superimposing portion 72*a* of the third first-page M-color calibration pattern 71Mca is referred to as a third first-page M-color superimposing portion 72Mca. The first-page superimposing portion 72*a* of the first first-page C-color calibration pattern 71Caa is referred to as a first first-page C-color superimposing portion 72Caa. The first-page superimposing portion 72*a* of the second first-page C-color calibration pattern 71Cba is referred to as a second first-page C-color superimposing portion 72Cba. The first-page superimposing portion 72*a* of the third first-page C-color calibration pattern 71Cca is referred to as a third first-page C-color superimposing portion 72Cca. Further, TP3 denotes a length of each of the first-page superimposing portions 72*a* in the sub-scanning direction Y.

Furthermore, on a rear-side end, beyond the coordinate TPSs, of each of the first-page calibration patterns 71*a*, a first-page non-superimposing portion 73*a* that is not superimposed on the second-page calibration pattern 71*b* (to be described later) during printing is included. The first-page non-superimposing portion 73*a* of the first first-page Y-color calibration pattern 71Yaa is referred to as a first first-page Y-color non-superimposing portion 73Yaa. The first-page non-superimposing portion 73*a* of the second first-page Y-color calibration pattern 71Yba is referred to as a second first-page Y-color non-superimposing portion 73Yba. The first-page non-superimposing portion 73*a* of the third first-page Y-color calibration pattern 71Yca is referred to as a third first-page Y-color non-superimposing portion 73Yca. The first-page non-superimposing portion 73*a* of the first first-page M-color calibration pattern 71Maa is referred to as a first first-page M-color non-superimposing portion 73Maa. The first-page non-superimposing portion 73*a* of the second first-page M-color calibration pattern 71Mba is referred to as a second first-page M-color non-superimposing portion 73Mba. The first-page non-superimposing portion 73*a* of the third first-page M-color calibration pattern 71Mca is referred to as a third first-page M-color non-superimposing portion 73Mca. The first-page non-superimposing portion 73*a* of the first first-page C-color calibration pattern 71Caa is referred to as a first first-page C-color non-superimposing portion 73Caa. The first-page non-superimposing portion 73*a* of the second first-page C-color calibration pattern 71Cba is referred to as a second first-page C-color non-superimposing portion 73Cba. The first-page non-superimposing portion 73*a* of the third first-page C-color calibration pattern 71Cca is referred to as a third first-page C-color non-superimposing portion 73Cca.

FIG. 10 is a table showing a Y-color gradation value of each pixel of data representing the first-page calibration image immediately after step S101 is completed in the thermal transfer printing apparatus according to the first embodiment. Here, the gradation value of each pixel of the data representing the first-page calibration image 70*a* is given as an example. Note that gradation values of pixels having the same line number in the primary scanning direction X are identical to each other in the same first-page calibration pattern 71*a*, and thus no description will be given of the gradation value of each pixel in the primary scanning direction X. Comparing the data representing the first-page calibration image 70*a* shown in FIG. 10 with the data representing the calibration image 70 shown in FIG. 8 reveals that the Y-color gradation values of pixels in the range from the line number #TPSe+1 to the line number #Tpe in the sub-scanning direction Y of the data representing the first-page calibration image 70*a* are 0.

Figures 11, 12:
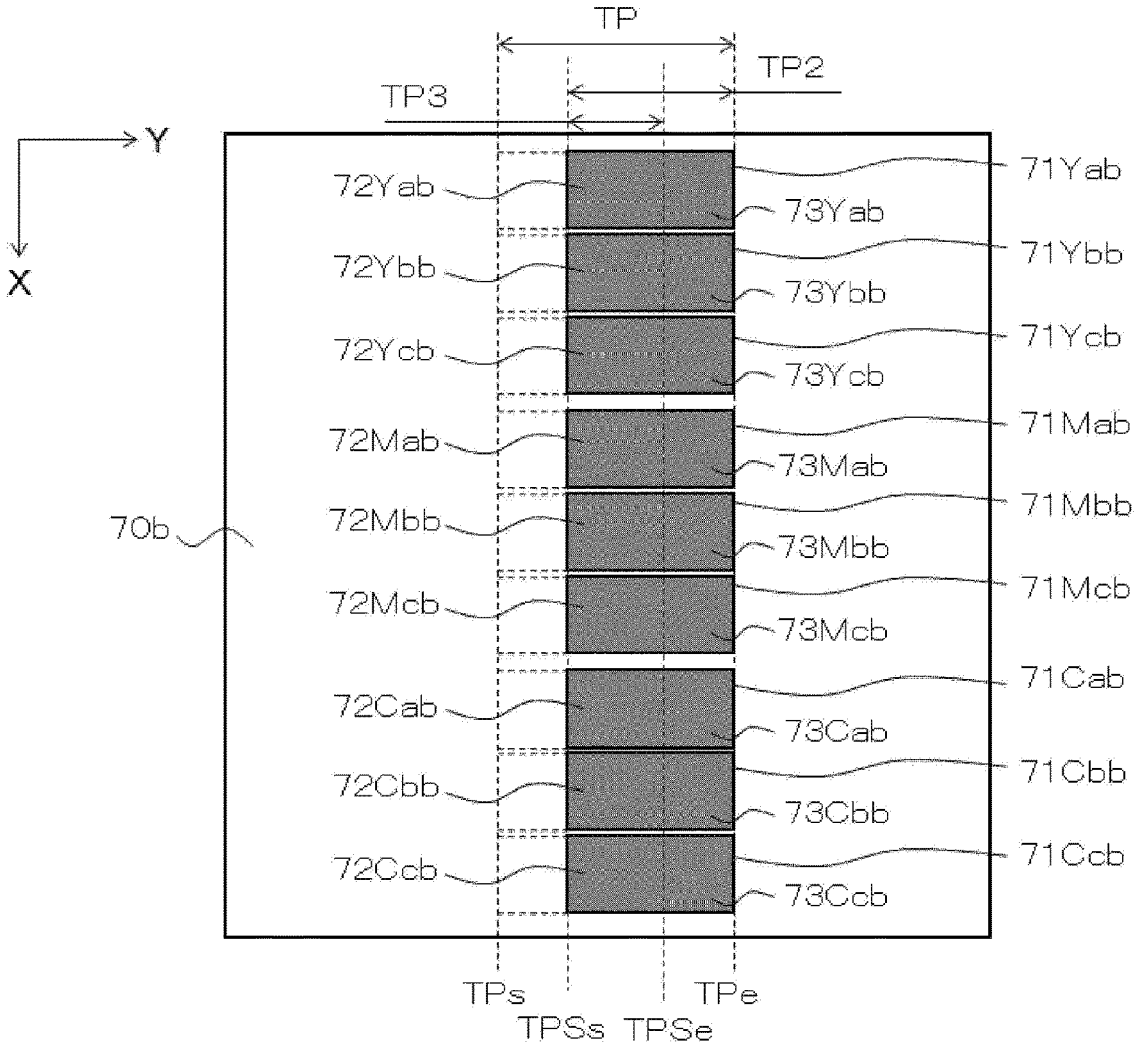
FIG. 11 is a diagram showing a second-page calibration image immediately after step S101 is completed in the thermal transfer printing apparatus according to the first embodiment.
FIG. 12 is a table showing a Y-color gradation value of each pixel of data representing the second-page calibration image immediately after step S101 is completed in the thermal transfer printing apparatus according to the first embodiment.

FIG. 11 is a diagram showing the second-page calibration image immediately after step S101 is completed in the thermal transfer printing apparatus according to the first embodiment. The second-page calibration image 70*b* includes nine second-page calibration patterns 71*b*.

The second-page calibration patterns 71*b* are individually referred to as a first second-page Y-color calibration pattern 71Yab, a second second-page Y-color calibration pattern 71Ybb, a third second-page Y-color calibration pattern 71Ycb, a first second-page M-color calibration pattern 71Mab, a second second-page M-color calibration pattern 71Mbb, a third second-page M-color calibration pattern 71Mcb, a first second-page C-color calibration pattern 71Cab, a second second-page C-color calibration pattern 71Cbb, and a third second-page C-color calibration pattern 71Ccb. Note that the coordinates and length in the primary scanning direction X of each of the second-page calibration patterns 71*b* are the same as the coordinates and length of a corresponding calibration pattern 71, and thus no description on the primary scanning direction X of the second-page calibration patterns 71*b* will be given.

TP2 denotes a length of each of the second-page calibration patterns 71*b* in the sub-scanning direction Y. TP2 is equal to or less than the length TA of the printing surface 60 of the ink sheet 13 in the sub-scanning direction Y. Further, a rear end of the second-page calibration pattern 71*b* is a side extending in the primary scanning direction X along the coordinate TPSs. Note that a front end of the second-page calibration pattern 71*b* is TPe as with the calibration pattern 71. Further, the gradation value of the second-page calibration pattern 71*b* is the same as the gradation value of a section from TPSs to TPe of the calibration pattern 71.

Further, on a rear-end side, beyond the coordinate TPSe, of each of the second-page calibration patterns 71*b*, a second-page superimposing portion 72*b* that is superimposed on the first-page superimposing portion 72*a* of a corresponding one of the first-page calibration patterns 71*a* during printing is included. The second-page superimposing portion 72*b* of the first second-page Y-color calibration pattern 71Yab is referred to as a first second-page Y-color superimposing portion 72Yab. The second-page superimposing portion 72*b* of the second second-page Y-color calibration pattern 71Ybb is referred to as a second second-page Y-color superimposing portion 72Ybb. The second-page superimposing portion 72*b* of the third second-page Y-color calibration pattern 71Ycb is referred to as a third second-page Y-color superimposing portion 72Ycb. The second-page superimposing portion 72*b* of the first second-page M-color calibration pattern 71Mab is referred to as a first second-page M-color superimposing portion 72Mab. The second-page superimposing portion 72*b* of the second second-page M-color calibration pattern 71Mbb is referred to as a second second-page M-color superimposing portion 72Mbb. The second-page superimposing portion 72*b* of the third second-page M-color calibration pattern 71Mcb is referred to as a third second-page M-color superimposing portion 72Mcb. The second-page superimposing portion 72*b* of the first second-page C-color calibration pattern 71Cab is referred to as a first second-page C-color superimposing portion 72Cab. The second-page superimposing portion 72*b* of the second second-page C-color calibration pattern 71Cbb is referred to as a second second-page C-color superimposing portion 72Cbb. The second-page superimposing portion 72*b* of the third second-page C-color calibration pattern 71Ccb is referred to as a third second-page C-color superimposing portion 72Ccb. Further, TP3 denotes a length of each of the second-page superimposing portions 72*b* in the sub-scanning direction Y.

Furthermore, on a rear-end side, beyond the coordinate TPSe, of each of the second-page calibration patterns 71*b*, a second-page non-superimposing portion 73*b* that is not superimposed on a corresponding one of the first-page calibration patterns 71*a* during printing is included. The second-page non-superimposing portion 73*b* of the first second-page Y-color calibration pattern 71Yab is referred to as a first second-page Y-color non-superimposing portion 73Yab. The second-page non-superimposing portion 73*b* of the second second-page Y-color calibration pattern 71Ybb is referred to as a second second-page Y-color non-superimposing portion 73Ybb. The second-page non-superimposing portion 73*b* of the third second-page Y-color calibration pattern 71Ycb is referred to as a third second-page Y-color non-superimposing portion 73Ycb. The second-page non-superimposing portion 73*b* of the first second-page M-color calibration pattern 71Mab is referred to as a first second-page M-color non-superimposing portion 73Mab. The second-page non-superimposing portion 73*b* of the second second-page M-color calibration pattern 71Mbb is referred to as a second second-page M-color non-superimposing portion 73Mbb. The second-page non-superimposing portion 73*b* of the third second-page M-color calibration pattern 71Mcb is referred to as a third second-page M-color non-superimposing portion 73Mcb. The second-page non-superimposing portion 73*b* of the first second-page C-color calibration pattern 71Cab is referred to as a first second-page C-color non-superimposing portion 73Cab. The second-page non-superimposing portion 73*b* of the second second-page C-color calibration pattern 71Cbb is referred to as a second second-page C-color non-superimposing portion 73Cbb. The second-page non-superimposing portion 73*b* of the third second-page C-color calibration pattern 71Ccb is referred to as a third second-page C-color non-superimposing portion 73Ccb.

Hereinafter, when the first-page superimposing portion 72*a* and the second-page superimposing portion 72*b* are not distinguished from each other, the first-page superimposing portion 72*a* and the second-page superimposing portion 72*b* are collectively referred to as a superimposing portion 72. When the first-page non-superimposing portion 73*a* and the second-page non-superimposing portion 73*b* are not distinguished from each other, the first-page non-superimposing portion 73*a* and the second-page non-superimposing portion 73*b* are collectively referred to as a non-superimposing portion 73.

FIG. 12 is a table showing a Y-color gradation value of each pixel of data representing the second-page calibration image immediately after step S101 is completed in the thermal transfer printing apparatus according to the first embodiment. Here, the gradation value of each pixel of the data representing the second-page calibration image 70*b* is given as an example. Note that, for the same reason as with the first-page calibration pattern 71*a*, no description will be given of the gradation value of each pixel in the primary scanning direction X. Comparing the data representing the second-page calibration image 70*b* shown in FIG. 12 with the data representing the calibration image 70 shown in FIG. 8 reveals that the Y-color gradation values of pixels in the range from the line number #TPs to the line number #TPSs−1 in the sub-scanning direction Y of the data representing the first-page calibration image 70*a* are 0.

A description will be given of the details of the flowchart of the calibration process again with reference to FIG. 5. After step S101 is completed, the process proceeds to step S102. In step S102, the data representing the first-page calibration image 70*a* and the data representing the second-page calibration image 70*b* are stored in the processing data storage part 33.

After step S102 is completed, the process proceeds to step S103. In step S103, the density adjustment processing part 22 uses the density adjustment parameter Ypara1 stored in the calibration-use density adjustment parameter storage part 36 to perform a density adjustment process on a calibration pattern 71 associated with the density adjustment parameter Ypara1 stored in the calibration pattern correspondence storage part 37. Note that the details of the density adjustment process will be described later.

After step S103 is completed, the process proceeds to step S104, and the density adjustment processing part 22 uses the density adjustment parameter Ypara2 stored in the calibration-use density adjustment parameter storage part 36 to perform the density adjustment process on a calibration pattern 71 associated with the density adjustment parameter Ypara2 stored in the calibration pattern correspondence storage part 37.

After step S104 is completed, the process proceeds to step S105, and the density adjustment processing part 22 uses the density adjustment parameter Ypara3 stored in the calibration-use density adjustment parameter storage part 36 to perform the density adjustment process on a calibration pattern 71 associated with the density adjustment parameter Ypara3 stored in the calibration pattern correspondence storage part 37.

Subsequently, in step S106, step S107, step S108, step S109, step S110, and step S111, the density adjustment processing part 22 uses each of the density adjustment parameters Mpara1, Mpara2, Mpara3, Cpara1, Cpara2, and Cpara3 stored in the calibration-use density adjustment parameter storage part 36 to perform the density adjustment process on a calibration pattern 71 associated with the density adjustment parameter stored in the calibration pattern correspondence storage part 37. When step S106, step S107, step S108, step S109, step S110, and step S111 are completed, the process proceeds to step S107, step S108, step S109, step S110, step S111, and step S112, respectively.

FIG. 13 is a detailed flowchart of the density adjustment process on the calibration pattern in the thermal transfer printing apparatus according to the first embodiment. Here, a description will be given of the details of the density adjustment process on the calibration pattern. As a premise at the start of the flowchart of FIG. 10, it is assumed that any one of step S103 to step S111 in the flowchart of FIG. 6 has been already started.

First, in step S300, the density adjustment processing part 22 acquires the density adjustment parameter stored in the calibration-use density adjustment parameter storage part 36. The density adjustment parameter to be acquired in step S300 is determined in accordance with step S103 to step S111. The density adjustment processing part 22 acquires Ypara1 in step S103, Mpara2 in step S104, Ypara3 in step S105, Mpara1 in step S106, Mpara2 in step S107, Mpara3 in step S108, Cpara1 in step S109, Cpara2 in step S110, Cpara3 in step S111.

After step S300 is completed, the process proceeds to step S301. In step S301, the density adjustment processing part 22 acquires, from the calibration pattern correspondence storage part 37, information representing which calibration pattern is associated with the density adjustment parameter acquired in step S300.

FIG. 14 is a table showing a correspondence between the density adjustment parameter and the calibration pattern stored in the calibration pattern correspondence storage part of the thermal transfer printing apparatus according to the first embodiment. In the first embodiment, stored in the calibration pattern correspondence storage part 37 are correspondences between the density adjustment parameter Ypara1 and the first Y-color calibration pattern 71Ya, between the density adjustment parameter Ypara2 and the second Y-color calibration pattern 72Yb, between the density adjustment parameter Ypara3 and the third Y-color calibration pattern 73Yc, between the density adjustment parameter Mpara1 and the first M-color calibration pattern 71Ma, between the density adjustment parameter Mpara2 and the second M-color calibration pattern 71Mb, between the density adjustment parameter Mpara3 and the third M-color calibration pattern 71Mc, between the density adjustment parameter Cpara1 and the first C-color calibration pattern 71Ca, between the density adjustment parameter Cpara2 and the second C-color calibration pattern 71Cb, between the density adjustment parameter Cpara3 and third C-color calibration pattern 71Cc.

A description will be given of the details of the flowchart of the density adjustment process on the calibration pattern again with reference to FIG. 13. After step S301 is completed, the process proceeds to step S302. In step S302, the density adjustment processing part 22 uses the density adjustment parameter acquired in step S301 to perform the density adjustment process on the superimposing portion 72 of the calibration pattern 71 associated with the density adjustment parameter acquired in step S301 for the first-page calibration image 70*a* and the second-page calibration image 70*b* stored in the processing data storage part 33.

Figure 15:
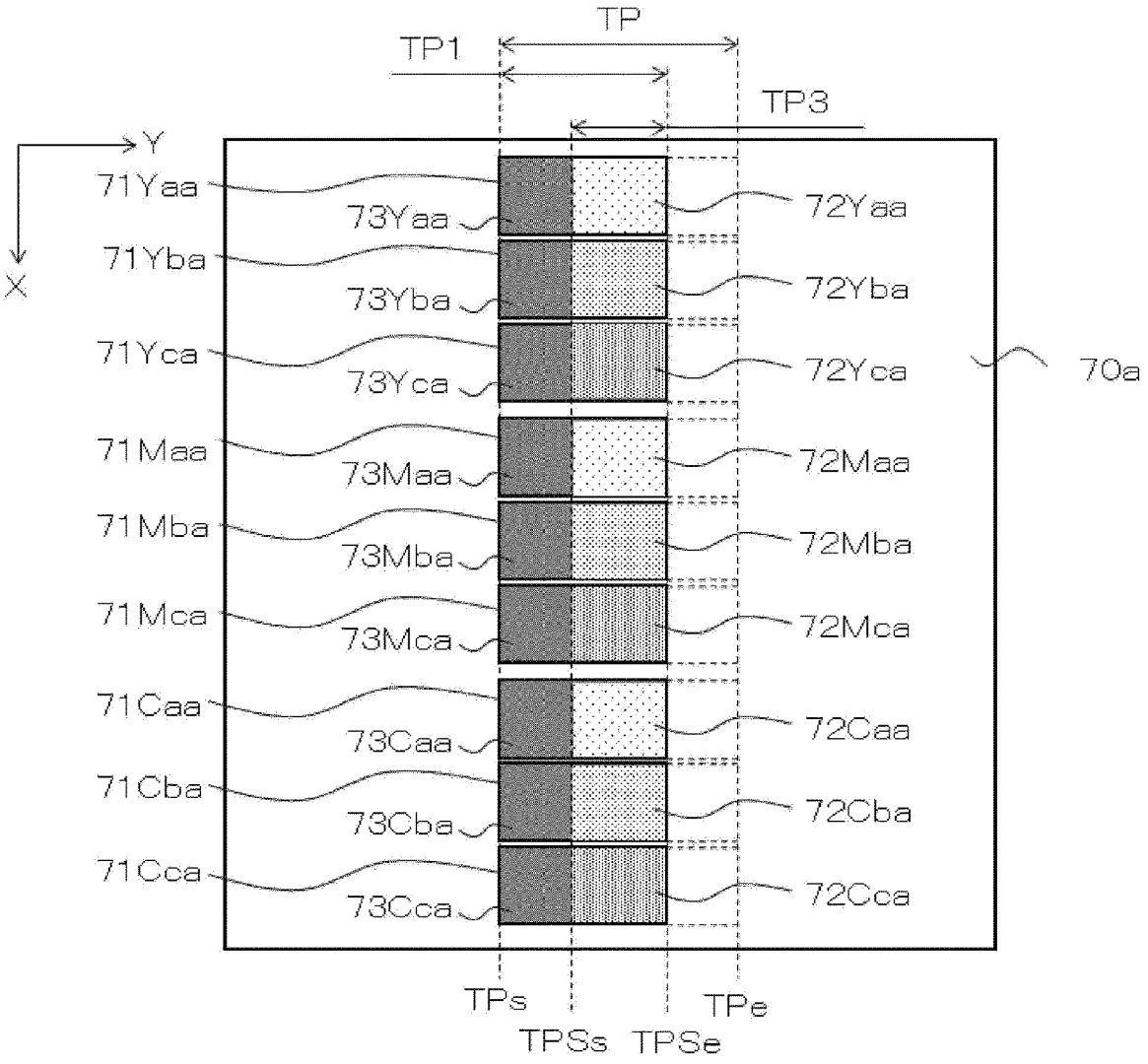
FIG. 15 is a diagram showing the first-page calibration image immediately after step S111 is completed in the thermal transfer printing apparatus according to the first embodiment.
Figure 16:
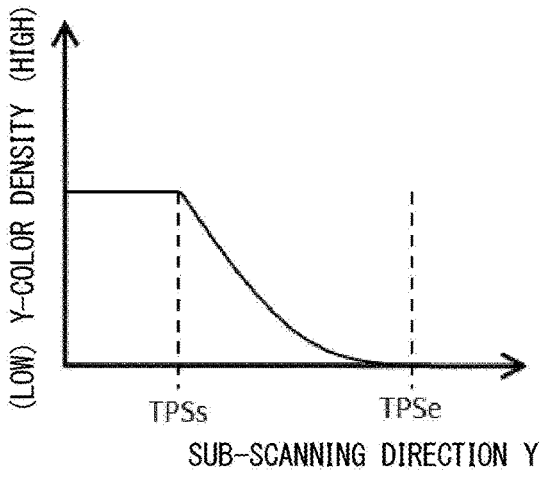
FIG. 16 is a graph showing a Y-color density of a range from coordinates TPSs to TPSe in a sub-scanning direction Y of a first Y-color (printed) calibration pattern of the first-page calibration image immediately after step S111 is completed in the thermal transfer printing apparatus according to the first embodiment.

FIG. 15 is a diagram showing the first-page calibration image immediately after step S111 is completed in the thermal transfer printing apparatus according to the first embodiment. FIG. 16 is a graph showing a Y-color density of a range from the coordinates TPSs to TPSe in the sub-scanning direction Y of the first Y-color calibration pattern of the first-page calibration image immediately after step S111 is completed in the thermal transfer printing apparatus according to the first embodiment. FIG. 17 is a graph showing a Y-color density of a range from the coordinates TPSs to TPSe in the sub-scanning direction Y of the second Y-color calibration pattern of the first-page calibration image immediately after step S111 is completed in the thermal transfer printing apparatus according to the first embodiment. FIG. 18 is a graph showing a Y-color density of a range from the coordinates TPSs to TPSe in the sub-scanning direction Y of the third Y-color calibration pattern of the first-page calibration image immediately after step S111 is completed in the thermal transfer printing apparatus according to the first embodiment. Here, a description will be given of the details of the density adjustment parameter for the first-page calibration image 70*a* and the first-page calibration image 70*a* subjected to all the density adjustment processes.

Each density adjustment parameter is set so that density adjustment is performed on the first-page superimposing portion 72*a* of the first-page calibration pattern 71*a* associated with the density adjustment parameter to cause the image density to gradually decrease from the rear end toward the front end in the sub-scanning direction Y. Furthermore, each density adjustment parameter is adjusted so that the density at TPSs that is the rear end of the first-page superimposing portion 72*a* is maintained the same as before the density adjustment, and the Y-color density at TPSe that is the front end becomes 0.

Further, the density adjustment parameters Ypara1, Ypara2, and Ypara3 are set so that the density of the first-page superimposing portion 72*a* at the same coordinate in the sub-scanning direction Y except the front end and the rear end satisfies a relation of the Y-color density after density adjustment using Ypara1<the Y-color density after density adjustment using Ypara2<the Y-color density after density adjustment using Mpara3.

Therefore, in each of the first-page calibration patterns 71*a* subjected to the density adjustment, the density of the first-page superimposing portion 72*a* gradually decreases from the rear end toward the front end in the sub-scanning direction Y. Further, the Y-color density of the first-page superimposing portion 72*a* at the same coordinate in the sub-scanning direction Y except the front end and the rear end satisfies a relation of the first first-page Y-color superimposing portion 72Yaa<the second first-page Y-color superimposing portion 72Yba<the third first-page Y-color superimposing portion 72Yca.

The density adjustment parameters Mpara1, Mpara2, and Mpara3, and the density adjustment parameters Cpara1, Cpara2, and Cpara3 are set to satisfy a similar relation. That is, the density of the first-page superimposing portion 72*a* at the same coordinate in the sub-scanning direction Y except the front end and the rear end satisfies a relation of the M-color density after density adjustment using Mpara1<the M-color density after density adjustment using Mpara2<the M-color density after density adjustment using Mpara3, and a relation of the C-color density after density adjustment using Cpara1<the C-color density after density adjustment using Cpara2<the C-color density after density adjustment using Cpara3.

Therefore, in the first-page calibration image 70*a* subjected to the density adjustment, the M-color density and the C-color density of the first-page superimposing portion 72*a* at the same coordinate in the sub-scanning direction Y except the front end and the rear end satisfy a relation of the first first-page M-color superimposing portion 72Maa<the second first-page M-color superimposing portion 72Mba<the third first-page M-color superimposing portion 72Mca, and a relation of the first first-page C-color superimposing portion 72Caa<the second first-page C-color superimposing portion 72Cba<the third first-page C-color superimposing portion 72Cca, respectively.

Figures 20, 21:
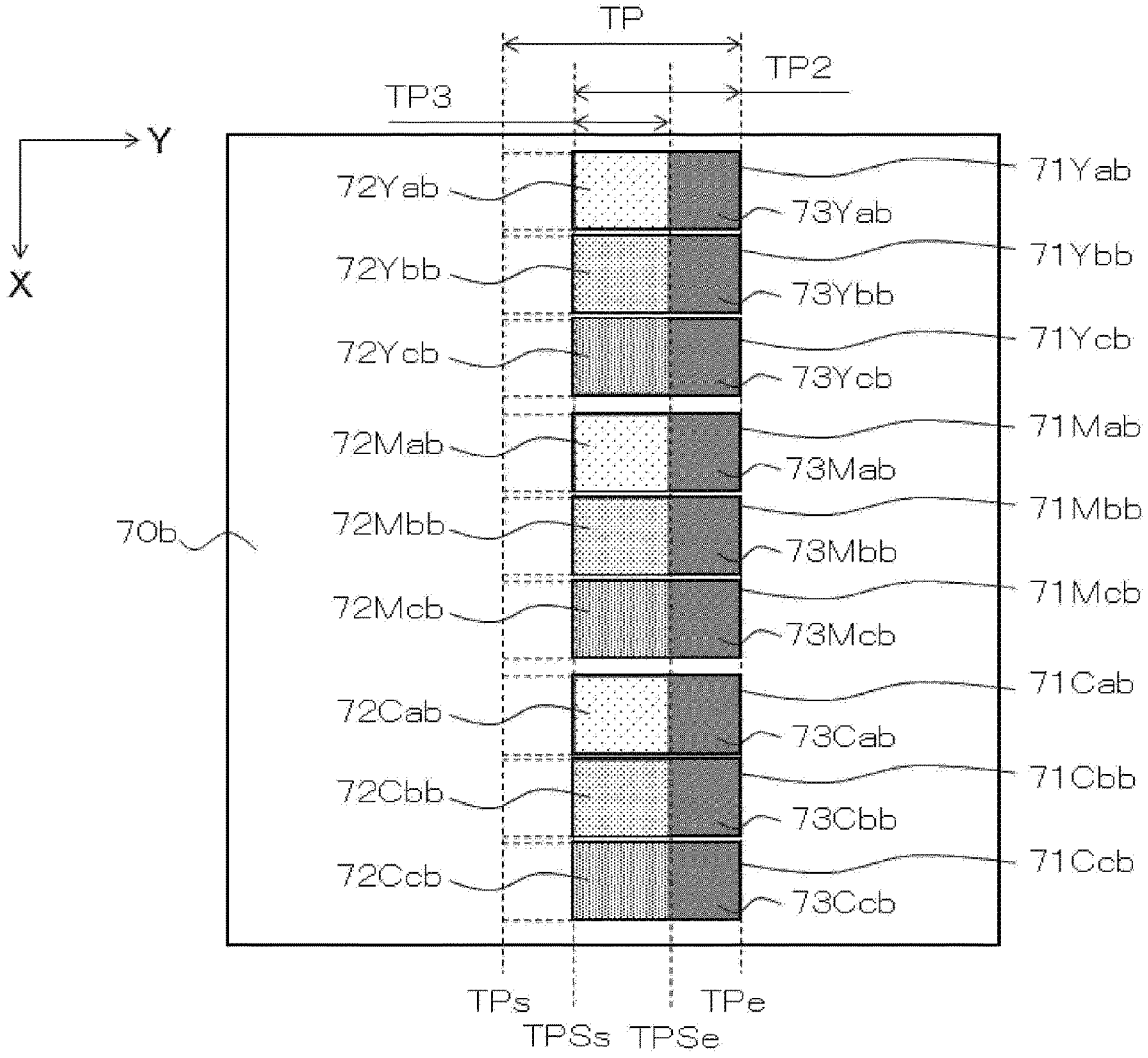
FIG. 20 is a table showing a Y-color gradation value of each pixel of data representing the first-page calibration image immediately after step S111 is completed in the thermal transfer printing apparatus according to the first embodiment.
FIG. 21 is a diagram showing the second-page calibration image immediately after step S111 is completed in the thermal transfer printing apparatus according to the first embodiment.

FIG. 19 is a table showing data on the density adjustment parameters Ypara1, Ypara2, and Ypara3 for the first-page calibration image in the thermal transfer printing apparatus according to the first embodiment. FIG. 20 is a table showing the Y-color gradation value of each pixel of data representing the first-page calibration image immediately after step S111 is completed in the thermal transfer printing apparatus according to the first embodiment. Here, specific data representing density adjustment parameters and gradation values of pixels of the data representing the first-page calibration image 70*a* subjected to the density adjustment are given as examples.

For the density adjustment parameters Ypara1, Ypara2, and Ypara3 for the first-page calibration image 70*a*, density adjustment factors are predetermined in accordance with the line number of each pixel in the sub-scanning direction Y from the line numbers #N to #N+TP3 in the sub-scanning direction Y. Each of the density adjustment factors is a factor by which the gradation value of a pixel to be subjected to the density adjustment is multiplied, and an upper limit and lower limit of the density adjustment factor are 1 and 0, respectively. Further, the line number #N in the sub-scanning direction Y is a line number of pixels located at the rearmost end of a range to be subjected to the density adjustment and corresponds to #TPSs in the first embodiment. Further, in the first embodiment, since the superimposing portion 72 has a length of TP3, #N+TP3 corresponds to #TPSe.

The respective density adjustment factors of the density adjustment parameters Ypara1, Ypara2, and Ypara3 for the first-page calibration image 70*a* are predetermined to be 1 for the line number #N in the sub-scanning direction Y and predetermined to be 0 for the line number #N+TP3 in the sub-scanning direction Y. Further, each of the density adjustment factors is predetermined so as to gradually decrease from the rear end toward the front end in the sub-scanning direction Y.

Further, the respective density adjustment factors, for the line numbers #N+1 to #N+TP3−1 in the sub-scanning direction Y, of the density adjustment parameters Ypara1, Ypara2, and Ypara3 for the first-page calibration image 70*a* are predetermined so as to satisfy a relation of the density adjustment factor of the density adjustment parameter Ypara1<the density adjustment factor of the density adjustment parameter Ypara2<the density adjustment factor of the density adjustment parameter Ypara3 for the same line number in the sub-scanning direction Y. For example, for #N+(TP3)/2, the density adjustment factor of the density adjustment parameter Ypara1 is 0.25, the density adjustment factor of the density adjustment parameter Ypara2 is 0.5, and the density adjustment factor of the density adjustment parameter Ypara1 is 0.75.

The gradation value of each pixel of the first-page calibration image 70*a* subjected to the density adjustment is calculated as follows. First, the gradation value of each pixel of the first-page calibration image 70*a* subjected to the density adjustment is calculated by multiplying the gradation value of each pixel of each line number of the data representing the first-page calibration image 70*a* before being subjected to the density adjustment process shown in FIG. 10 by a density adjustment factor of an associated density adjustment parameter among the density adjustment parameters shown in FIG. 19.

The following is an example of the calculation. First, among the Y-color gradation values of the pixels of the first-page calibration image 70*a* before being subjected to the density adjustment process, Y-color gradation values of pixels of the line number #N+(TP3)/2 are 128 in the first Y-color calibration pattern 71Ya, 128 in the second Y-color calibration pattern 71Yb, and 128 in the third Y-color calibration pattern 71Yc. The first Y-color calibration pattern 71Ya is associated with the density adjustment parameter Ypara1, and the density adjustment factor of the line number #N+(TP3)/2 of the density adjustment parameter Ypara is 0.25. Multiplying 128 by 0.25 gives 32. Therefore, the Y-color gradation values of the pixels of the line number #N+(TP3)/2 of the first Y-color calibration pattern 71Ya of the first-page calibration image 70*a* subjected to the density adjustment process become 32. In the first embodiment, when the multiplication result does not become an integer, the multiplication result is rounded off to the nearest integer.

Further, the second Y-color calibration pattern 71Yb is associated with the density adjustment parameter Ypara2, and the third Y-color calibration pattern 71Yc is associated with the density adjustment parameter Ypara3. Calculation in the same manner as with the first Y-color calibration pattern 71Ya gives 64 to the Y-color gradation values of the pixels of the line number #N+(TP3)/2 of the second Y-color calibration pattern 71Yb, and gives 95 to the Y-color gradation values of the pixels of the line number #N+(TP3)/2 of the third Y-color calibration pattern 71Yc of the first-page calibration image 70*a* subjected to the density adjustment process.

As described above, the Y-color gradation values of the pixels of the same line number #N+(TP3)/2 in the sub-scanning direction Y after the density adjustment process satisfy a relation of the first first-page Y-color calibration pattern 71Yaa<the second first-page Y-color calibration pattern 71Yba<third first-page Y-color calibration pattern 71Yca.

Figure 22:
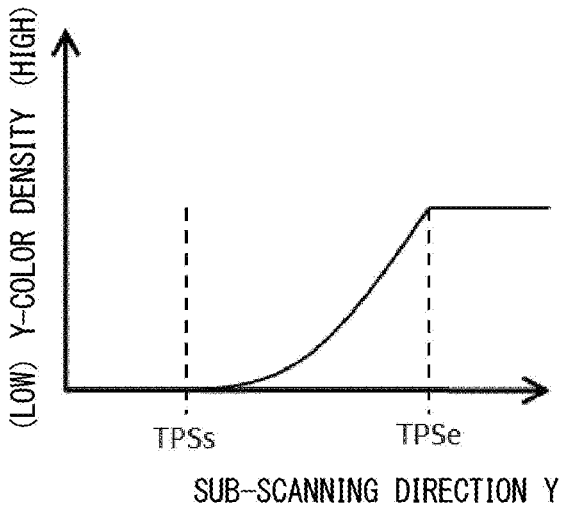
FIG. 22 is a graph showing a Y-color density of a range from the coordinates TPSs to TPSe in the sub-scanning direction Y of a first Y-color calibration pattern of the second-page calibration image immediately after step S111 is completed in the thermal transfer printing apparatus according to the first embodiment.
Figure 23:
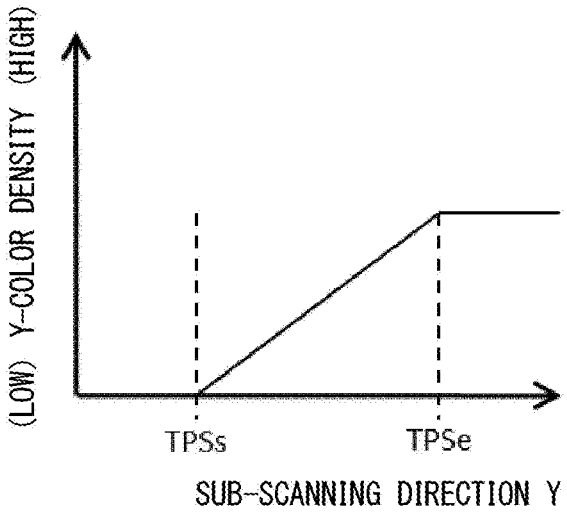
FIG. 23 is a graph showing a Y-color density of a range from the coordinates TPSs to TPSe in the sub-scanning direction Y of a second Y-color calibration pattern of the second-page calibration image immediately after step S111 is completed in the thermal transfer printing apparatus according to the first embodiment.

FIG. 21 is a diagram showing the second-page calibration image immediately after step S111 is completed in the thermal transfer printing apparatus according to the first embodiment. FIG. 22 is a graph showing a Y-color density of a range from the coordinates TPSs to TPSe in the sub-scanning direction Y of the first Y-color calibration pattern of the second-page calibration image immediately after step S111 is completed in the thermal transfer printing apparatus according to the first embodiment. FIG. 23 is a graph showing a Y-color density of a range from the coordinates TPSs to TPSe in the sub-scanning direction Y of the second Y-color calibration pattern of the second-page calibration image immediately after step S111 is completed in the thermal transfer printing apparatus according to the first embodiment. FIG. 24 is a graph showing a Y-color density of a range from the coordinates TPSs to TPSe in the sub-scanning direction Y of the third Y-color calibration pattern of the second-page calibration image immediately after step S111 is completed in the thermal transfer printing apparatus according to the first embodiment. Here, a description will be given of the details of the density adjustment parameter for the second-page calibration image 70*b* and the second-page calibration image 70*b* subjected to all the density adjustment processes.

Each density adjustment parameter is set so that density adjustment is performed on the second-page superimposing portion 72*b* of the second-page calibration pattern 71*b* associated with the density adjustment parameter to cause the image density to gradually increase from the rear end toward the front end in the sub-scanning direction Y. Furthermore, each density adjustment parameter is adjusted so that the density at TPSs that is the rear end of the second-page superimposing portion 72*b* becomes 0, and the Y-color density at TPSe that is the front end is maintained the same as before the density adjustment.

Further, the density adjustment parameters Ypara1, Ypara2, and Ypara3 are set so that the density of the second-page superimposing portion 72*b* at the same coordinate in the sub-scanning direction Y except the front end and the rear end satisfies a relation of the Y-color density after density adjustment using Ypara1<the Y-color density after density adjustment using Ypara2<the Y-color density after density adjustment using Ypara3, as with the first-page superimposing portion 72*a*.

Therefore, in the second-page calibration image 70*b* subjected to the density adjustment, the density of the second-page superimposing portion 72*b* gradually increases from the rear end toward the front end in the sub-scanning direction Y. Further, the Y-color density of the second-page superimposing portion 72*b* at the same coordinate in the sub-scanning direction Y except the front end and the rear end satisfies a relation of the first second-page Y-color superimposing portion 72Yab<the second second-page Y-color superimposing portion 72Ybb<the third second-page Y-color superimposing portion 72Ycb.

The density adjustment parameters Mpara1, Mpara2, and Mpara3 and the density adjustment parameters Cpara1, Cpara2, and Cpara3 are set to satisfy a relation similar to the relation for the first-page calibration image 70*a*. That is, the density of the second-page superimposing portion 72*b* at the same coordinate in the sub-scanning direction Y except the front end and the rear end satisfies a relation of the M-color density after density adjustment using Mpara1<the M-color density after density adjustment using Mpara2<the M-color density after density adjustment using Mpara3, and a relation of the C-color density after density adjustment using Cpara1<the C-color density after density adjustment using Cpara2<the C-color density after density adjustment using Cpara3.

Therefore, in the second-page calibration image 70*b* subjected to the density adjustment, the M-color density and the C-color density of the second-page superimposing portion 72*b* at the same coordinate in the sub-scanning direction Y except the front end and the rear end satisfy a relation of the first second-page M-color superimposing portion 72Mab<the second second-page M-color superimposing portion 72Mbb<the third second-page M-color superimposing portion 72Mcb, and a relation of the first second-page C-color superimposing portion 72Cab<the second second-page C-color superimposing portion 72Cbb<the third second-page C-color superimposing portion 72Ccb, respectively.

FIG. 25 is a table showing data on the density adjustment parameters Ypara1, Mpara2, and Mpara3 for the second-page calibration image in the thermal transfer printing apparatus according to the first embodiment. FIG. 26 is a table showing a Y-color gradation value of each pixel of data representing the second-page calibration image immediately after step S111 is completed in the thermal transfer printing apparatus according to the first embodiment. Here, specific data representing density adjustment parameters and gradation values of pixels of the data representing the second-page calibration image 70*b* subjected to the density adjustment are given as examples.

For the density adjustment parameters Ypara1, Ypara2, and Ypara3 for the second-page calibration image 70*b*, density adjustment factors are predetermined in accordance with the line number from the line numbers #N to #N+TP3 in the sub-scanning direction Y, as with the density adjustment parameters for the first-page calibration image 70*a*. Further, the line number #N in the sub-scanning direction Y is a line number located at the rearmost end of a range to be subjected to the density adjustment and corresponds to #TPSs in the first embodiment. Further, in the first embodiment, since the superimposing portion 72 has a length of TP3, #N+TP3 corresponds to #TPSe.

The respective density adjustment factors of the density adjustment parameters Ypara1, Ypara2, and Ypara3 for the second-page calibration image 70*b* are predetermined to be 0 for the line number #N in the sub-scanning direction Y, and 1 for the line number #N+TP3 in the sub-scanning direction Y. Further, each of the density adjustment factors is predetermined so as to gradually increase from the rear end toward the front end in the sub-scanning direction Y.

Further, the respective density adjustment factors, for the line numbers #N+1 to #N+TP3−1 in the sub-scanning direction Y, of the density adjustment parameters Ypara1, Ypara2, and Ypara3 for the first-page calibration image 70*a* are predetermined so as to satisfy a relation of the density adjustment factor of the density adjustment parameter Ypara1<the density adjustment factor of the density adjustment parameter Ypara2<the density adjustment factor of the density adjustment parameter Ypara3 for the same line number in the sub-scanning direction Y. This relation is similar to the relation for the density adjustment parameters Ypara1, Ypara2, and Ypara3 for the first-page calibration image 70*a*, and thus no description will be given of a specific example of the relation. Further, the calculation of the gradation values of the pixels of the second-page calibration image 70*b* subjected to the density adjustment is also similar to the calculation of the gradation values of the pixels of the first-page calibration image 70*a* subjected to the density adjustment, and thus no description will be given of the calculation.

A description will be given of the details of the flowchart of the density adjustment process on the calibration pattern again with reference to FIG. 13. When step S302 is completed, the process proceeds to step S303. In step S303, the data representing the first-page calibration image 70*a* and the data representing the second-page calibration image 70*b* that have been subjected to the density adjustment process in step S302 are stored in the processing data storage part 33. The completion of step S303 brings the flowchart of the density adjustment process on the calibration to an end.

A description will be given of the details of the flowchart of the calibration process again with reference to FIG. 5. After step S111 is completed, the process proceeds to step S112. In step S112, the data processing part 23 converts each of the data representing the first-page calibration image 70*a* and the data representing the second-page calibration image 70*b* stored in the processing data storage part 33 and subjected to the density adjustment process in step S103 to step S111 into printing data to be thermal-transferred by the thermal head 10.

In step S112, the printing data converted from the data representing the first-page calibration image 70*a* is referred to as a first-page printing data. The printing data converted from the data representing the second-page calibration image 70*b* is referred to as a second-page printing data. Note that the first-page printing data and the second-page printing data each include Y data on Y color, M data on M color, and C data on C color.

After step S112 is completed, the process proceeds to step S113. In step S113, the printing control part 26 sets an optionally selected position on the recording paper 14 as an origin in the sub-scanning direction Y.

After step S113 is completed, the process proceeds to step S114. In step S114, the printing control part 26 controls the printing part 50 based on the first-page printing data converted in step S112 to print the first-page calibration image 70*a*. Note that the details of the printing process will be described later.

After step S114 is completed, the process proceeds to step S115. In step S115, the printing control part 26 controls the printing part 50 based on the second-page printing data converted in step S112 to print the second-page calibration image 70*b*.

Figure 27:
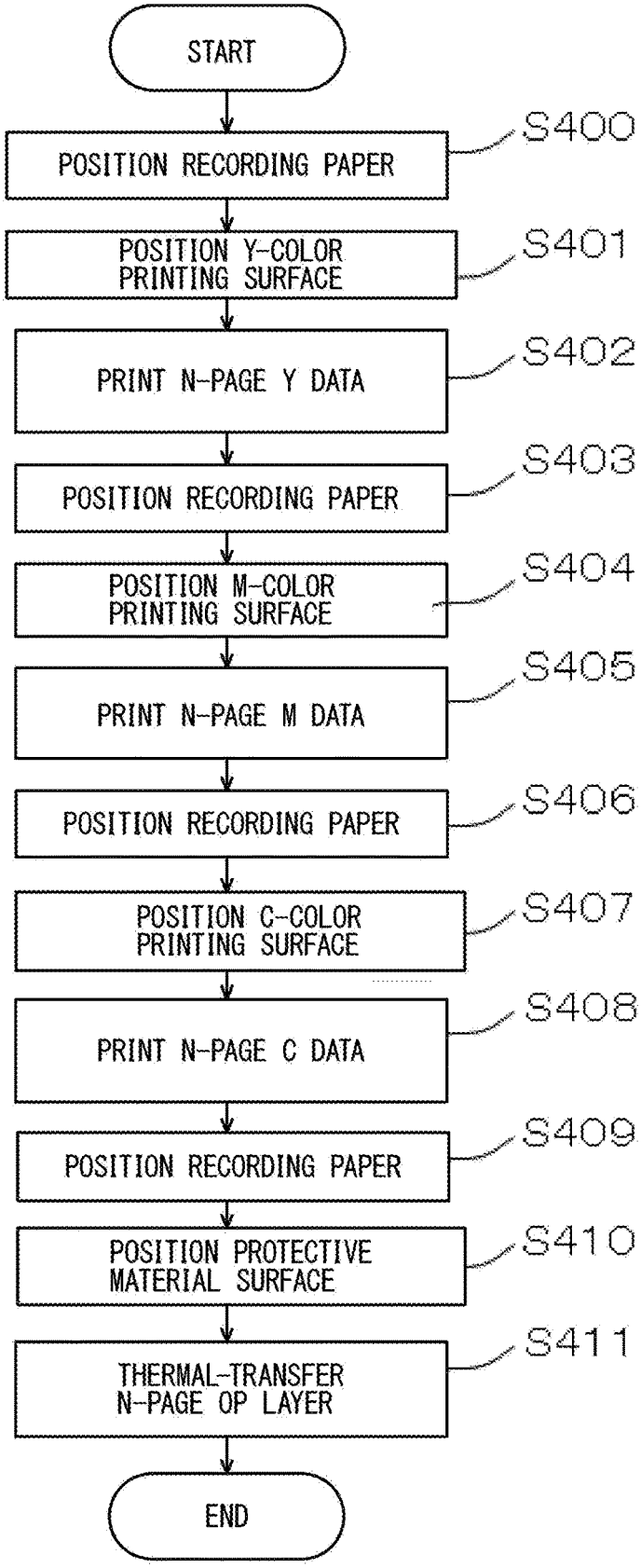
FIG. 27 is a detailed flowchart of a printing process in the thermal transfer printing apparatus according to the first embodiment.

FIG. 27 is a detailed flowchart of the printing process in the thermal transfer printing apparatus according to the first embodiment. Here, a description will be given of the details of the printing process to be performed in step S114 and step S115. As a premise at the start of the flowchart of FIG. 27, it is assumed that either step S114 or step S115 in the flowchart of FIG. 5 has been already started.

In step S400, the printing control part 26 controls the paper feed drive part 51 to position the recording paper 14. During positioning the recording paper 14, the recording paper 14 is moved in the sub-scanning direction Y so that a printing start position is located between the thermal head 10 and the platen roller 11. Further, the printing start position varies in each step. For example, the printing start position in step S114 is the coordinate TPs in the sub-scanning direction Y that is the rear end of the first-page calibration pattern 71*a*. The printing start position in step S115 is the coordinate TPSs in the sub-scanning direction Y that is the rear end of the second-page calibration pattern 71*b*.

After step S400 is completed, the process proceeds to step S401. In step S401, the printing control part 26 controls the ink sheet feed drive part 52 to position the Y-color printing surface 60Y of the ink sheet 13. The positioning of the printing surface 60 is to move the ink sheet 13 in the sub-scanning direction Y so that an ink use position is located between the thermal head 10 and the platen roller 11. Further, the ink use position varies in each step. For example, the ink use position in step S114 is the rear end Yya of the first Y-color printing surface 60Ya. Further, the ink use position in step S115 is the rear end Yyb of the second Y-color printing surface 60Yb.

After step S401 is completed, the process proceeds to step S402. In step S402, the printing control part 26 controls the paper feed drive part 51, the ink sheet feed drive part 52, and the thermal head drive part 53 to make a print on the recording paper 14 based on the Y data of the N-page printing data. Here, N is a natural number that varies in each step, and is "first" in step S114 and "second" in step S115.

After step S402 is completed, the process proceeds to step S403. In step S403, as in step S400, the printing control part 26 controls the paper feed drive part 51 to position the recording paper 14. Step S403 is the same as step S400, and thus no description will be given of step S404.

After step S403 is completed, the process proceeds to step S404. In step S404, the printing control part 26 controls the ink sheet feed drive part 52 to position the M-color printing surface 60M of the ink sheet 13. Further, the ink use position varies in each step. For example, the ink use position in step S114 is the rear end Yma of the first M-color printing surface 60Ma. Further, the ink use position in step S115 is the rear end Ymb of the second M-color printing surface 60Mb.

After step S404 is completed, the process proceeds to step S405. In step S405, the printing control part 26 controls the paper feed drive part 51, the ink sheet feed drive part 52, and the thermal head drive part 53 to make a print on the recording paper 14 based on the M data of the N-page printing data. As in step S402, N is a natural number that varies in each step, and is "first" in step S114 and "second" in step S115.

After step S405 is completed, the process proceeds to step S406. In step S406, as in step S400, the printing control part 26 controls the paper feed drive part 51 to position the recording paper 14. Step S406 is the same as step S400, and thus no description will be given of step S406.

After step S406 is completed, the process proceeds to step S407. In step S407, the printing control part 26 controls the ink sheet feed drive part 52 to position the C-color printing surface 60C of the ink sheet 13. Further, the ink use position varies in each step. For example, the ink use position in step S114 is the rear end Yca of the first C-color printing surface 60Ca. Further, the ink use position in step S115 is the rear end Ycb of the second C-color printing surface 60Cb.

After step S407 is completed, the process proceeds to step S408. In step S408, the printing control part 26 controls the paper feed drive part 51, the ink sheet feed drive part 52, and the thermal head drive part 53 to make a print on the recording paper 14 based on the C data of the N-page printing data. As in step S402, N is a natural number that varies in each step, and is "first" in step S114 and "second" in step S115.

After step S408 is completed, the process proceeds to step S409. In step S409, as in step S400, the printing control part 26 controls the paper feed drive part 51 to position the recording paper 14. Step S409 is the same as step S400, and thus no description will be given of step S409.

After step S409 is completed, the process proceeds to step S410. In step S410, the printing control part 26 controls the ink sheet feed drive part 52 to position the protective material surface 61 of the ink sheet 13. The positioning of the protective material surface 61 is to move the ink sheet 13 in the sub-scanning direction Y so that a protective material use position is located between the thermal head 10 and the platen roller 11. Further, the protective material use position varies in each step. For example, the protective material use position in step S114 is the rear end Yopa of the first protective material surface 61*a*. Further, the protective material use position in step S115 is the rear end Yopb of the second protective material surface 61*b*.

After step S410 is completed, the process proceeds to step S411. In step S411, the printing control part 26 controls the paper feed drive part 51, the ink sheet feed drive part 52, and the thermal head drive part 53 to thermal-transfer a protective layer to the recording paper 14. As in step S402, N is a natural number that varies in each step, and is "first" in step S114 and "second" in step S115.

The completion of step S411 brings the flowchart of the printing process to an end.

A description will be given of the details of the flowchart of the calibration process again with reference to FIG. 5. After step S115 is completed, the process proceeds to step S116. In step S116, the printing control part 26 controls the paper feed drive part 51 and the recording paper cutting mechanism drive part 54 to eject the recording paper 14 on which the print has been made. Specifically, the printing control part 26 controls the paper feed drive part 51 to move the recording paper 14 in the sub-scanning direction Y so that a cutting position of the recording paper 14 is located in the cutter 12, and then controls the recording paper cutting mechanism drive part 54 to cut the recording paper 14. The cutting position of the recording paper 14 is the front end of the calibration image 70 in the sub-scanning direction Y.

Figure 28:
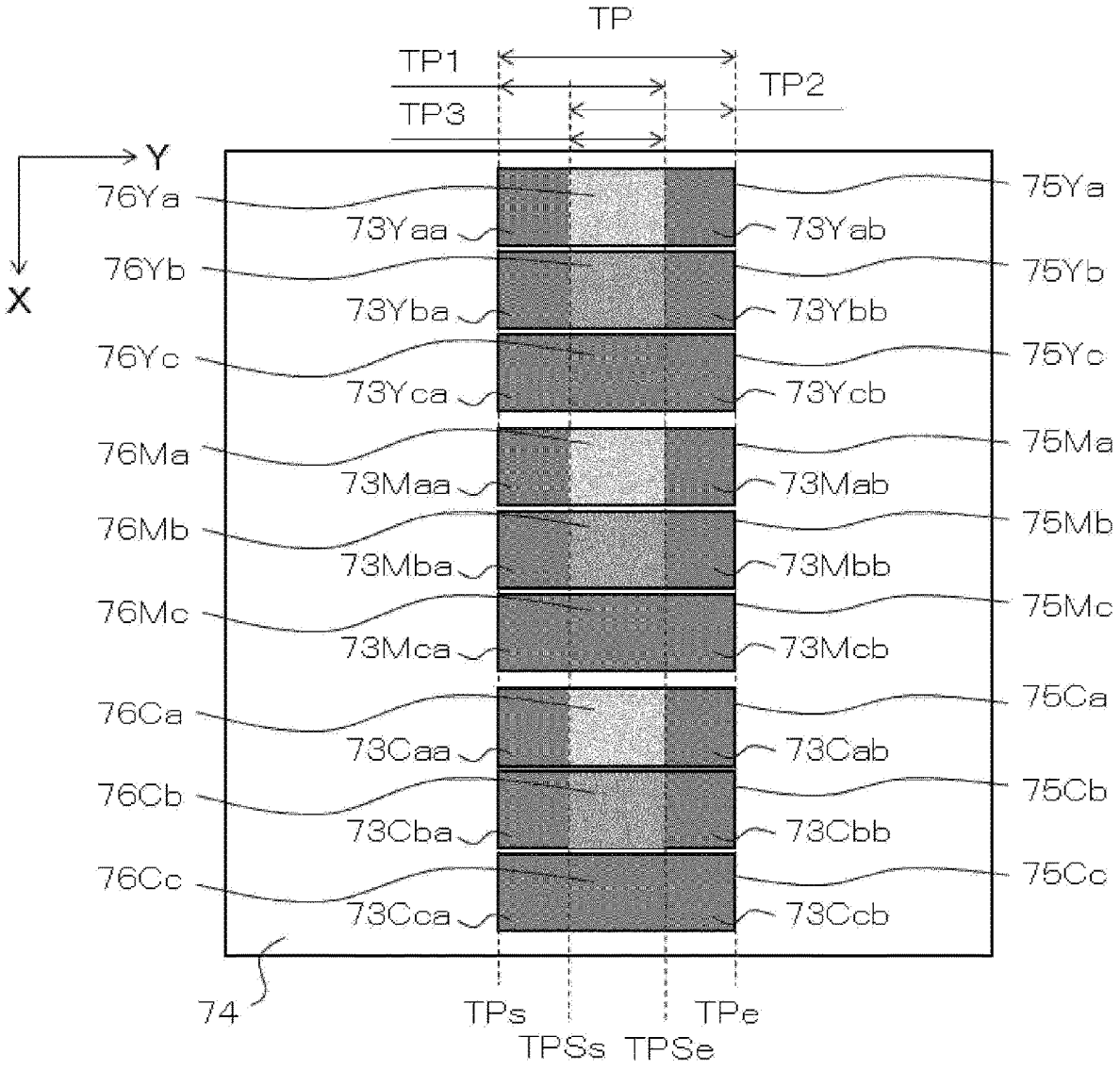
FIG. 28 is a diagram showing a printed calibration image in the thermal transfer printing apparatus according to the first embodiment.

FIG. 28 is a diagram showing a printed calibration image in the thermal transfer printing apparatus according to the first embodiment. Here, a description will be given of the printed calibration image. A printed calibration image 74 is an image printed on the recording paper ejected in step S116.

The printed calibration image 74 is an image that is a combination of the first-page calibration image 70*a* subjected to the density adjustment process and printed in step S114 and the second-page calibration image 70*b* subjected to the density adjustment process and printed in step S115.

In the printed calibration image 74, three Y-color printed calibration patterns 75Y, three M-color printed calibration patterns 75M, and three C-color printed calibration patterns 75C are formed. The printed calibration patterns 75 are individually referred to as a first Y-color printed calibration pattern 75Ya, a second Y-color printed calibration pattern 75Yb, a third Y-color printed calibration pattern 75Yc, a first M-color printed calibration pattern 75Ma, a second M-color printed calibration pattern 75Mb, a third M-color printed calibration pattern 75Mc, a first C-color printed calibration pattern 75Ca, a second C-color printed calibration pattern 75Cb, and a third C-color printed calibration pattern 75Cc.

Each of the printed calibration patterns 75 is constituted by a combination of the first-page calibration pattern 71*a* and the second-page calibration pattern 71*b*. Further, the printed calibration pattern 75 includes a printed superimposing portion 76 in which the first-page superimposing portion 72*a* of the first-page calibration pattern 71*a* and the second-page superimposing portion 72*b* of the second-page calibration pattern 71*b* superimposed on each other are printed. The printed superimposing portion 76 of the first Y-color printed calibration pattern 75Ya is referred to as a first Y-color printed superimposing portion 76Ya. The printed superimposing portion 76 of the second Y-color printed calibration pattern 75Yb is referred to as a second Y-color printed superimposing portion 76Yb. The printed superimposing portion 76 of the third Y-color printed calibration pattern 75Yc is referred to as a third Y-color printed superimposing portion 76Yc. The printed superimposing portion 76 of the first M-color printed calibration pattern 75Ma is referred to as a first M-color printed superimposing portion 76Ma. The printed superimposing portion 76 of the second M-color printed calibration pattern 75Mb is referred to as a second M-color printed superimposing portion 7 Mb. The printed superimposing portion 76 of the third M-color printed calibration pattern 75Mc is referred to as a third M-color printed superimposing portion 76Mc. The printed superimposing portion 76 of the first C-color printed calibration pattern 75Ca is referred to as a first C-color printed superimposing portion 76Ca. The printed superimposing portion 76 of the second C-color printed calibration pattern 75Cb is referred to as a second C-color printed superimposing portion 76Cb. The printed superimposing portion 76 of the third C-color printed calibration pattern 75Cc is referred to as a third C-color printed superimposing portion 76Cc.

Further, a density of the printed superimposing portion 76 satisfies a relation of (a density of) the first Y-color printed superimposing portion 76Ya<the second Y-color printed superimposing portion 76Yb<the third Y-color printed superimposing portion 76Yc. The reason is that the relation of the first first-page Y-color superimposing portion 72Yaa<the second first-page Y-color superimposing portion 72Yba<the third first-page Y-color superimposing portion 72Yac and the relation of the first second-page Y-color superimposing portion 72Yab<the second second-page Y-color superimposing portion 72Ybb<the third second-page Y-color superimposing portion 72Ycb are satisfied due to the density adjustment process.

For the same reason, a relation of (a density of) the first M-color printed superimposing portion 76Ma<the second M-color printed superimposing portion 76Mb<the third M-color printed superimposing portion 76Mc is satisfied. Furthermore, for the same reason, a relation of (a density of) the first C-color printed superimposing portion 76Ca<the second C-color printed superimposing portion 76Cb<the third C-color printed superimposing portion 76Cc is satisfied.

Further, each of the printed calibration patterns 75 includes the first-page non-superimposing portion 73*a* and the second-page non-superimposing portion 73*b* as the non-superimposing portions 73. This allows the user to compare the density of the printed superimposing portion 76 of the printed calibration pattern 75 with the density of the non-superimposing portion 73.

Further, since the printed calibration image 74 is printed on the recording paper 14, the printed calibration image 74 contains disturbance factors such as variations in characteristics of the ink sheet and the recording paper to be used or a difference between environments where printing is performed.

After step S116 is completed, the process proceeds to step S117. In step S117, the thermal transfer printer 100 waits for a predetermined time.

While the thermal transfer printer 100 is in wait in step S117, the user compares the density of the printed superimposing portion 76 of each of the printed calibration patterns 75 with the density of the non-superimposing portion 73, and selects, from among the Y-color, M-color, and C-color printed calibration patterns 75, a printed calibration pattern 75 in which the superimposing portion is less noticeable. The user inputs the printed calibration pattern 75 thus selected from the external information processing apparatus 200. After input by the user, the external information processing apparatus 200 transmits a signal containing information on the selected printed calibration pattern 75 to the calibration pattern selection receiving part 43.

When the predetermined time has elapsed in step S117, the process proceeds to step S118. In step S118, the determination part 25 determines whether the printed calibration patterns 75 have been selected for all the colors. For example, when the signal received by the calibration pattern selection receiving part 43 contains respective pieces of information on the printed calibration patterns 75 selected for all of Y color, M color, and C color, the determination part 25 determines that the printed calibration patterns 75 have been selected for all the colors (Yes in step S118). When the signal received by the calibration pattern selection receiving part 43 does not contain any of the respective pieces of information on the printed calibration patterns 75 selected for Y color, M color, and C color, the determination part 25 determines that the printed calibration patterns 75 have not been selected for all the colors (No in step S118).

When the determination part 25 determines in step S118 that the printed calibration patterns 75 have not been selected for all the colors (No in step S118), the process returns to step S117, and the thermal transfer printer 100 waits for the predetermined time.

When the determination part 25 determines in step S118 that the printed calibration patterns 75 have been selected for all the colors (Yes in step S118), the process proceeds to step S119. In step S119, the respective density adjustment parameters for Y color, M color, and C color based on the signal containing the respective pieces of information on the selected printed calibration patterns 75 received by the calibration pattern selection receiving part 43 are stored in the density adjustment parameter storage part 32. Specifically, the respective density adjustment parameters for Y color, M color, and C color used in the density adjustment process on the first-page calibration pattern 71*a* and the second-page calibration pattern 71*b* that constitute each of the selected printed calibration patterns 75 are stored in the density adjustment parameter storage part 32.

For example, it is assumed that the user selects the third Y-color printed calibration pattern 75Yc for Y color, the third M-color printed calibration pattern 75Mc for M color, and the third C-color printed calibration pattern 75Cc for C color. The third Y-color printed calibration pattern 75Yc is constituted by a combination of the third first-page Y-color calibration pattern 71Yca and the third second-page Y-color calibration pattern 71Ycb both subjected to the density adjustment process using the density adjustment parameter Ypara3, and thus the density adjustment parameter Ypara3 is stored in the density adjustment parameter storage part 32. For the same reason, the density adjustment parameter Mpara3 and the density adjustment parameter Cpara3 are stored in the density adjustment parameter storage part 32.

After step S119 is completed, the thermal transfer printer 100 brings the calibration process to an end.

Figure 29:
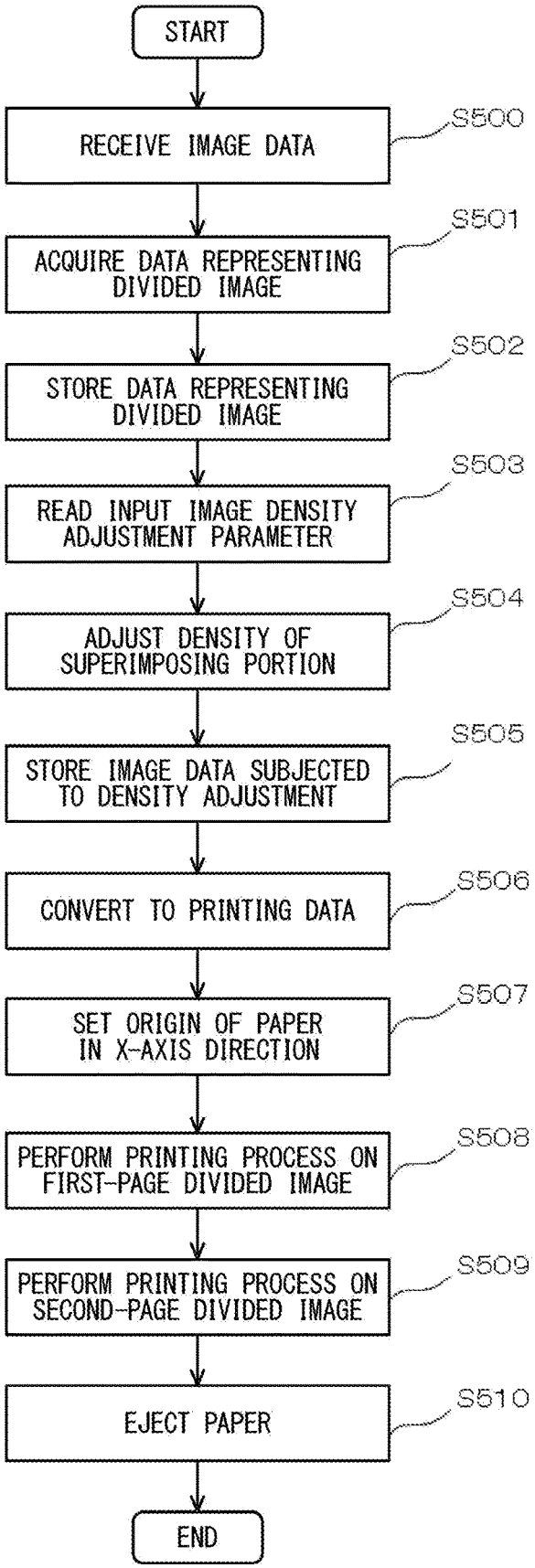
FIG. 29 is a flowchart of a panoramic image printing process in the thermal transfer printing apparatus according to the first embodiment.

FIG. 29 is a flowchart of the panoramic image printing process in the thermal transfer printing apparatus according to the first embodiment. Next, a description will be given of the details of the panoramic image printing process in the thermal transfer printer 100 according to the first embodiment. As a premise at the start of the flowchart of FIG. 29, it is assumed that the process selection receiving part 41 has already received a signal containing an instruction to perform the panoramic image printing process from the external information processing apparatus 200.

In step S500, the input image receiving part 42 receives a signal containing data representing an input image 80 from the external information processing apparatus 200. The input image 80 is an image to be printed by the panoramic image printing process in the thermal transfer printer 100.

Figure 30:
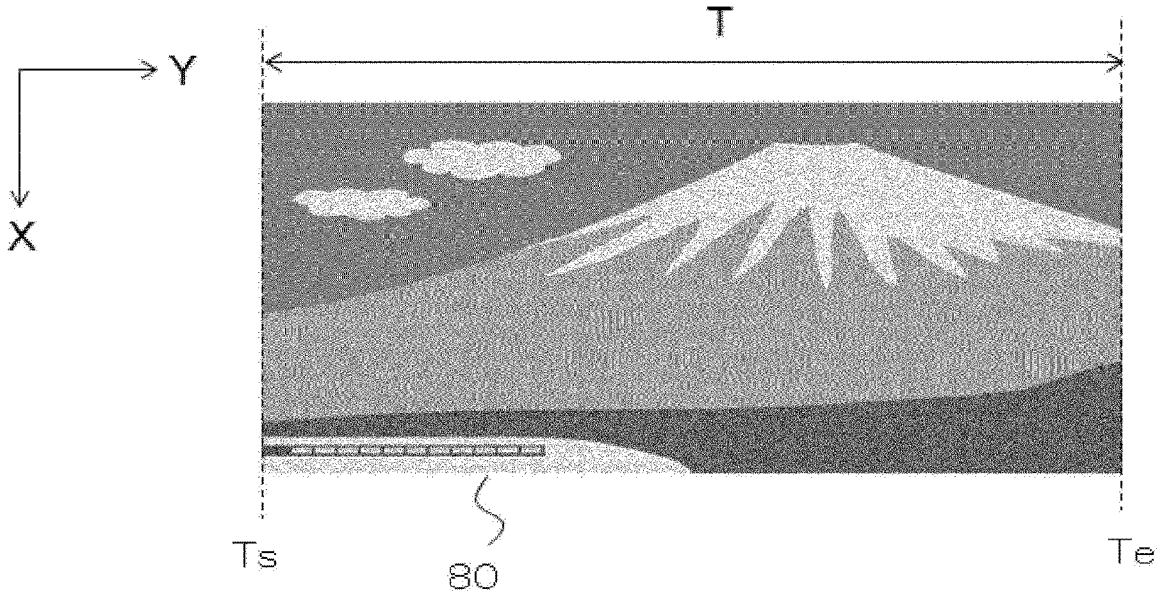
FIG. 30 is a diagram showing an input image in the thermal transfer printing apparatus according to the first embodiment.

FIG. 30 is a diagram showing the input image in the thermal transfer printing apparatus according to the first embodiment. T denotes a width of the input image 80 in the sub-scanning direction Y. T is greater than the width TA of the printing surface 60 in the sub-scanning direction Y. Further, Ts denotes a coordinate of a rear end of the input image 80 in the sub-scanning direction Y. Furthermore, Te denotes a coordinate of a front end of the input image 80 in the sub-scanning direction Y.

A description will be given of the details of the flowchart of the panoramic image printing process again with reference to FIG. 29. After step S500 is completed, the process proceeds to step S501. In step S501, the divided image data acquisition part 21 acquires data representing a first-page input image 80*a* and data representing a second-page input image 80*b* that result from dividing the data representing the input image 80 received in step S500.

Figure 31:
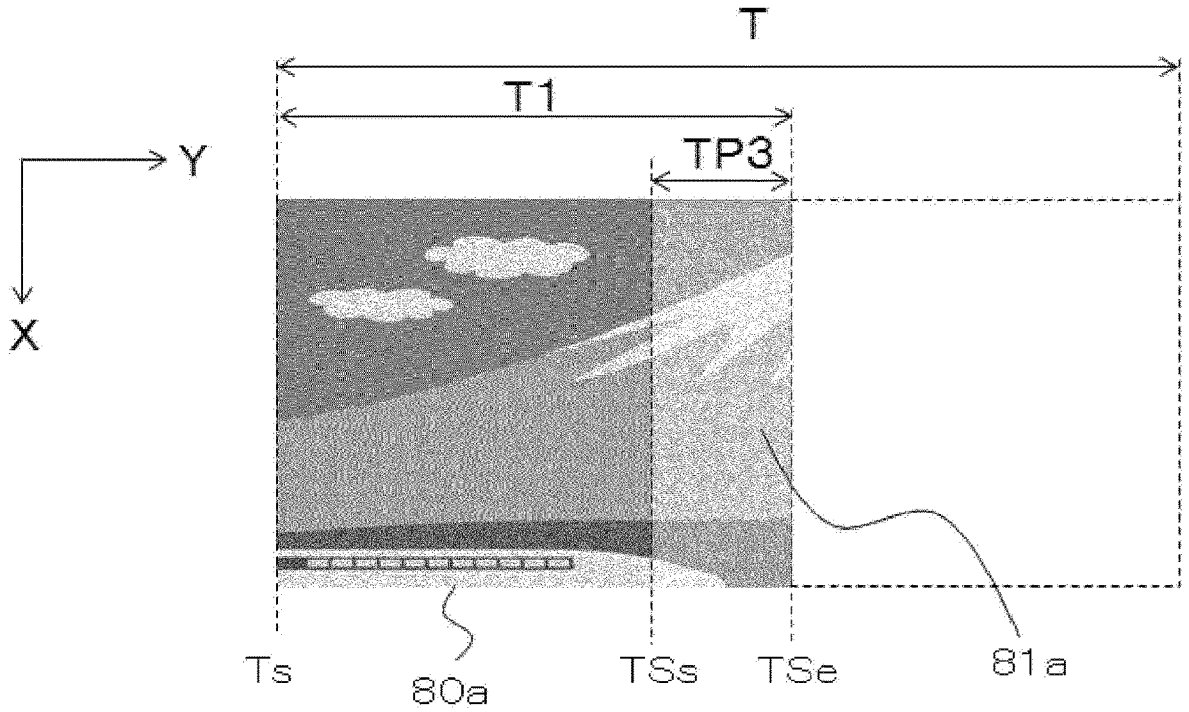
FIG. 31 is a diagram showing a first-page input image in the thermal transfer printing apparatus according to the first embodiment.

FIG. 31 is a diagram showing the first-page input image in the thermal transfer printing apparatus according to the first embodiment. The first-page input image 80*a* is an image extending from a coordinate Ts to a coordinate TSe in the sub-scanning direction Y of the input image 80. Further, the first-page input image 80*a* includes a first-page superimposing portion 81*a* that extends from a coordinate TSs to the front end of the first-page input image in the sub-scanning direction Y and is superimposed on the second-page input image 80*b*. T1 denotes a width of the first-page input image 80*a* in the sub-scanning direction Y. T1 is less than the width TA of the printing surface 60 in the sub-scanning direction Y. Further, a width of the first-page superimposing portion 81*a* in the sub-scanning direction Y is TP3 as in the calibration process.

Figure 32:
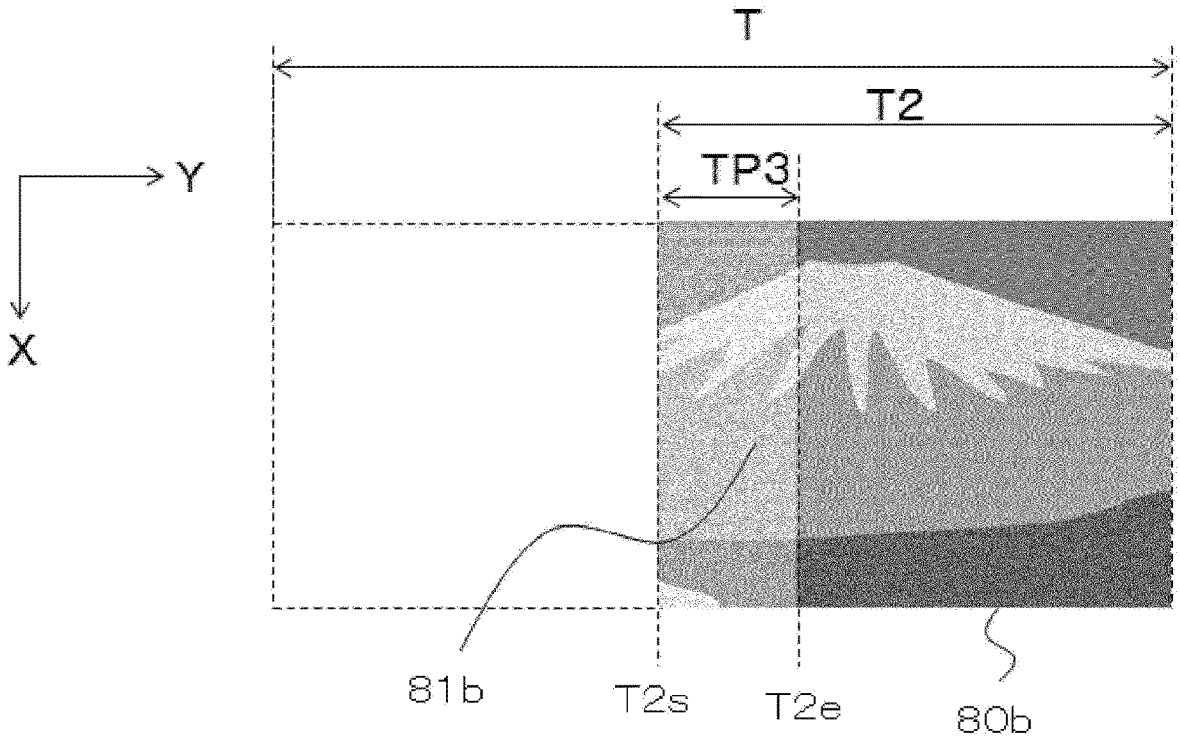
FIG. 32 is a diagram showing a second-page input image in the thermal transfer printing apparatus according to the first embodiment.

FIG. 32 is a diagram showing the second-page input image in the thermal transfer printing apparatus according to the first embodiment. The second-page input image 80*b* is an image extending from the coordinate TSs to a coordinate Te in the sub-scanning direction Y of the input image 80. The second-page input image 80*b* includes a second-page superimposing portion 81*b* that extends from the coordinate TSe to the rear end of the second-page input image 80*b* in the sub-scanning direction Y and is superimposed on the first-page input image 80*a*. T2 denotes a width of the second-page input image 80*b* in the sub-scanning direction Y. T2 is less than the width TA of each of the printing surface 60 in the sub-scanning direction Y. Further, a width of the second-page superimposing portion 81*b* in the sub-scanning direction Y is TP3 as in the calibration process.

After step S501 is completed, the process proceeds to step S502. In step S502, the data representing the first-page input image 80*a* and the data representing the second-page input image 80*b* are stored in the input image data storage part 34.

After step S502 is completed, the process proceeds to step S503. In step S503, the density adjustment processing part 22 reads the respective density adjustment parameters for Y color, M color, and C color stored in the density adjustment parameter storage part 32. Here, the respective density adjustment parameters for Y color, M color, and C color stored in the density adjustment parameter storage part 32 are the density adjustment parameters stored in step S119 of the calibration process.

For example, it is assumed that, in step S119 of the calibration process, Ypara3, Mpara3, and Cpara3 are stored in the density adjustment parameter storage part 32 as the density adjustment parameter for Y color, the density adjustment parameter for M color, and the density adjustment parameter for C color, respectively. In this case, the density adjustment parameters read by the density adjustment processing part 22 in step S503 are Ypara3 for Y color, Mpara3 for M color, and Cpara3 for C color.

After step S503 is completed, the process proceeds to step S504. In step S504, the density adjustment processing part 22 uses the density adjustment parameters read in step S503 to perform the density adjustment process on the first-page superimposing portion 81*a* of the first-page input image 80*a* and the second-page superimposing portion 81*b* of the second-page input image 80*b* for Y color, M color, and C color.

Pixels of the data representing the first-page input image 80*a* except the first-page superimposing portion 81*a*, that is, pixels in the range from Ts to TSs in the sub-scanning direction Y, are identical in gradation value to pixels in the same range of the input image 80. On the other hand, the first-page superimposing portion 81*a*, that is, pixels of data in the range from TSs to TSe in the sub-scanning direction Y are subjected to the density adjustment process and thus are lower in gradation value than pixels in the same range of the input image 80, which makes the density lower. Further, the gradation value of each pixel of the first-page superimposing portion 81*a* gradually decreases from the rear end toward the front end in the sub-scanning direction Y.

Pixels of the data representing the second-page input image 80*b* except the second-page superimposing portion 81*b*, that is, pixels in the range from TSe to Te in the sub-scanning direction Y, are identical in gradation value to pixels in the same range of the input image 80. On the other hand, the second-page superimposing portion 81*b*, that is, pixels in the range from TSs to TSe in the sub-scanning direction Y are subjected to the density adjustment process and thus are lower in gradation value than pixels in the same range of the input image 80, which makes the density lower. Further, the gradation value of each pixel of the second-page superimposing portion 81*b* gradually increases from the rear end toward the front end in the sub-scanning direction Y.

After step S504 is completed, the process proceeds to step S505. In step S505, the data representing the first-page input image 80*a* and the data representing the second-page input image 80*b* subjected to the density adjustment process in step S504 are stored in the processing data storage part 33.

After step S505 is completed, the process proceeds to step S506. In step S506, the data processing part 23 converts the data representing the first-page input image 80*a* and the data representing the second-page input image 80*b* subjected to the density adjustment process and stored in the processing data storage part 33 into respective pieces of printing data to be thermal-transferred by the thermal head 10. In step S506, the printing data converted from the data representing the first-page input image 80*a* is referred to as first-page printing data. The printing data converted from the data representing the second-page input image 80*b* is referred to as second-page printing data. Note that the first-page printing data and the second-page printing data each include Y data on Y color, M data on M color, and C data on C color.

After step S506 is completed, the process proceeds to step S507. In step S507, the printing control part 26 sets an optionally selected position on the recording paper 14 as an origin in the sub-scanning direction Y.

After step S507 is completed, the process proceeds to step S508. In step S508, the printing control part 26 controls the printing part 50 based on the first-page printing data converted in step S506 to print the first-page input image 80*a*. The printing process is performed in accordance with the flowchart of FIG. 27 described above. In the printing process in step S508, the position in each step is as follows. The printing start position in step S400, step S403, step S406, and step S409 is Ts. The ink use position in step S401 is the rear end Yya of the first Y-color printing surface 60Ya. The ink use position in step S404 is the rear end Yma of the first M-color printing surface 60Ma. The ink use position in step S407 is the rear end Yca of the first C-color printing surface 60Ca. The protective material use position in step S410 is the rear end Yopa of the first protective material surface 61*a*.

After step S508 is completed, the process proceeds to step S509. In step S509, the printing control part 26 controls the printing part 50 based on the second-page printing data converted in step S506 to print the second-page input image 80*b*. The printing process is performed in accordance with the flowchart of FIG. 27 described above. In the printing process in step S509, the position in each step is as follows. The printing start position in step S400, step S403, step S406, and step S409 is TSs. The ink use position in step S401 is the rear end Yyb of the second Y-color printing surface 60Yb. The ink use position in step S404 is the rear end Ymb of the second M-color printing surface 60Mb. The ink use position in step S407 is the rear end Ycb of the second C-color printing surface 60Cb. The protective material use position in step S410 is the rear end Yopb of the second protective material surface 61*b*.

After step S509 is completed, the process proceeds to step S510. In step S510, as in step S116, the printing control part 26 controls the paper feed drive part 51 and the recording paper cutting mechanism drive part 54 to eject the recording paper 14 on which the print has been made. The cutting position of the recording paper 14 is the rear end Te of the input image 80.

After step S510 is completed, the thermal transfer printer 100 brings the panoramic image printing process to an end.

Figure 33:
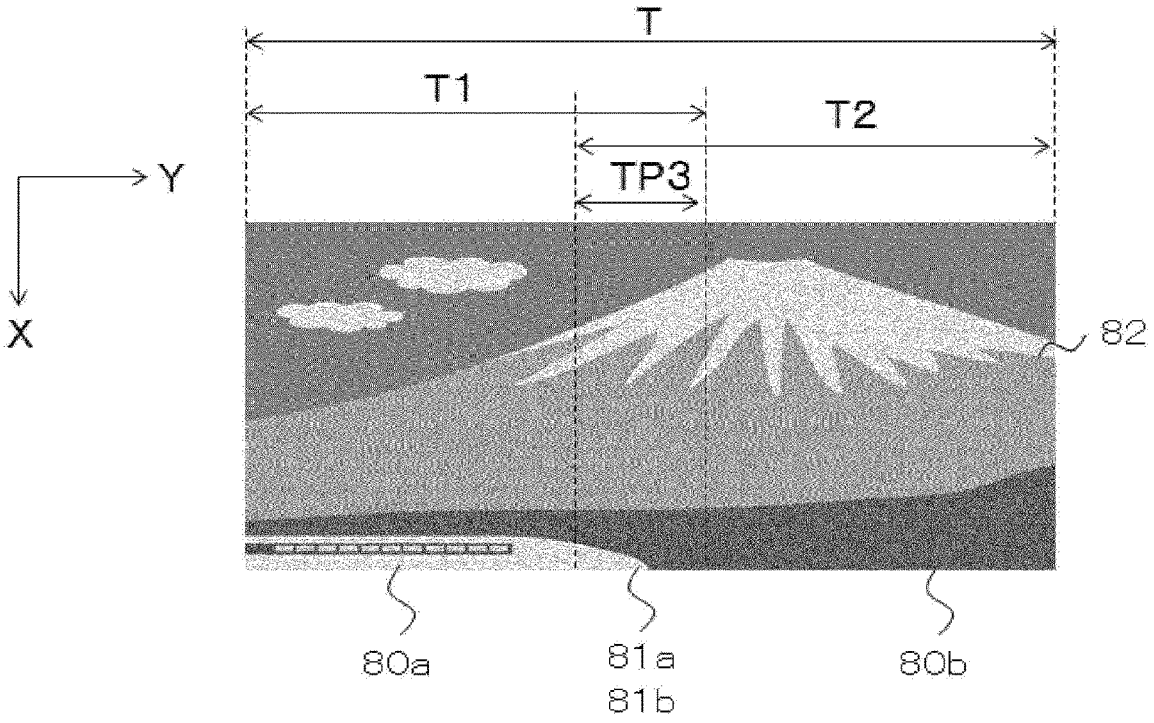
FIG. 33 is a diagram showing a panoramic printed image in the thermal transfer printing apparatus according to the first embodiment.

FIG. 33 is a diagram showing a panoramic printed image in the thermal transfer printing apparatus according to the first embodiment. Here, a description will be given of a panoramic printed image 82. The panoramic printed image 82 is an image printed on the recording paper ejected in step S510.

The panoramic printed image 82 is constituted by a combination of the first-page input image 80*a* subjected to the density adjustment process and printed in step S508 and the second-page input image 80*b* subjected to the density adjustment process and printed in step S509.

Further, the first-page superimposing portion 81*a* and the second-page superimposing portion 81*b* are superimposed on each other. The first-page superimposing portion 81*a* and the second-page superimposing portion 81*b* have been subjected to the density adjustment process using the density adjustment parameters set in the calibration process. For this reason, a portion of the panoramic printed image 82 where the first-page superimposing portion 81*a* and the second-page superimposing portion 81*b* are superimposed on each other is less noticeable as compared with a portion where the first-page superimposing portion 81*a* and the second-page superimposing portion 81*b* are not superimposed, and thus the panoramic printed image 82 is a single natural image that does not give a sense of discontinuity.

As described above, a thermal transfer printing apparatus according to the first embodiment is configured to acquire data on a color of a first image and data on a color of a second image, adjust a portion of the data on the color of the first image thus acquired and a portion of the data on the color of the second image thus acquired using a predetermined density adjustment parameter, and perform a panoramic image printing process of printing the first image and the second image using a plurality of printing surfaces arranged on an ink sheet to cause the portion of the first image thus adjusted and the portion of the second image thus adjusted to be superimposed on each other, and the thermal transfer printing apparatus includes a divided image data acquisition part configured to acquire data representing a first-page calibration image including data on a color density of a plurality of first-page calibration patterns and data representing a second-page calibration image including data on a color density of a plurality of second-page calibration patterns, a calibration-use density adjustment parameter storage part configured to store a plurality of the density adjustment parameters that are each associated with a corresponding one of the plurality of first-page calibration patterns and the plurality of second-page calibration patterns, a density adjustment processing part configured to adjust data on a color density of a first-page superimposing portion that is superimposed on a corresponding one of the plurality of second-page calibration patterns during printing of the data on the color density of the plurality of first-page calibration patterns using one of the density adjustment parameters associated with a corresponding one of the first-page calibration patterns and adjust data on a color density of a second-page superimposing portion that is superimposed on a corresponding one of the plurality of first-page calibration patterns during printing of the data on the color density of the plurality of second-page calibration patterns using one of the plurality of density adjustment parameters associated with a corresponding one of the second-page calibration patterns, and a printing part configured to print the first-page calibration image and the second-page calibration image on recording paper to form a plurality of printed calibration patterns that are each constituted by one of the first-page calibration patterns and one of the second-page calibration patterns and include a printed superimposing portion where the first-page superimposing portion and the second-page superimposing portion are superimposed on each other based on the data on the color densities adjusted by the density adjustment processing part. A color density of the printed superimposing portion printed on the recording paper varies for each of the printed calibration patterns. In particular, since the printed calibration patterns are different from each other in color density of the printed superimposing portion, it is possible to select a calibration pattern whose superimposing portion including disturbance factors is less noticeable, and thus it is possible to provide the thermal transfer printing apparatus that makes the superimposing portion less noticeable even under the influence of the disturbance factors.

Furthermore, in addition to the configuration of the thermal transfer printing apparatus according to the first embodiment, another configuration may be added in which a calibration pattern selection receiving part configured to receive a signal including data on a printed calibration pattern selected from among the plurality of printed calibration patterns that have been printed is provided, and the density adjustment parameters associated with the first-page calibration pattern and the second-page calibration pattern constituting the printed calibration pattern thus selected are used in the panoramic image printing process. This configuration allows the user to select a density parameter that makes the superimposing portion less noticeable even under the influence of disturbance factors.

Furthermore, in addition to the configuration of the thermal transfer printing apparatus according to the first embodiment, another configuration may be added in which the data on the color density of each of the first-page calibration patterns and the data on the color density of each of the second-page calibration patterns each represent a gradation value of a pixel to which line numbers are assigned in the primary scanning direction X and the sub-scanning direction Y, the plurality of density adjustment parameters each represent a predetermined density adjustment factor associated with the line number of the pixel in the sub-scanning direction, and the density adjustment processing part adjusts the gradation value of the pixel associated with the density adjustment factor based on the density adjustment factor.

Further, a method for calibrating a thermal transfer printing apparatus according to the first embodiment includes adjusting data on a color density of a second-page superimposing portion that is superimposed on a corresponding one of the plurality of first-page calibration patterns during printing of data on the color density of the plurality of second-page calibration patterns thus acquired using a density adjustment parameter associated with a corresponding one of the plurality of second-page calibration patterns, printing the first-page calibration image and the second-page calibration image on recording paper to form a plurality of printed calibration patterns that are each constituted by one of the first-page calibration patterns and one of the second-page calibration patterns and include a printed superimposing portion where the first-page superimposing portion and the second-page superimposing portion are superimposed on each other based on the data on color densities thus adjusted and to make a color density of the printed superimposing portion different for each of the printed calibration patterns, and receiving a signal including data on the printed calibration pattern selected from among the plurality of printed calibration patterns printed on the recording paper, and storing, in a density adjustment parameter storage part, the density adjustment parameters that are each associated with a corresponding one of the first-page calibration patterns and the second-page calibration patterns constituting the printed calibration pattern thus selected. These configurations make it possible to select a density adjustment parameter that makes the superimposing portion including disturbance factors less noticeable, and thus make it possible to perform calibration to make the superimposing portion less noticeable even under the influence of the disturbance factors.

Further, a printing method of a thermal transfer printing apparatus according to the first embodiment includes acquiring data on a color of a first image and a color of a second image, adjusting a portion of the data on the color of the first image thus acquired and a portion of the data on the color of the second image thus acquired using the density adjustment parameters stored in the density adjustment parameter storage part in the method for calibrating a thermal transfer printing apparatus according to the first embodiment, and printing the first image and the second image using a plurality of printing surfaces arranged on an ink sheet to cause the portion of the first image thus adjusted and the portion of the second image thus adjusted to be superimposed on each other. This configuration makes it possible to obtain a panoramic image whose superimposing portion is less noticeable even under the influence of the disturbance factors.

Further, for the thermal transfer printing apparatus 1000 according to the first embodiment, three calibration patterns for each color and three density adjustment parameters for each color are provided. However, the present invention is not limited to this configuration, and it is only necessary that a plurality of calibration patterns and a plurality of density adjustment parameters be provided.

Further, in the thermal transfer printing apparatus 1000 according to the first embodiment, the calibration patterns for each color are arranged in the primary scanning direction X. However, the present invention is not limited to this configuration, and the calibration patterns may be arranged in the sub-scanning direction Y.

Figure 34:
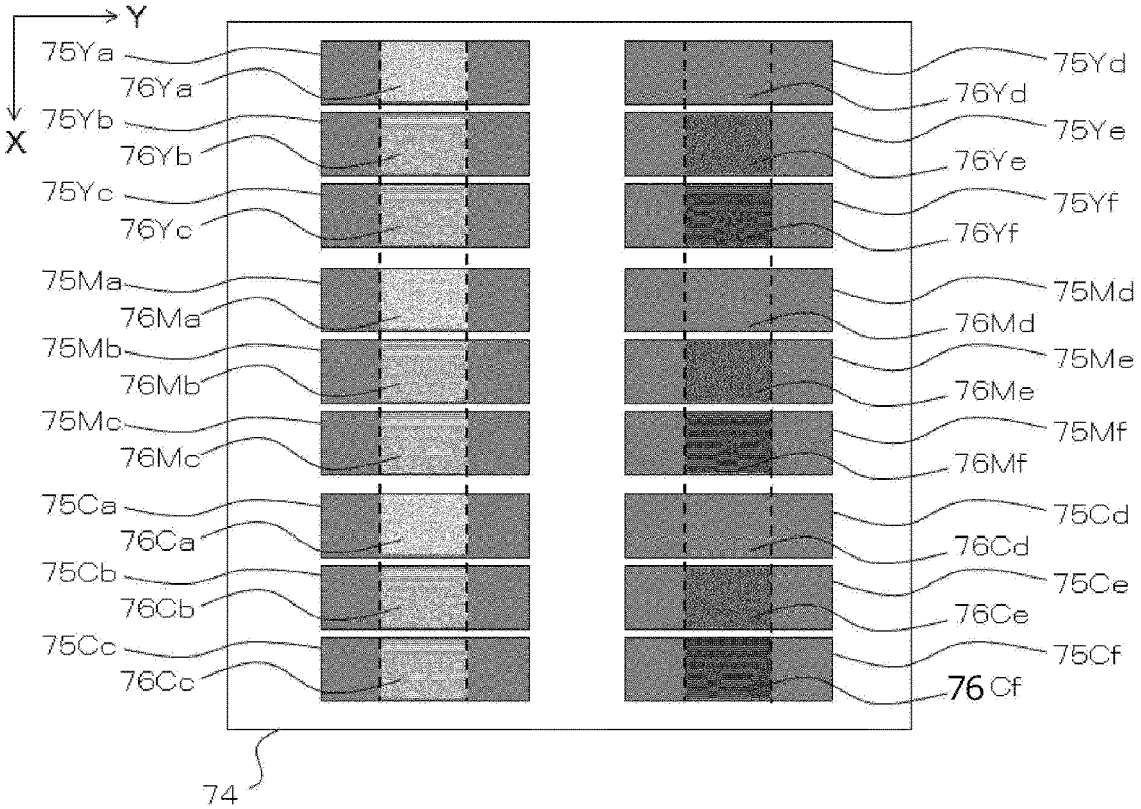
FIG. 34 is a diagram showing a printed calibration image in a thermal transfer printing apparatus according to a first modification of the first embodiment.

FIG. 34 is a diagram showing a printed calibration image in a thermal transfer printing apparatus according to a first modification of the first embodiment. The present invention may be, for example, the first modification of the first embodiment. A printed calibration image 74 of the first modification of the first embodiment includes a first Y-color printed calibration pattern 75Ya, a second Y-color printed calibration pattern 75Yb, a third Y-color printed calibration pattern 75Yc, a fourth Y-color printed calibration pattern 75Yd, a fifth Y-color printed calibration pattern 75Ye, and a sixth Y-color printed calibration pattern 75Yf. The printed calibration image 74 of the first modification of the first embodiment further includes first to sixth M-color printed calibration patterns 75Ma to f and first to sixth C-color printed calibration patterns 75Ca to f.

Further, the first to third Y-color printed calibration patterns 75Ya to c are arranged in the primary scanning direction X, and each of the fourth to sixth Y-color printed calibration patterns 75Yd to f is disposed side by side with, in the sub-scanning direction Y, a corresponding one of the first to third Y-color printed calibration patterns 75Ya to c.

In the calibration-use density adjustment parameter storage part 36 of the first modification of the first embodiment, six density adjustment parameters for Y color Ypara1, Ypara2, Ypara3, Ypara4, Ypara5, and Ypara6 are stored. The respective density adjustment factors of the density adjustment parameters for Y color are predetermined so as to satisfy a relation of the density adjustment factor of the density adjustment parameter Ypara1<the density adjustment factor of the density adjustment parameter Ypara2<the density adjustment factor of the density adjustment parameter Ypara3<the density adjustment factor of the density adjustment parameter Ypara4<the density adjustment factor of the density adjustment parameter Ypara5<the density adjustment factor of the density adjustment parameter Ypara6 for the same line number in the sub-scanning direction Y. Similarly, in the calibration-use density adjustment parameter storage part 36 of the first modification of the first embodiment, six density adjustment parameters for M color Mpara1 to Mpara6 and six density adjustment parameters for C color Cpara1 to Cpara6 are stored, and the respective density adjustment factors of the density adjustment parameters for each color are predetermined so as to satisfy a relation of Mpara1<Mpara2<Mpara3<Mpara4<Mpara5<Mpara6 and a relation of Cpara1<Cpara2<Cpara3<Cpara4<Cpara5<Cpara6.

Further, the density adjustment parameter Ypara1 is associated with the first Y-color calibration pattern, and the superimposed portion of the first Y-color calibration pattern is subjected to the density adjustment process using the density adjustment parameter Ypara1. Furthermore, the density adjustment parameters Ypara2, Ypara3, Ypara4, Ypara5, Ypara6 are respectively associated with the second Y-color calibration pattern, the third Y-color calibration pattern, the fourth Y-color (printed) calibration pattern, the fifth Y-color (printed) calibration pattern, and the sixth Y-color (printed) calibration pattern, and the superimposing portion of each of the Y-color calibration patterns is subjected to the density adjustment process using the density adjustment parameter associated with the Y-color calibration pattern. Similarly, the density adjustment parameters Mpara1 to Mpara6 and the density adjustment parameters Cpara1 to Cpara6 are respectively associated with the first to sixth M-color printed calibration patterns 75Ma to f and the first to sixth C-color printed calibration patterns 75Ca to f, and the superimposed portion of each of the calibration patterns is subjected to the density adjustment process using the density adjustment parameter associated with the calibration pattern.

Therefore, the density of the printed superimposing portion 76 of the printed calibration image 74 of the first modification of the first embodiment satisfies a relation of (the density of) the first Y-color printed superimposing portion 76Ya<the second Y-color printed superimposing portion 76Yb<the third Y-color printed superimposing portion 76Yc<(the density of) the fourth Y-color printed superimposing portion 76Yd<the fifth Y-color printed superimposing portion 76Ye<the sixth Y-color printed superimposing portion 76Yf. Similarly, the density of the printed superimposing portion 76 of the printed calibration image 74 of the first modification of the first embodiment satisfies a relation of (the density of) the first M-color printed superimposing portion 76Ma<the second M-color printed superimposing portion 76Mb<the third M-color printed superimposing portion 76Mc<(the density of) the fourth M-color printed superimposing portion 76Md<the fifth M-color printed superimposing portion 76Me<the sixth M-color printed superimposing portion 76Mf, and a relation of (the density of) the first C-color printed superimposing portion 76Ca<the second C-color printed superimposing portion 76Cb<the third C-color printed superimposing portion 76Cc<(the density of) the fourth C-color printed superimposing portion 76Cd<the fifth C-color printed superimposing portion 76Ce<the sixth C-color printed superimposing portion 76Cf.

Further, in the thermal transfer printing apparatus 1000 according to the first embodiment, the thermal transfer printer 100 inputs and outputs information on image data from and to the external information processing apparatus 200, but the present invention is not limited to this configuration. The thermal transfer printer may acquire information on image data without using the external information processing apparatus. For example, the thermal transfer printer may be provided with an existing image data capturing part such as a scanner and acquire image data through the image data capturing part.

Further, in the thermal transfer printing apparatus 1000 according to the first embodiment, the thermal transfer printer 100 acquires information on the printed calibration pattern 75 selected by the user from the external information processing apparatus 200, but the present invention is not limited to this configuration. The thermal transfer printer may acquire information on the printed calibration pattern selected by the user without using the external information processing apparatus. For example, the thermal transfer printer may be provided with an existing operation input part such as a touch panel to allow the user to directly select and input the printed calibration pattern through the operation input part. Note that the operation input part in this configuration corresponds to the calibration pattern selection receiving part of the present invention.

Further, the thermal transfer printing apparatus 1000 according to the first embodiment includes all the divided image data acquisition part 21, the density adjustment processing part 22, the data processing part 23, the calibration image data acquisition part 24, the determination part 25, the density adjustment parameter storage part 32, the input image data storage part 34, the calibration image data storage part 35, the calibration-use density adjustment parameter storage part 36, and the calibration pattern correspondence storage part 37, but the present invention is not limited to this configuration. For example, the external information processing apparatus 200 may include all or some of the divided image data acquisition part 21, the density adjustment processing part 22, the data processing part 23, the calibration image data acquisition part 24, the determination part 25, the density adjustment parameter storage part 32, the input image data storage part 34, the calibration image data storage part 35, the calibration-use density adjustment parameter storage part 36, and the calibration pattern correspondence storage part 37.

Further, in the thermal transfer printing apparatus 1000 according to the first embodiment, the calibration image 70 includes the plurality of Y-color calibration patterns 71Y, the plurality of M-color calibration patterns 71M, and the plurality of C-color calibration patterns 71C, and the printed calibration image 74 includes the plurality of Y-color printed calibration patterns 75Y, the plurality of M-color printed calibration patterns 75M, and the plurality of C-color printed calibration patterns 75C, but the present invention is not limited to this configuration. For example, the calibration image 70 may include any one of pluralities of Y-color, M-color, and C-color calibration patterns 71, and the user may select a printed calibration pattern 75 from among any one of pluralities of Y-color, M-color, and C-color printed calibration patterns 75 printed on the printed calibration image 74.

Further, in the thermal transfer printing apparatus 1000 according to the first embodiment, the density adjustment factor of the density adjustment parameter is predetermined so as to gradually decrease from the rear end toward the front end in the sub-scanning direction Y for the first-page calibration image 70*a* and gradually increase from the rear end toward the front end in the sub-scanning direction Y for the second-page calibration image 70*b*, but the present invention is not limited to this configuration. For example, the density adjustment factor of the density adjustment parameter may be a predetermined factor that is less than 1 and constant over a range from the line numbers #N+1 to #N+TP3−1 in the sub-scanning direction.

Further, in the thermal transfer printing apparatus 1000 according to the first embodiment, the gradation value of each color of the calibration pattern 71 stored in the calibration image data storage part 44 is acquired, and the calibration image 70 including the calibration pattern 71 is acquired, but the present invention is not limited to this configuration. For example, with the data representing the calibration image 70 stored in the calibration image data storage part 44, the calibration image data acquisition part 24 may acquire the data representing the calibration image 70. Furthermore, with the data representing the first-page calibration image 70*a* and the data representing the second-page calibration image 70*b* stored in the calibration image data storage part 44, the divided image data acquisition part 21 may acquire the data representing the first-page calibration image 70*a* and the data representing the second-page calibration image 70*b* from the calibration image data storage part 44. This configuration eliminates the need for the calibration image data acquisition part 24 in the thermal transfer printing apparatus 1000.

Further, in the thermal transfer printing apparatus 1000 according to the first embodiment, the printed calibration pattern 75 includes the non-superimposing portion 73, but the present invention is not limited to this configuration. For example, all of the first-page calibration pattern 71*a* and the second-page calibration pattern 71*b* may serve as the superimposing portion 72, and all the printed calibration pattern 75 may serve as the printed superimposing portion 76.

However, when all the printed calibration pattern 75 serves as the printed superimposing portion 76, the user can determine whether the printed superimposing portion 76 has streaks, but the user cannot determine unevenness between a non-superimposing portion and a superimposing portion. Therefore, to the thermal transfer printing apparatus according to the first embodiment, another configuration may be added in which the printed calibration pattern includes a non-superimposing portion where the first-page calibration pattern and the second-page calibration pattern are not superimposed on each other. This added configuration makes it possible to select a density adjustment parameter that can suppress unevenness due to the disturbance factors, and thus makes it possible to provide a thermal transfer printer and a printing method of the thermal transfer printer that make the superimposing portion less noticeable.

The gradation value of each color of the first-page calibration pattern 71*a* may be greater than or less than the center gradation value.

Further, in the thermal transfer printing apparatus 1000 according to the first embodiment, the gradation value of each color of the calibration pattern 71 is predetermined to be the center gradation value 128, but the present invention is not limited to this configuration. The gradation value of each color of the calibration pattern 71 may be greater than or less than the center gradation value.

However, streaks or unevenness due to the disturbance factors are likely to occur when the gradation value is less than the center gradation value. Therefore, to the configuration of the thermal transfer printing apparatus, the configuration of the thermal transfer printing, and the configuration of the thermal transfer method according to the first embodiment, another configuration may be added in which the gradation value of the calibration pattern is less than a center value of the range of the gradation value. This added configuration makes it possible to select a density adjustment parameter that can further suppress streaks or unevenness due to the disturbance factors as compared with the configuration in which the gradation value of the calibration pattern is greater than the center value of the range of the gradation value, and thus makes it possible to provide a thermal transfer printer and a printing method of the thermal transfer printer that make the superimposing portion less noticeable.

Further, in preparation for a case where the calibration process has never been performed before the panoramic image printing process, respective density adjustment parameters for Y color, M color, and C color that are predetermined as initial values may be stored in the density adjustment parameter storage part 32.

Second Embodiment

Figure 35:
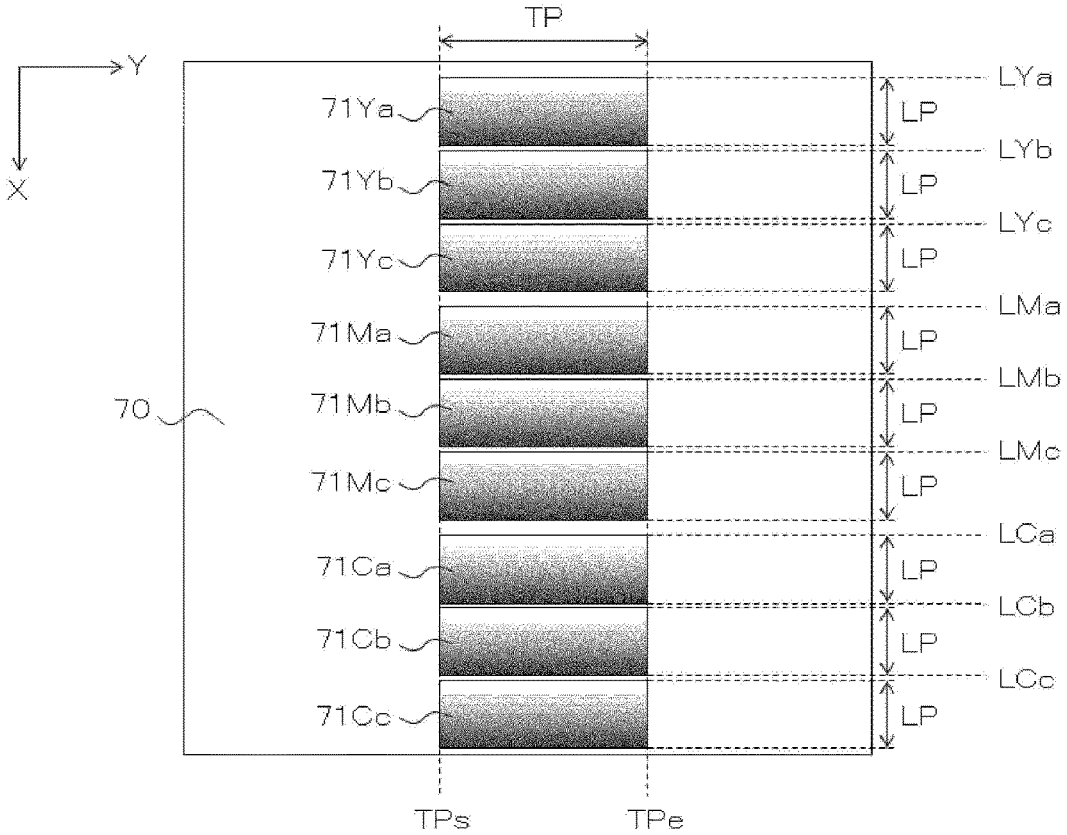
FIG. 35 is a diagram showing a calibration image immediately after step S100 is completed in a thermal transfer printing apparatus according to a second embodiment.

FIG. 35 is a diagram showing a calibration image immediately after step S100 is completed in a thermal transfer printing apparatus according to a second embodiment. FIG. 36 is a table showing a Y-color gradation value of each pixel of data representing the calibration image immediately after step S100 is completed in the thermal transfer printing apparatus according to the second embodiment. Next, a description will be given of a thermal transfer printing apparatus 1000 of the second embodiment.

The thermal transfer printing apparatus 1000 of the second embodiment is different from the thermal transfer printing apparatus 1000 of the first embodiment in the calibration pattern 71 of the calibration image 70 acquired in step S100 of the calibration process. Note that the thermal transfer printing apparatus 1000 of the second embodiment is identical in the other configurations to the thermal transfer printing apparatus 1000 of the first embodiment, and thus no description will be given of the other configurations.

The density of each calibration pattern 71 of the first embodiment is uniform, whereas, the density of each calibration pattern 71 of the second embodiment varies for each coordinate in the primary scanning direction X.

More specifically, in the second embodiment, the Y-color density of the first Y-color calibration pattern 71Ya, the Y-color density of the second Y-color calibration pattern 71Yb, and the Y-color density of the third Y-color calibration pattern 71Yc gradually increase from the upper end that is one end in the primary scanning direction X of each calibration pattern 71 toward the lower end that is the other end. Similarly, the M-color densities of the first to third M-color calibration patterns 71Ma, Mb, Mc and the C-color densities of the first to third C-color calibration patterns 71Ca, Cb, Cc gradually increase from the upper end toward the lower end in the primary scanning direction X of each calibration pattern 71.

In the data representing the calibration image 70 of the second embodiment, the gradation value of each pixel of each calibration pattern 71 varies for each line number in the primary scanning direction X. More specifically, the gradation value of each pixel of each calibration pattern 71 gradually increases from the line number of the upper end that is one end in the primary scanning direction X toward the line number of the lower end that is the other end. For example, as shown in FIG. 36, the Y-color gradation value of each pixel of #Lya that is the line number of the upper end in the primary scanning direction X of the first Y-color calibration pattern 71Ya is 16. Further, the Y-color gradation value of each pixel of #Lya+LP that is the line number of the lower end in the primary scanning direction X of the first Y-color calibration pattern 71Ya is 128.

In the thermal transfer printing apparatus of the second embodiment, in addition to the configuration of the thermal transfer printing apparatus according to the first embodiment, the printing part is further configured to make a print to cause the color density of the printed calibration pattern in the primary scanning direction X to gradually increase from one end toward the other end in the primary scanning direction X. This configuration makes it possible to check streaks or unevenness in the superimposing portion for a plurality of gradation values through one calibration process and thus makes it possible to provide a thermal transfer printing apparatus that makes the superimposing portion less noticeable even under the influence of disturbance factors.

Further, in addition to the configuration of the thermal transfer printing apparatus of the second embodiment, another configuration may be employed where data on the color density of the first-page calibration pattern and data on the color density of the second-page calibration pattern acquired by the divided image data acquisition part are set to cause their respective densities to gradually increase from the one end toward the other end in the primary scanning direction X.

The additional configurations described in the second embodiment may be combined with each additional configuration of the first embodiment.

Third Embodiment

FIG. 37 is a schematic diagram of an ink sheet loaded in a thermal transfer printer according to a third embodiment.

Next, a description will be given of a thermal transfer printing apparatus 1000 of the third embodiment.

The thermal transfer printing apparatus 1000 of the third embodiment is different from the thermal transfer printing apparatus 1000 of the first embodiment in the ink sheet 13 and the printing process in the calibration process. Note that the thermal transfer printing apparatus 1000 of the third embodiment is identical in the other configurations to the thermal transfer printing apparatus 1000 of the first embodiment, and thus no description will be given of the other configurations.

In the ink sheet 13 loaded in the thermal transfer printer 100 of the third embodiment, the width TA of the printing surface 60 in the sub-scanning direction Y is greater than the sum of the length TP1 of the first-page calibration pattern 71*a* in the sub-scanning direction Y and the length TP2 of the second-page calibration pattern 71*b* in the sub-scanning direction Y. Further, the coordinate at the rear end of the Y-color printing surface 60Y in the sub-scanning direction Y is denoted as Yy1. Similarly, the coordinates at the rear ends of the M-color printing surface 60M, the C-color printing surface 60C, and the protective material surface 61 in the sub-scanning direction Y are denoted as Ym1, Yc1, and Yop1, respectively.

Further, the Y-color printing surface 60Y has an optionally selected coordinate Yy2 between the rear end and the front end in the sub-scanning direction Y. A width TB from the rear end to the coordinate Yy2 of the Y-color printing surface 60Y is greater than the length TP1 of the first-page calibration pattern 71*a* in the sub-scanning direction Y. Further, a width TC from the coordinate Yy2 to the rear end of the Y-color printing surface 60Y is greater than the length TP2 of the second-page calibration pattern 71*b* in the sub-scanning direction Y.

Similarly, the M-color printing surface 60M, the C-color printing surface 60C, and the protective material surface 61 have optionally selected coordinates Ym2, Yc2, and Yop2 between the rear end and the front end in the sub-scanning direction Y, respectively.

A width from the rear end to the coordinate Ym2 of the M-color printing surface 60M, a width from the rear end to the coordinate Yc2 of the C-color printing surface 60C, and a width from the rear end to the coordinate Yop2 of the protective material surface 61 are also TB that is greater than the length TP1 of the first-page calibration pattern 71*a* in the sub-scanning direction Y. Further, a width from the coordinate Ym2 to the front end of the M-color printing surface 60M, a width from the coordinate Yc2 to the front end of the C-color printing surface 60C, and a width from the coordinate Yop2 to the front rear end of the protective material surface 61 are also TC that is greater than the length TP2 of the second-page calibration pattern 71*b* in the sub-scanning direction Y.

Next, a description will be given of the printing process in the calibration process of the third embodiment with reference to the flowchart of the printing process of FIG. 27. Note that the positioning of the recording paper in step S400, step S403, step S406, and step S409 is the same as in the first embodiment, and thus no description will be given of the positioning.

In step S401, the printing control part 26 controls the ink sheet feed drive part 52 to position the Y-color printing surface 60Y of the ink sheet 13. The ink use position varies in each step, and the ink use position in step S114 is the rear end Yy1 of the Y-color printing surface 60Y. Further, the ink use position in step S115 is the coordinate Yy2.

In step S402, the printing control part 26 controls the paper feed drive part 51, the ink sheet feed drive part 52, and the thermal head drive part 53 to make a print on the recording paper 14 based on the Y-color data of the N-page printing data. Here, N is a natural number that varies in each step, and is "first" in step S114 and "second" in step S115. That is, the printing part 50 prints the first-page calibration pattern 71*a* using a section from the rear end to the coordinate Yy2 that is a portion of the Y-color printing surface 60Y, and the second-page calibration pattern 71*b* using a section from the coordinate Yy2 to the front end that is the other portion of the Y-color printing surface 60Y.

In step S404, the printing control part 26 controls the ink sheet feed drive part 52 to position the M-color printing surface 60M of the ink sheet 13. The ink use position varies in each step, and the ink use position in step S114 is the rear end Ym1 of the M-color printing surface 60M. Further, the ink use position in step S115 is the coordinate Ym2.

In step S405, the printing control part 26 controls the paper feed drive part 51, the ink sheet feed drive part 52, and the thermal head drive part 53 to make a print on the recording paper 14 based on the M-color data of the N-page printing data. As in step S402, N is a natural number that varies in each step, and is first in step S114 and second in step S115. That is, the printing part 50 prints the first-page calibration pattern 71*a* using a section from the rear end to the coordinate Ym2 that is a portion of the M-color printing surface 60M, and the second-page calibration pattern 71*b* using a section from the coordinate Ym2 to the front end that is the other portion of the M-color printing surface 60M.

In step S407, the printing control part 26 controls the ink sheet feed drive part 52 to position the C-color printing surface 60C of the ink sheet 13. The ink use position varies in each step, and the ink use position in step S114 is the rear end Yc1 of the C-color printing surface 60C. Further, the ink use position in step S115 is the coordinate Yc2.

In step S408, the printing control part 26 controls the paper feed drive part 51, the ink sheet feed drive part 52, and the thermal head drive part 53 to make a print on the recording paper 14 based on the C-color data of the N-page printing data. As in step S402, N is a natural number that varies in each step, and is first in step S114 and second in step S115. That is, the printing part 50 prints the first-page calibration pattern 71*a* using a section from the rear end to the coordinate Yc2 that is a portion of the C-color printing surface 60C, and the second-page calibration pattern 71*b* using a section from the coordinate Yc2 to the front end that is the other portion of the C-color printing surface 60C.

In step S410, the printing control part 26 controls the ink sheet feed drive part 52 to position the protective material surface 61 of the ink sheet 13. The protective material use position varies in each step, and the protective material use position in step S114 is the rear end Yopa of the protective material surface 61. Further, the protective material use position in step S115 is the coordinate Yop2.

After step S410 is completed, the process proceeds to step S411. In step S411, the printing control part 26 controls the paper feed drive part 51, the ink sheet feed drive part 52, and the thermal head drive part 53 to thermal-transfer a protective layer to the recording paper 14. As in step S402, N is a natural number that varies in each step, and is first in step S114 and second in step S115. That is, the printing part 50 applies the protective material using a section from the rear end to the coordinate Yop2 that is a portion of the protective material surface 61 and a section from the coordinate Yop2 to the front end that is the other portion of the protective material surface 61.

In the thermal transfer printing apparatus of the third embodiment, in addition to the configuration of the thermal transfer printing apparatus of the first embodiment, the printing part is further configured to print the first-page calibration image using a portion of the printing surface and then print the second-page calibration image using the other portion of the printing surface used in printing of the first-page calibration image. This configuration allows the calibration process to be performed using one printing surface for each color, and thus the ink sheet used in the calibration process can be saved.

Further, the thermal transfer printing apparatus 1000 according to the third embodiment uses the same printing surface 60 twice for each color in the calibration process, but the present invention is not limited to this configuration, and the printing surface 60 for each color may be used three or more times.

Figure 38:
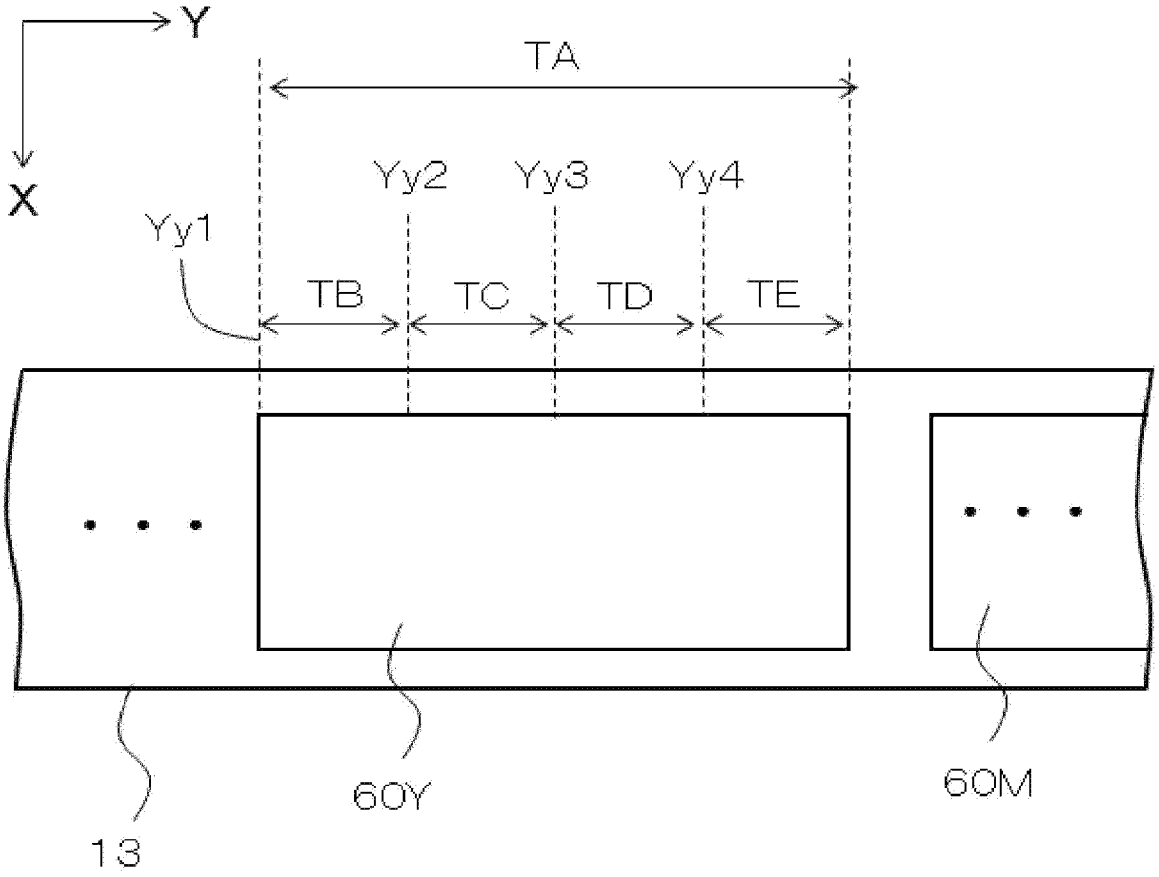
FIG. 38 is a schematic diagram of a Y-color printing surface of an ink sheet to be loaded into a thermal transfer printer according to a modification of the third embodiment.

FIG. 38 is a schematic diagram of a Y-color printing surface of an ink sheet to be loaded into a thermal transfer printer according to a modification of the third embodiment. In the ink sheet 13 loaded in the thermal transfer printer 100 of the modification of the third embodiment, the width TA of the printing surface 60 in the sub-scanning direction Y is greater than twice the sum of the length TP1 of the first-page calibration pattern 71*a* in the sub-scanning direction Y and the length TP2 of the second-page calibration pattern 71*b* in the sub-scanning direction Y. That is, a relation of TA>TP1+TP1+TP2+TP2 is satisfied.

Further, the Y-color printing surface 60Y has optionally selected coordinates Yy2, Yy3, Yy4 between the rear end and the front end in the sub-scanning direction Y. A width TB from the rear end to the coordinate Yy2 of the Y-color printing surface 60Y is greater than the length TP1 of the first-page calibration pattern 71*a* in the sub-scanning direction Y. Further, a width TC from the coordinate Yy2 to the coordinate Yy3 is greater than the length TP2 of the second-page calibration pattern 71*b* in the sub-scanning direction Y. Furthermore, a width TD from the coordinate Yy3 to the coordinate Yy4 is greater than TP1, and a width TE from the coordinate Yy4 to the front end of the Y-color printing surface 60Y is greater than TP2.

In a calibration image according to the modification of the third embodiment, calibration patterns are arranged as in the first modification of the first embodiment shown in FIG. 34. Here, in the calibration process according to the modification of the third embodiment, four printing processes are performed, including a step of performing a printing process of printing a portion corresponding to the first to third first-page calibration patterns, a step of performing a printing process of printing a portion corresponding to the first to third second-page calibration patterns, a step of performing a printing process of printing a portion corresponding to the fourth to sixth first-page calibration patterns, and a step of performing a printing process of printing a portion corresponding to the fourth to sixth second-page calibration patterns.

In the step of performing the printing process of printing the portion corresponding to the first to third first-page calibration patterns, with the ink sheet use position set to the rear end Yy1 of the Y-color printing surface 60Y, the print can be made using a section from the rear end to the coordinate Yy2 of the Y-color printing surface 60Y.

Further, in the step of performing the printing process of printing the portion corresponding to the first to third second-page calibration patterns, with the ink sheet use position set to the coordinate Yy2, the print can be made using a section from the coordinate Yy2 to the coordinate Yy3 of the Y-color printing surface 60Y.

In the step of performing the printing process of printing the portion corresponding to the fourth to sixth first-page calibration patterns, with the ink sheet use position set to the coordinate Yy3, the print can be made using a section from the coordinate Yy3 to the coordinate Yy4 of the Y-color printing surface 60Y.

Further, in the step of performing the printing process of printing the portion corresponding to the fourth to sixth second-page calibration patterns, with the ink sheet use position set to the coordinate Yy4, the print can be made using a section from the coordinate Yy4 to the front end of the Y-color printing surface 60Y.

The invention claimed is:

1. A thermal transfer printing apparatus configured to acquire data on a color of a first image and data on a color of a second image, adjust a portion of the data on the color of the first image thus acquired and a portion of the data on the color of the second image thus acquired using a predetermined density adjustment parameter, and perform a panoramic image printing process of printing the first image and the second image using a plurality of printing surfaces arranged on an ink sheet to cause the portion of the first image thus adjusted and the portion of the second image thus adjusted to be superimposed on each other, the thermal transfer printing apparatus comprising:

a divided image data receiver to acquire data representing a first-page calibration image including data on a color density of a plurality of first-page calibration patterns and data representing a second-page calibration image including data on a color density of a plurality of second-page calibration patterns;

a calibration-use density adjustment parameter storage to store a plurality of the density adjustment parameters that are each associated with a corresponding one of the plurality of first-page calibration patterns and the plurality of second-page calibration patterns;

processing circuitry to execute a density adjustment processing to adjust data on a color density of a first-page superimposing portion that is superimposed on a corresponding one of the plurality of second-page calibration patterns during printing of the data on the color density of the plurality of first-page calibration patterns using one of the density adjustment parameters associated with a corresponding one of the first-page calibration patterns and adjust data on a color density of a second-page superimposing portion that is superimposed on a corresponding one of the plurality of first-page calibration patterns during printing of the data on the color density of the plurality of second-page calibration patterns using one of the plurality of density adjustment parameters associated with a corresponding one of the second-page calibration patterns; and a printer to print the first-page calibration image and the second-page calibration image on recording paper to form a plurality of printed calibration patterns that are each constituted by one of the first-page calibration patterns and one of the second-page calibration patterns and include a printed superimposing portion where the first-page superimposing portion and the second-page superimposing portion are superimposed on each other based on the data on the color densities adjusted by the density adjustment processing, wherein a color density of the printed superimposing portion printed on the recording paper varies for each of the printed calibration patterns.

2. The thermal transfer printing apparatus according to claim 1 further comprising a calibration pattern selection receiver to receive a signal including data on the printed calibration pattern selected from among the plurality of printed calibration patterns that have been printed, wherein the density adjustment parameters associated with the first-page calibration pattern and the second-page calibration pattern constituting the printed calibration pattern thus selected are used in the panoramic image printing process.

3. The thermal transfer printing apparatus according to claim 1, wherein the printer makes a print to cause a color density of each of the printed calibration patterns in a primary scanning direction to increase stepwise from one end to an other end in the primary scanning direction.

4. The thermal transfer printing apparatus according to claim 3, wherein the data on the color density of each of the first-page calibration patterns and the data on the color density of each of the second-page calibration patterns acquired by the divided image data receiver are each set to cause a corresponding density to increase stepwise from one end to an other end in the primary scanning direction.

5. The thermal transfer printing apparatus according to claim 1, wherein the data on the color density of each of the first-page calibration patterns and the data on the color density of each of the second-page calibration patterns each represent a gradation value of a pixel to which line numbers are assigned in the primary scanning direction and a sub-scanning direction, the plurality of the density adjustment parameters each represent a predetermined density adjustment factor associated with the line number of the pixel in the sub-scanning direction, and the density adjustment processing adjusts the gradation value of the pixel associated with the density adjustment factor based on the density adjustment factor.

6. The thermal transfer printing apparatus according to claim 1, wherein the printer prints the first-page calibration image using a portion of one of the printing surfaces, and prints the second-page calibration image using an other portion of the printing surface used for printing the first-page calibration image.

7. The thermal transfer printing apparatus according to claim 1, wherein each of the printed calibration patterns includes a non-superimposing portion where the first-page calibration patterns and the second-page calibration patterns are not superimposed on each other.

8. A method for calibrating a thermal transfer printing apparatus comprising:

acquiring data representing a first-page calibration image including data on a color density of a plurality of first-page calibration patterns and data representing a second-page calibration image including data on a color density of a plurality of second-page calibration patterns;

adjusting data on a color density of a first-page superimposing portion that is superimposed on a corresponding one of the plurality of second-page calibration patterns during printing of the data on the color density of the plurality of first-page calibration patterns thus acquired using a density adjustment parameter associated with a corresponding one of the plurality of first-page calibration patterns and adjusting data on a color density of a second-page superimposing portion that is superimposed on a corresponding one of the plurality of first-page calibration patterns during printing of the data on the color density of the plurality of second-page calibration patterns thus acquired using a density adjustment parameter associated with a corresponding one of the plurality of second-page calibration patterns;

printing the first-page calibration image and the second-page calibration image on recording paper to form a plurality of printed calibration patterns that are each constituted by one of the first-page calibration patterns and one of the second-page calibration patterns and include a printed superimposing portion where the first-page superimposing portion and the second-page superimposing portion are superimposed on each other based on the data on the color densities thus adjusted and to make a color density of the printed superimposing portion different for each of the printed calibration patterns;

receiving a signal including data on the printed calibration pattern selected from among the plurality of printed calibration patterns printed on the recording paper; and storing, in a density adjustment parameter storage, the density adjustment parameters that are each associated with a corresponding one of the first-page calibration patterns and the second-page calibration patterns constituting the printed calibration pattern thus selected.

9. A printing method of a thermal transfer printing apparatus comprising:

acquiring data on a color of a first image and a color of a second image;

adjusting a portion of the data on the color of the first image thus acquired and a portion of the data on the color of the second image thus acquired using the density adjustment parameters stored in the density adjustment parameter storage in the method for calibrating a thermal transfer printing apparatus according to claim 8; and printing the first image and the second image using a plurality of printing surfaces arranged on an ink sheet to cause the portion of the first image thus adjusted and the portion of the second image thus adjusted to be superimposed on each other.

* * * * *